US009280974B2

(12) United States Patent
Kikuiri et al.

(10) Patent No.: US 9,280,974 B2
(45) Date of Patent: Mar. 8, 2016

(54) AUDIO DECODING DEVICE, AUDIO DECODING METHOD, AUDIO DECODING PROGRAM, AUDIO ENCODING DEVICE, AUDIO ENCODING METHOD, AND AUDIO ENCODING PROGRAM

(71) Applicant: NTT DOCOMO, Inc, Tokyo (JP)

(72) Inventors: Kei Kikuiri, Tokyo (JP); Choong Seng Boon, Tokyo (JP)

(73) Assignee: NTT DOCOMO, INC., Tokyo (JP)

( * ) Notice: Subject to any disclaimer, the term of this patent is extended or adjusted under 35 U.S.C. 154(b) by 317 days.

(21) Appl. No.: 13/765,109

(22) Filed: Feb. 12, 2013

(65) Prior Publication Data

US 2013/0159005 A1 Jun. 20, 2013

Related U.S. Application Data

(63) Continuation of application No. PCT/JP2011/068388, filed on Aug. 11, 2011.

(30) Foreign Application Priority Data

Aug. 13, 2010 (JP) ..... 2010-181345

(51) Int. Cl.
*G10L 19/00* (2013.01)
*G10L 19/18* (2013.01)
*G10L 19/22* (2013.01)

(52) U.S. Cl.
CPC ..... *G10L 19/00* (2013.01); *G10L 19/18* (2013.01); *G10L 19/22* (2013.01)

(58) Field of Classification Search
CPC ... G10L 19/00; G10L 19/0017; G10L 19/008; G10L 19/02; G10L 19/022; G10L 19/167
USPC ..... 704/500, 501, 503, 504
See application file for complete search history.

(56) References Cited

U.S. PATENT DOCUMENTS 6,658,381 B1 12/2003 Hellwig et al.
8,018,993 B2 9/2011 Yamanashi et al.

(Continued)

FOREIGN PATENT DOCUMENTS

JP 2000-267699 A 9/2000
JP 2001-53869 A 2/2001

(Continued)

OTHER PUBLICATIONS

Extended European Search Report for European Application No. 11816491.2, dated Mar. 5, 2014, 8 pages.

(Continued)

*Primary Examiner* — Qi Han

(74) *Attorney, Agent, or Firm* — Brinks Gilson & Lione

(57) ABSTRACT

In an audio decoding device of an embodiment, a plurality of decoding units execute different audio decoding schemes, respectively, to generate audio signals from coded sequences. An extraction unit extracts long-term encoding scheme information from a stream. The stream has a plurality of frames each including a coded sequence of an audio signal. The long-term encoding scheme information is a unit information for multiple frames and indicates that a common audio encoding scheme was used to generate coded sequences of the multiple frames. According to the extracted long-term encoding scheme information, a selection unit selects, from the plurality of decoding units, a decoding unit to be used commonly to decode the coded sequences of the multiple frames.

10 Claims, 53 Drawing Sheets

(56) References Cited

U.S. PATENT DOCUMENTS

| | | | | |
|---|---|---|---|---|
| 8,023,530 | B1 * | 9/2011 | Giallorenzi et al. | 370/469 |
| 8,099,291 | B2 | 1/2012 | Yamanashi et al. | |
| 2006/0271355 | A1 * | 11/2006 | Wang et al. | 704/220 |
| 2007/0223660 | A1 | 9/2007 | Dei et al. | |
| 2010/0114568 | A1 * | 5/2010 | Yoon et al. | 704/223 |
| 2010/0145688 | A1 | 6/2010 | Sung et al. | |
| 2011/0158326 | A1 * | 6/2011 | Kordon et al. | 375/240.25 |
| 2013/0021965 | A1 * | 1/2013 | Chu et al. | 370/328 |

FOREIGN PATENT DOCUMENTS

| | | | |
|---|---|---|---|
| JP | 2003-512639 | A | 4/2003 |
| JP | 2003-173622 | A | 6/2003 |
| JP | 2003-195894 | A | 7/2003 |
| JP | 2006-195144 | A | 7/2006 |
| JP | 2008-197199 | A | 8/2008 |
| WO | WO 2005/099243 | A1 | 10/2005 |
| WO | WO 2006/011444 | A1 | 2/2006 |
| WO | WO 2010/047566 | A2 | 4/2010 |

OTHER PUBLICATIONS

3GPP TS 26.290 V7.0.0, "Audio codec processing functions; Extended Adaptive Multi-Rate—Wideband (AMR-WB+) codec; Transcoding functions," 3rd Generation Partnership Project; Technical Specifications Group Service and System Aspects, Mar. 2007, 85 pages.

International Search Report for International Application No. PCT/JP2011/068388, dated Sep. 6, 2011, 2 pages.

* cited by examiner

*Fig.17*

| mod[k] | a(mod[k]) |
|---|---|
| 0 | 1 |
| 1 | 1 |
| 2 | 2 |
| 3 | 4 |

*Fig.20*

| | Conventional stream | Stream in an embodiment |
|---|---|---|
| header | header<br>AMRWPSampleEntry fields | header<br>AMRWPSampleEntry fields<br>GEM_ID |
| 1st frame | frame type 7 bits<br>Mode bits 2 bits<br>code sequence | frame type 7 bits<br>code sequence |
| 2nd frame | frame type 7 bits<br>Mode bits 2 bits<br>code sequence | frame type 7 bits<br>code sequence |
| ⋮ | ⋮ | ⋮ |
| m-th frame | frame type 7 bits<br>Mode bits 2 bits<br>code sequence | frame type 2 bits<br>code sequence |

*Fig.27*

| | Stream |
|---|---|
| 1st frame | extended encoding process information<br>code sequence |
| 2nd frame | code sequence |
| ⋮ | ⋮ |
| l-th frame | extended encoding process information<br>code sequence |
| ⋮ | ⋮ |
| m-th frame | code sequence |

*Fig.34*

| | Conventional stream | Stream in an embodiment |
|---|---|---|
| 1st frame | header<br>core_mode 1 bit<br>lpd_mode 4 bits<br>code sequence | header<br>extended encoding process information(GEM_ID) 1 bit<br>code sequence |
| 2nd frame | core_mode 1 bit<br>lpd_mode 4 bits<br>code sequence | code sequence |
| ⋮ | ⋮ | ⋮ |
| l-th frame | header<br>core_mode 1 bit<br>lpd_mode 4 bits<br>code sequence | header<br>extended encoding process information(GEM_ID) 1 bit<br>code sequence |
| ⋮ | ⋮ | ⋮ |
| m-th frame | core_mode 1 bit<br>lpd_mode 4 bits<br>code sequence | code sequence |

*Fig.48*

| | Conventional stream | Stream in an embodiment |
|---|---|---|
| 1st frame | frame type 7 bits<br>Mode bits 2 bits<br>code sequence | frame type 7 bits<br>GEM_ID<br>code sequence |
| 2nd frame | frame type 7 bits<br>Mode bits 2 bits<br>code sequence | frame type 7 bits<br>code sequence |
| | | |
| m-th frame | frame type 7 bits<br>Mode bits 2 bits<br>code sequence | frame type 7 bits<br>code sequence |

AUDIO DECODING DEVICE, AUDIO DECODING METHOD, AUDIO DECODING PROGRAM, AUDIO ENCODING DEVICE, AUDIO ENCODING METHOD, AND AUDIO ENCODING PROGRAM

RELATED APPLICATIONS

This application is a continuation of PCT/JP2011/068388 filed on Aug. 11, 2011, which claims priority to Japanese Application No. 2010-181345 filed on Aug. 13, 2010. The entire contents of these applications are incorporated herein by reference

TECHNICAL FIELD

A variety of aspects of the present invention relate to an audio decoding device, audio decoding method, audio decoding program, audio encoding device, audio encoding method, and audio encoding program.

BACKGROUND ART

In order to efficiently encode both speech and music signals, a complex audio encoding system is found effective which is used to switch between an encoding scheme suitable for speech signal and an encoding scheme suitable for music signal.

Patent Literature 1 below describes such a complex audio encoding system. In the audio encoding system described in Patent Literature 1, each frame is added with information indicative of the type of an encoding scheme used for generation of a coded sequence for the frame.

The audio encoding in MPEG USAC (Unified Speech and Audio Coding) uses three encoding processes, i.e., FD (Modified AAC (Advanced Audio Coding)), TCX (transform coded excitation), and ACELP (Algebraic Code Excited Linear Prediction). In MPEG USAC, TCX and ACELP are collectively recognized as LPD. In MPEG USAC, each frame is added with 1-bit information to indicate whether FD or LPD was used. When LPD is used in MPEG USAC, each frame is added with 4-bit information to define a procedure of using a combination of TCX and ACELP.

Furthermore, AMR-WB+ (Extended Adaptive Multi-Rate Wideband) of Third Generation Partnership Project (3GPP) uses two encoding schemes, i.e., TCX and ACELP. In AMR-WB+, each frame is added with 2-bit information to discern use of TCX or ACELP.

CITATION LIST

Patent Literature 1: Japanese Patent Application Laid-open No. 2000-267699

SUMMARY OF THE INVENTION

Technical Problem

There are audio signals in some cases which consist mainly of speech signals based on human voice, and there are audio signals in some other cases which consist mainly of music signals. In encoding such audio signals, a common encoding scheme is expected to be used for multiple frames. For such audio signals, there is demand for a technique to enable more efficient information transmission from the encoder side to the decoder side, for such audio signals.

It is an object of various aspects of the present invention to provide an audio encoding device, audio encoding method, and audio encoding program capable of generating a small-size stream and an audio decoding device, audio decoding method, and audio decoding program capable of using a small-size stream.

Solution to Problem

An aspect of the present invention relates to audio encoding and may include an audio encoding device, audio encoding method, and audio encoding program described below:

An audio encoding device according to an aspect of the present invention comprises a plurality of encoding units, a selection unit, a generation unit, and an output unit. The plurality of encoding units each perform a different audio encoding scheme to generate a coded sequence from audio signals. The selection unit selects, from the plurality of encoding units, an encoding unit which may be used commonly to encode audio signals of multiple frames, or selects from the same a set of encoding units which may each be used commonly to encode audio signals of multiple super-frames including a plurality of frames. The generation unit generates long-term encoding scheme information. The long-term encoding scheme information is a unit of information for multiple frames and indicates that a common audio encoding scheme was used to generate coded sequences of the multiple frames. Alternatively, the long-term encoding scheme information is a unit of information for multiple super-frames and indicates that a set of common audio encoding schemes were used to generate coded sequences of the multiple super-frames. The output unit outputs a stream which includes the coded sequences of the multiple frames generated by the encoding unit selected by the selection unit, or the coded sequences of the multiple super-frames generated by the set of encoding units selected by the selection unit, and the long-term encoding scheme information.

An audio encoding method according to another aspect of the present invention comprises: (a) a step of selecting, from a plurality of audio encoding schemes each different from each other, an audio encoding scheme which may be used commonly to encode audio signals of multiple frames, or selecting from the same a set of audio encoding schemes which may each be used commonly to encode audio signals of multiple super-frames which include a plurality of frames; (b) a step of encoding the audio signals of the multiple frames with the selected audio encoding scheme to generate coded sequences of the multiple frames, or encoding the audio signals of the multiple super-frames with the selected set of audio encoding schemes to generate coded sequences of the multiple super-frames; (c) a step of generating a unit of long-term encoding scheme information for the multiple frames indicative of the common audio encoding scheme used to generate the coded sequences of the multiple frames, or a unit of long-term encoding scheme information for the multiple super-frames indicative of the set of common audio encoding processes used to generate the coded sequences of the multiple super-frames; and (d) a step of outputting a stream including the coded sequences of the multiple frames or the coded sequences of the multiple super-frames, and the long-term encoding scheme information.

An audio encoding program according to another aspect of the present invention causes a computer to function as a plurality of encoding units, a selection unit, a generation unit, and an output unit.

Since the audio encoding device, the audio encoding method, and the audio encoding program according to the aspects of the present invention employ long-term encoding scheme information, the encoder side can notify the common audio encoding scheme used to generate the coded sequences of the multiple frames or the set of common audio encoding schemes used to generate the coded sequences of the multiple super-frames. With the long-term encoding scheme information so notified, the decoder side can select a common audio decoding scheme or a common set of audio decoding schemes. Therefore, it is possible to reduce an amount of information included in the stream and used to specify the audio encoding scheme.

In an embodiment, the stream may be configured to include multiple frames in which each of the frames coming subsequent to the lead frame does not have to include information for specifying an audio encoding scheme used to generate a coded sequence of the subsequent frames.

In another embodiment, an encoding unit (or a predetermined audio encoding scheme) may be pre-selected for the multiple frames from the plurality of encoding units (or the plurality of audio encoding schemes), and the stream may include no information for specifying the audio encoding scheme used to generate the coded sequences of the multiple frames. This embodiment enables a further reduction in the information amount of the stream. In another embodiment, the long-term encoding scheme information may be 1-bit information. This embodiment enables a further reduction in the information amount of the stream.

Aspects of the present invention relate to audio decoding and may include an audio decoding device, audio decoding method, and audio decoding program.

An audio decoding device according to an aspect of the present invention comprises a plurality of decoding units, an extraction unit, and a selection unit. The plurality of decoding units each perform a different audio decoding scheme to generate audio signals from coded sequences. The extraction unit extracts long-term encoding scheme information from a stream. The stream has multiple frames each including a coded sequence of an audio signal and/or multiple super-frames each including a plurality of frames. The long-term encoding scheme information is a unit of long-term encoding scheme information for multiple frames and indicates that a common audio encoding scheme was used to generate coded sequences of the multiple frames, or the long-term encoding scheme information is a unit of long-term encoding scheme information for multiple super-frames and indicates that a set of common audio encoding schemes were used to generate coded sequences of the multiple super-frames. The selection unit selects, from the plurality of decoding units, a decoding unit to be used commonly to decode the coded sequences of the multiple frames in response to extraction of the long-term encoding scheme information. Alternatively, the selection unit selects, from the plurality of decoding units, a set of decoding units to be used commonly to decode the coded sequences of the multiple super-frames.

An audio decoding method according to another aspect of the present invention comprises: (a) a step of extracting, from a stream having multiple frames each including a coded sequence of an audio signal and/or multiple super-frames each including a plurality of frames, a single unit long-term encoding scheme information for the multiple frames which indicates a common audio encoding used to generate the coded sequences of the multiple frames, or a single unit long-term encoding scheme information for the multiple super-frames which indicates a set of common audio encoding schemes used to generate the coded sequences of the multiple super-frames; (b) in response to extraction of the long-term encoding scheme information, a step of selecting, from a plurality of different audio decoding schemes, an audio decoding scheme used commonly to decode the coded sequences of the multiple frames or selecting from the same a set of audio decoding schemes used commonly to decode the coded sequences of the multiple super-frames; and (c) a step of decoding the coded sequences of the multiple frames with the selected audio decoding scheme or decoding the coded sequences of the multiple super-frames with the set of selected audio decoding schemes.

An audio decoding program according to another aspect of the present invention causes a computer to function as the plurality of decoding units, the extraction unit and the selection unit.

The audio decoding device, audio decoding method, and audio decoding program according to another aspect of the present invention can generate the audio signals from the stream generated based on the aforementioned aspects of the present invention concerning encoding.

In an embodiment, the stream may be configured so that each of the frames coming subsequent to the lead frame in the plurality of frames does not include information for specifying an audio encoding scheme used to generate coded sequences of the subsequent frames.

In another embodiment, a decoding unit (or a predetermined audio decoding scheme) may be pre-selected form the multiple frames from the plurality of decoding units (or the plurality of audio decoding schemes), and the stream may include no information for specifying the audio encoding scheme used to generate the coded sequences of the multiple frames. This embodiment enables a further reduction in the amount of information in the stream. In another embodiment, the long-term encoding scheme information may be 1-bit information. This embodiment enables a further reduction in the amount of information in the stream.

Advantageous Effect of Invention

As described above, the aspects of the present invention provide an audio encoding device, an audio encoding method, and an audio encoding program which generate a smaller size stream, and provide an audio decoding device, an audio decoding method, and an audio decoding program which use the smaller size stream.

BRIEF DESCRIPTION OF THE DRAWINGS

FIG. 17 is a drawing showing a relation between mod[k] and a(mod[k]).

FIG. 20 is a drawing showing a stream generated according to the conventional AMR WB+ and a stream generated by the audio encoding device shown in FIG. 19.

FIG. 27 is a drawing showing a stream generated by the audio encoding device shown in FIG. 26.

FIG. 34 is a drawing showing a stream generated according to the conventional MPEG USAC and a stream generated by the audio encoding device shown in FIG. 33.

FIG. 48 is a drawing showing a stream generated according to the conventional AMR WB+ and a stream generated by the audio encoding device shown in FIG. 47.

DETAILED DESCRIPTION OF THE PREFERRED EMBODIMENTS

Various embodiments will be described below in detail with reference to the drawings. Identical or equivalent portions will be denoted by the same reference signs throughout the drawings.

Figure 1:
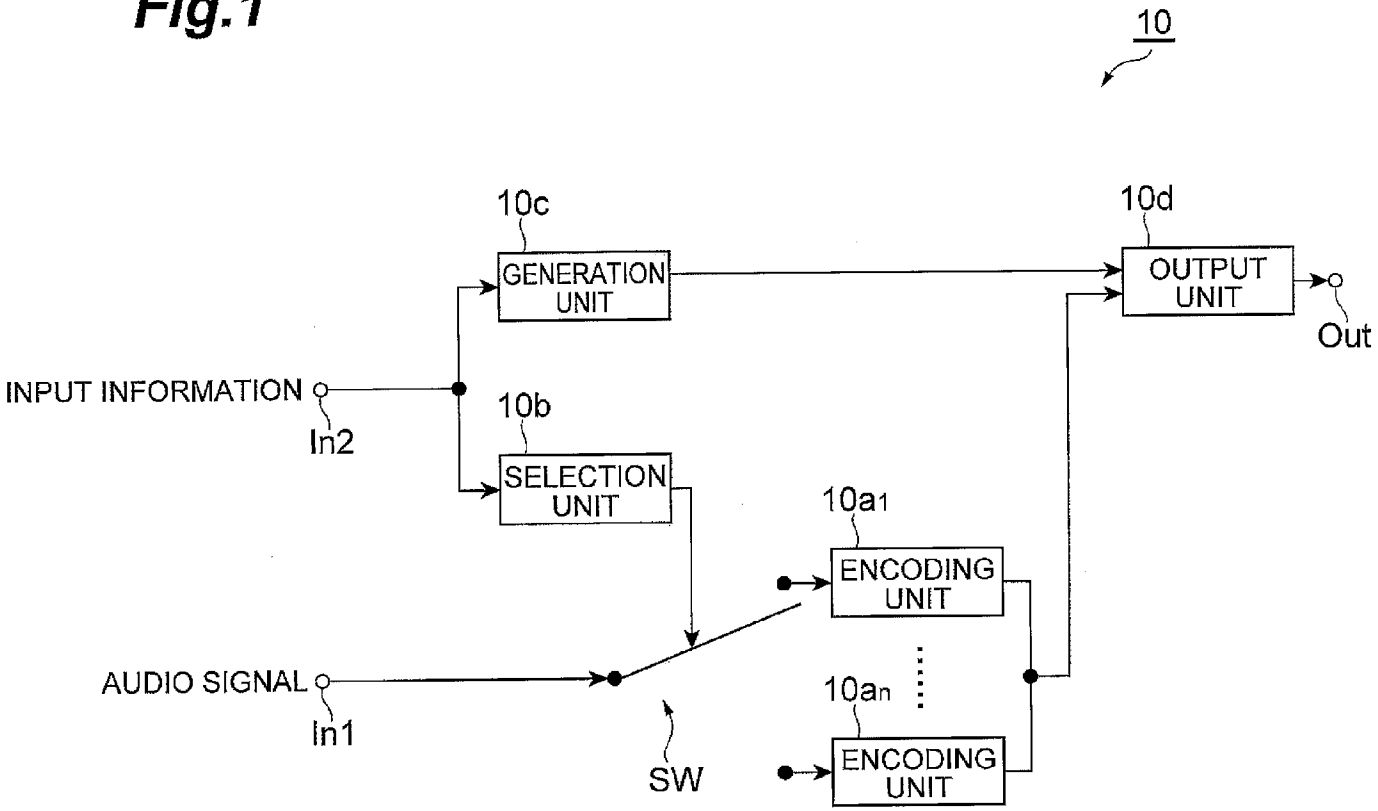
FIG. 1 is a drawing showing an audio encoding device according to one embodiment.

FIG. 1 is a drawing showing an audio encoding device according to an embodiment. The audio encoding device 10 shown in FIG. 1 is a device that encodes audio signals of multiple frames fed to an input terminal In1, using a common audio encoding scheme. As shown in FIG. 1, the audio encoding device 10 is formed with a plurality of encoding units $\mathbf{10}a_1$-$\mathbf{10}a_n$, a selection unit 10*b*, a generation unit 10*c*, and an output unit 10*d*. The number n herein is an integer not less than 2.

The encoding units $\mathbf{10}a_1$-$\mathbf{10}a_n$ each perform a different audio encoding scheme to generate coded sequences from the audio signals. These audio encoding schemes to be adopted may be any audio encoding schemes. For example, the audio encoding schemes adoptable herein may include Modified AAC encoding scheme, ACELP encoding scheme, and TCX encoding scheme.

The selection unit 10*b* selects one encoding unit from the encoding units $\mathbf{10}a_1$-$\mathbf{10}a_n$ according to input information fed to an input terminal In2. The input information is, for example, information entered by a user. In one embodiment, this input information may be information for specifying an audio encoding scheme used commonly for audio signals of multiple frames. The selection unit 10*b* controls a switch SW to selectively connect the input terminal In1 to an encoding unit of the encoding units $\mathbf{10}a_1$-$\mathbf{10}a_n$ to perform an audio encoding scheme specified by the input information.

The generation unit 10*c* generates long-term encoding scheme information, based on the input information. The long-term encoding scheme information indicates an audio encoding scheme used commonly to generate coded sequences of the multiple frames. The long-term encoding scheme information may be a unique word identifiable by the decoder side. In one embodiment, it may be any information that enables the decoder side to identify an audio encoding scheme used commonly to generate coded sequences of the multiple frames.

The output unit 10*d* outputs a stream which includes the coded sequences of the multiple frames generated by the selected encoding unit and the long-term encoding scheme information generated by the generation unit 10*c*.

Figure 2:
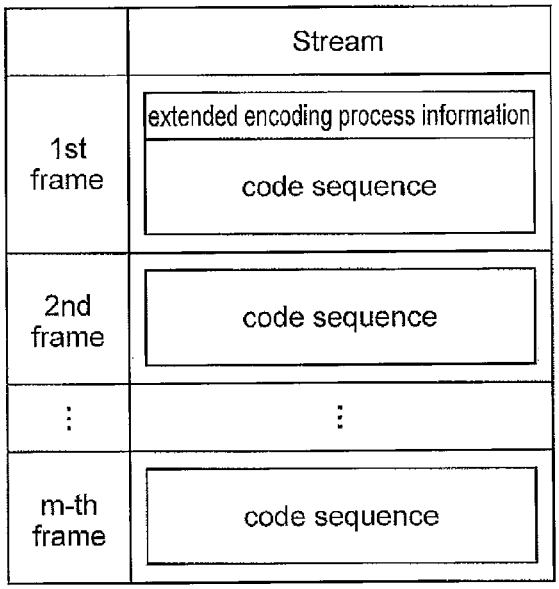
FIG. 2 is a drawing showing a stream generated by the audio encoding device according to one embodiment.

FIG. 2 is a drawing showing an exemplary stream generated by the audio encoding device according to one embodiment. The stream shown in FIG. 2 contains the first to the m-th frame. In this example, m is an integer not less than 2. In the description hereinafter, the frames in a stream will sometimes be referred to as output frames. Each output frame contains, as to an input audio signal, a coded sequence generated from the audio signal of a frame corresponding to the output frame. The first frame of the stream may include the long-term encoding scheme information as parameter information.

Figure 3:
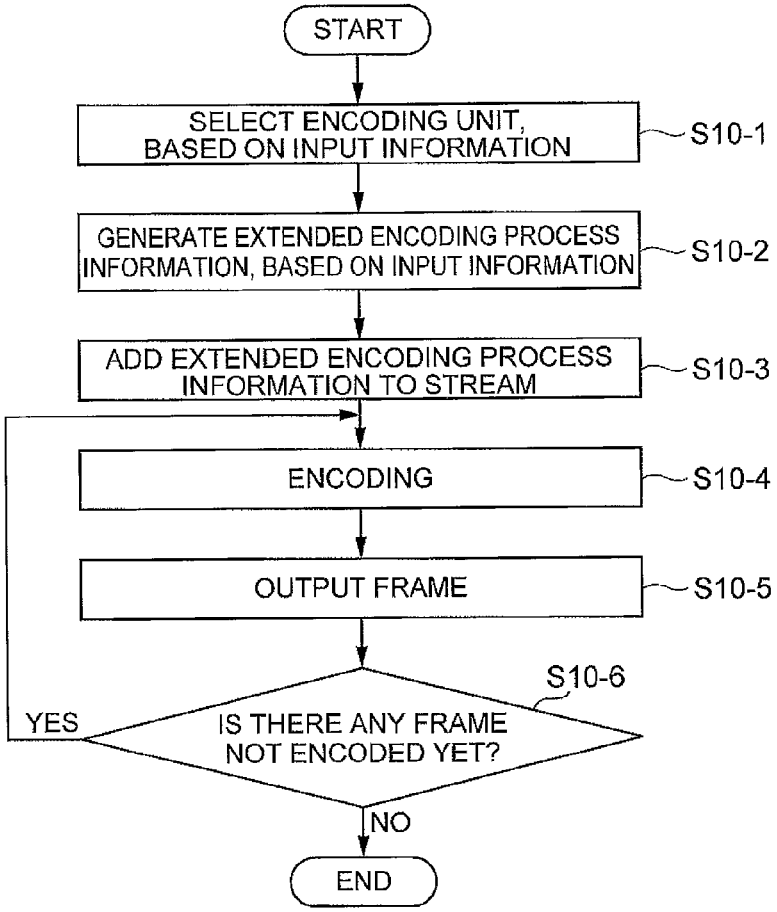
FIG. 3 is a flowchart showing an audio encoding method according to one embodiment.

Described below is an operation of the audio encoding device 10 and an audio encoding method of an embodiment. FIG. 3 is a flowchart showing the audio encoding method according to an embodiment. In the embodiment, as shown in FIG. 3, in step S10-1, the selection unit 10*b* selects one encoding unit from the encoding units $\mathbf{10}a_1$-$\mathbf{10}a_n$, based on the input information.

Next, in step S10-2, the generation unit 10*c* generates long-term encoding scheme information, based on the input information. In step S10-3, the output unit 10*d* adds the long-term encoding scheme information as parameter information to the first frame.

Next, in step S10-4, the encoding unit selected by the selection unit 10*b* encodes an audio signal of a current encoding target frame to generate a coded sequence. In subsequent step S10-5, the output unit 10*d* adds the coded sequence, generated by the encoding unit, into an output frame in a stream corresponding to the encoding target frame and outputs the output frame.

In subsequent step S10-5, it is determined whether there is any frame left to be encoded. The process ends when there is no frame left uncoded. On the other hand, when there is a further frame left to be encoded, the processes sequential from step S10-4 are repeated for the target uncoded frame.

According to the audio encoding device 10 and the audio encoding method of an embodiment described above, the long-term encoding scheme information is included only in the first frame in the stream. Namely, no information for specifying the used audio encoding scheme is included in the frames subsequent to the first frame in the stream. Therefore, it is possible to generate an efficient smaller size stream.

Figure 4:
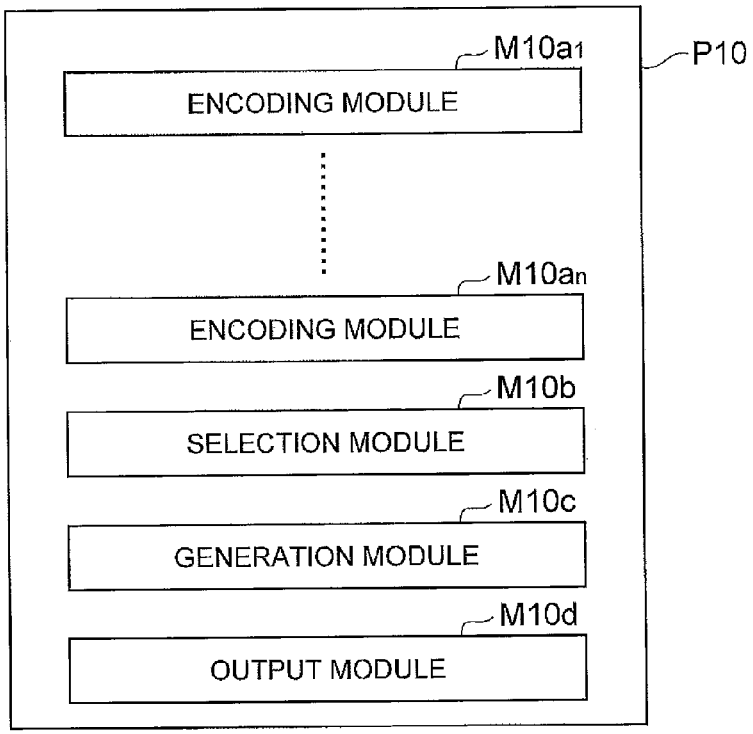
FIG. 4 is a drawing showing an audio encoding program according to one embodiment.
Figure 5:
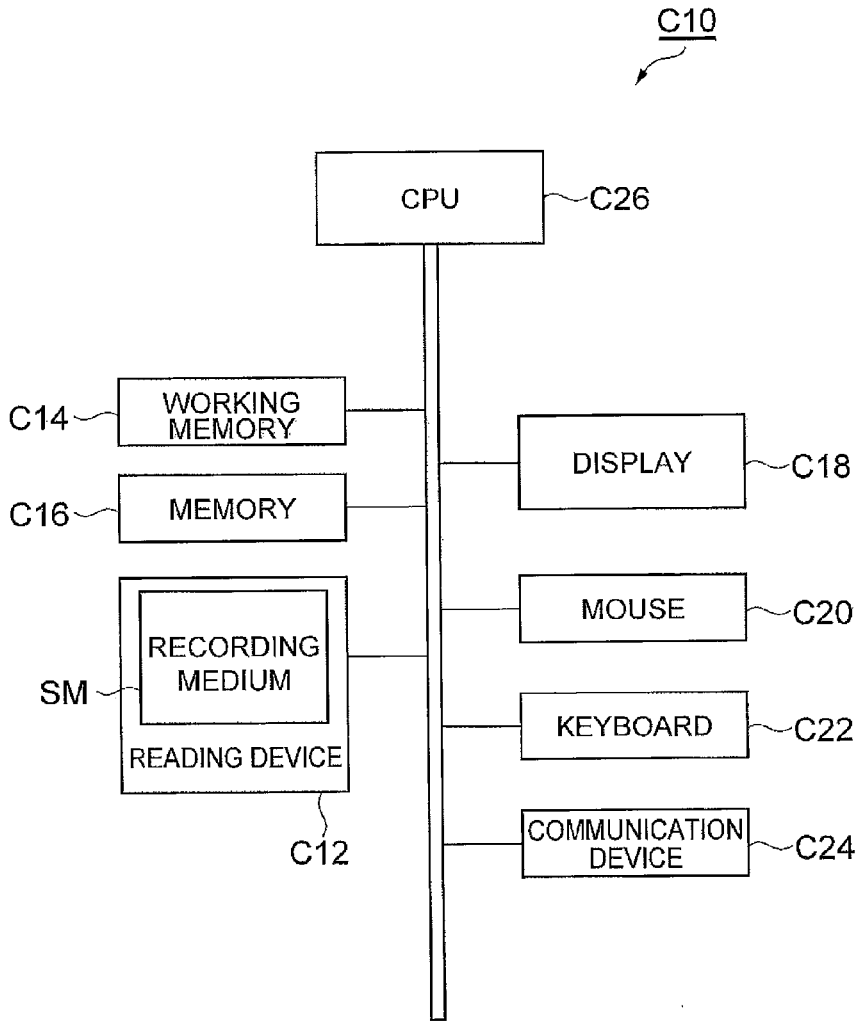
FIG. 5 is a drawing showing a hardware configuration of a computer according to one embodiment.
Figure 6:
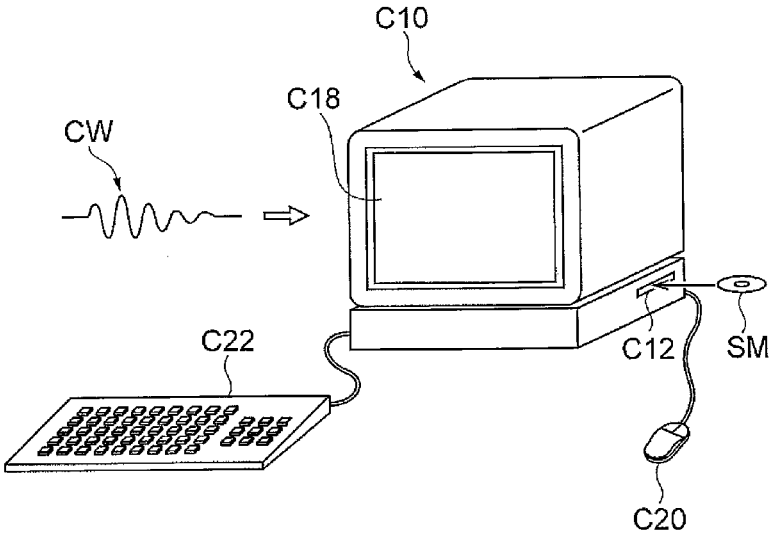
FIG. 6 is a perspective view showing a computer according to one embodiment.

Described below is a program that causes a computer to operate as the audio encoding device 10. FIG. 4 is a drawing showing an audio encoding program according to an embodiment. FIG. 5 is a drawing showing the hardware configuration of a computer according to an embodiment. FIG. 6 is a perspective view showing the computer according to the embodiment. The audio encoding program P10 shown in FIG. 4 causes the computer C10 shown in FIG. 5 to operate as the audio encoding device 10. The program described in the present specification can operates any device, other than the computer shown in FIG. 5, such as a cell phone or a mobile information terminal, according to the program.

The audio encoding program P10 may be stored in a recording medium SM. The recording medium SM may, for example, be a recording medium such as a floppy disk, CD-ROM, DVD, or ROM, or a semiconductor memory or the like.

As shown in FIG. 5, the computer C10 may be provided with a reading device C12 such as a floppy disk drive unit, CD-ROM drive unit, or DVD drive unit, a working memory (RAM) C14 in which an operating system resides, a memory C16 to store a program recorded in the recording medium SM, a monitor device C18 such as a display, a mouse C20 and a keyboard C22 as input devices, a communication device C24 to perform transmission and reception of data or the like, and a CPU C26 to control the execution of the program.

When the recording medium SM is incorporated into the reading device C12, the computer C10 becomes accessible to the audio encoding program P10 stored in the recording medium SM, through the reading device C12, and becomes able to operate as the audio encoding device 10 according to the program P10.

As shown in FIG. 6, the audio encoding program P10 may be provided through a network in the form of a computer data signal CW superimposed on a carrier wave. In this case, the computer C10 can store the audio encoding program P10 received by the communication device C24 into the memory C16 and execute the program P10.

As shown in FIG. 4, the audio encoding program P10 is provided with a plurality of encoding modules M10$a_1$-M10$a_n$, a selection module M10*b*, a generation module M10*c*, and an output module M10*d*.

In one embodiment, the encoding module sections M10$a_1$-M10$a_n$, the selection module M10*b*, the generation module M10*c*, and the output module M10*d* cause the computer C10 to perform the same functions as performed by the encoding units $\mathbf{10}a_1$-$\mathbf{10}a_n$, the selection unit 10*b*, the generation unit 10*c*, and the output unit 10*d*, respectively. According to this audio encoding program P10, the computer C10 becomes able to operate as the audio encoding device 10.

Figure 7:
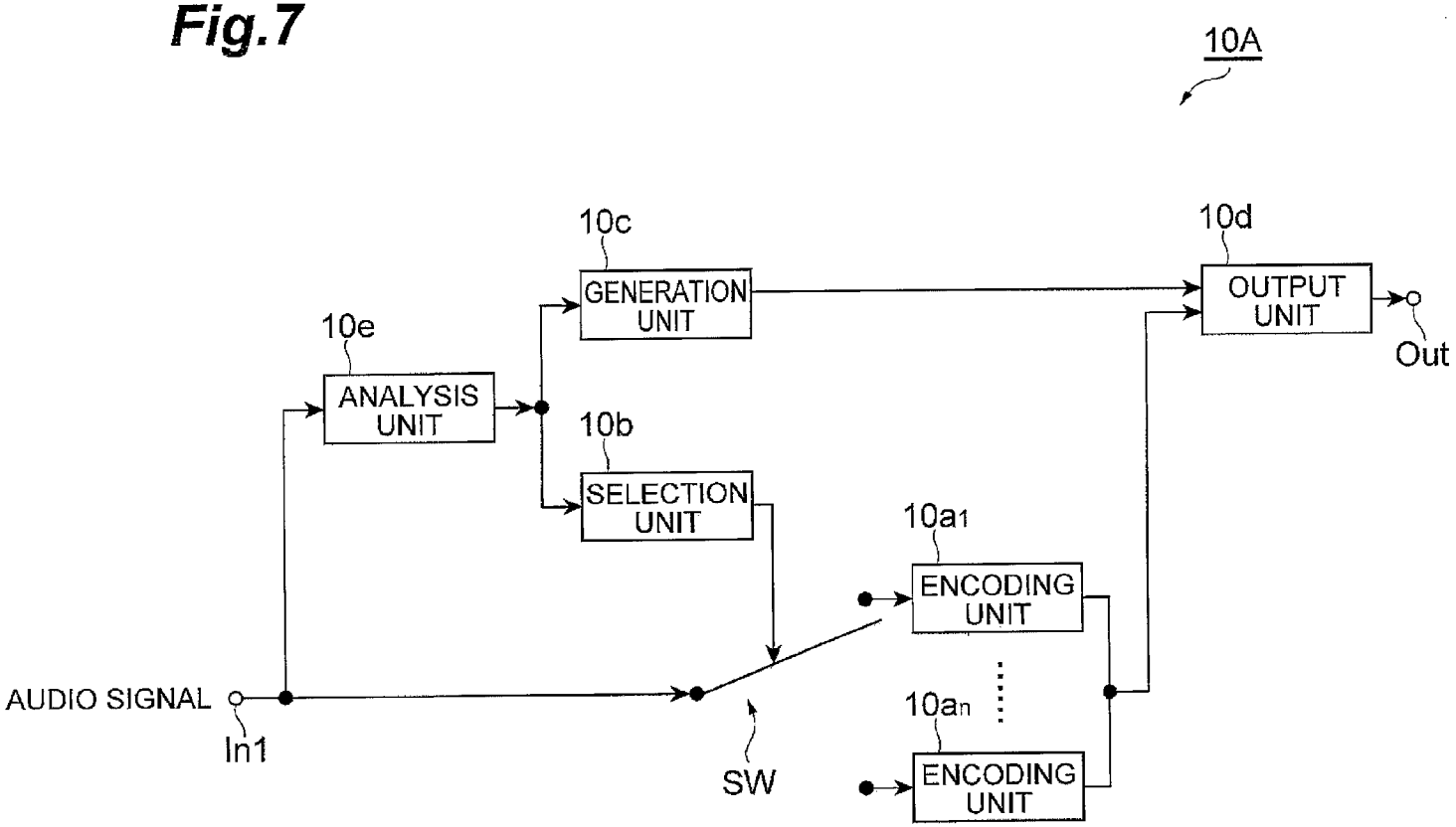
FIG. 7 is a drawing showing an audio encoding device according to a modified embodiment.

A modified embodiment of the audio encoding device 10 will be described below. FIG. 7 is a drawing showing an audio encoding device according to the modification embodiment. The encoding unit (encoding scheme) of the audio encoding device 10 is selected based on input information. On the other hand, an encoding unit of an audio encoding device 10A shown in FIG. 7 is selected based on a result of an analysis made on an audio signal. For this purpose, the audio encoding device 10A is provided with an analysis unit 10*e*.

The analysis unit 10*e* analyzes audio signals of multiple frames to determine an audio encoding scheme suitable to encode the audio signals of the multiple frames. The analysis unit 10*e* supplies information for specifying the determined audio encoding scheme to the selection unit 10*b* to instruct the selection unit 10*b* to select a encoding unit to execute the audio encoding scheme. Furthermore, the analysis unit 10*e* supplies the information for specifying the determined audio encoding scheme to the generation unit 10*c* to instruct the generation unit 10*c* to generate a long-term encoding scheme information.

The analysis unit 10*e* may analyze, for example, a tonality, a pitch period, a temporal envelope, or a transient component (sudden signal rise/fall) of an audio signal. For example, when a tonality of the audio signal is stronger than a predetermined tonality, the analysis unit 10*e* may determine to use an audio encoding scheme that performs encoding in the frequency domain. Furthermore, for example, when a pitch period of the audio signal is within a predetermined range, the analysis unit 10*e* may determine to use an audio encoding scheme suitable to encode the audio signal. Furthermore, for example, when a variation of the temporal envelope of the audio signal is larger than a predetermined variation or when the audio signal includes a transient component, the analysis unit 10*e* may determine to use an audio encoding scheme that performs encoding in the time domain.

Figure 8:
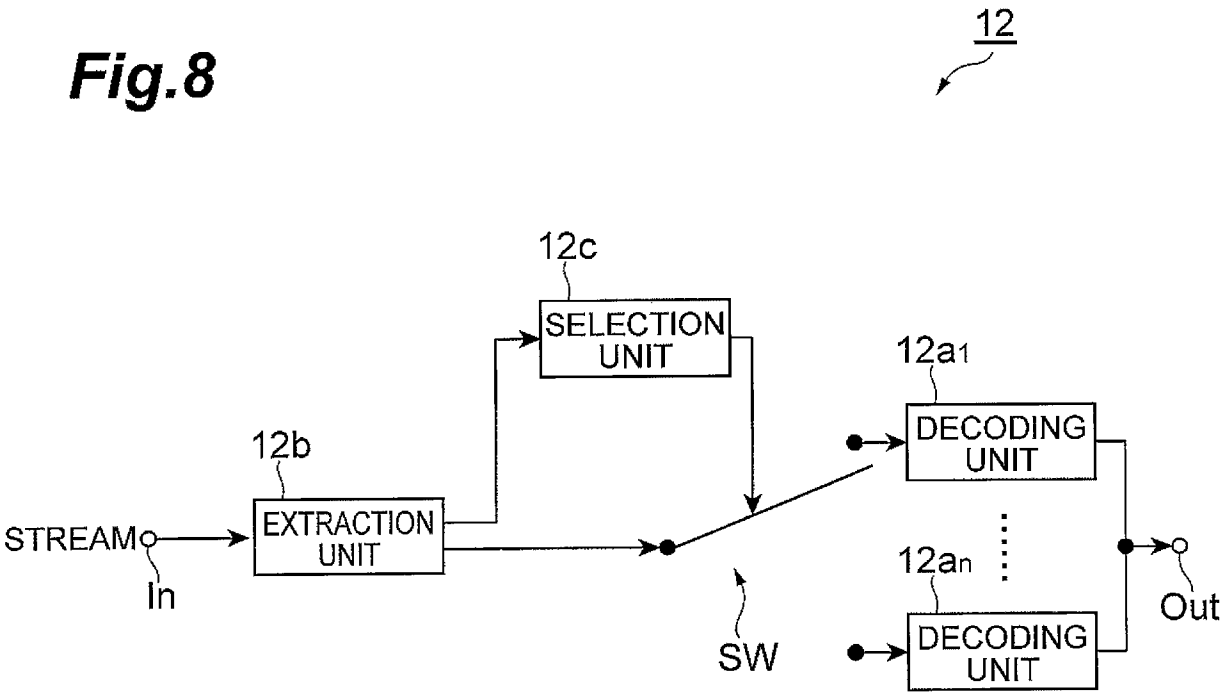
FIG. 8 is a drawing showing an audio decoding device according to one embodiment.

Described below is an audio decoding device that decodes a stream generated by the audio encoding device 10. FIG. 8 is a drawing showing an audio decoding device according to an embodiment. An audio decoding device 12 shown in FIG. 8 is comprised of a plurality of decoding units $\mathbf{12}a_1$-$\mathbf{12}a_n$, an extraction unit 12$b$, and a selection unit 12$c$. The decoding units 12$a_1$-12$a_n$ each execute a different audio decoding scheme to generate audio signals from coded sequences. The schemes performed by the decoding units 12$a_1$-12$a_n$ are complementary to the schemes performed by the encoding units 10$a_1$-10$a_n$.

The extraction unit 12$b$ extracts a long-term encoding scheme information (cf. FIG. 3) from a stream fed to an input terminal In. The extraction unit 12$b$ supplies the extracted long-term encoding scheme information to the selection unit 12$c$ and outputs the rest of the stream exclusive of the long-term encoding scheme information to a switch SW.

The selection unit 12$c$ controls a switch SW, based on the long-term encoding scheme information. The selection unit 12$c$ selects, from the decoding units 12$a_1$-12$a_n$, a decoding unit to execute a decoding scheme specified based on the long-term encoding scheme information. The selection unit 12$c$ controls the switch SW so as to connect multiple frames in the stream to the selected decoding unit.

Figure 9:
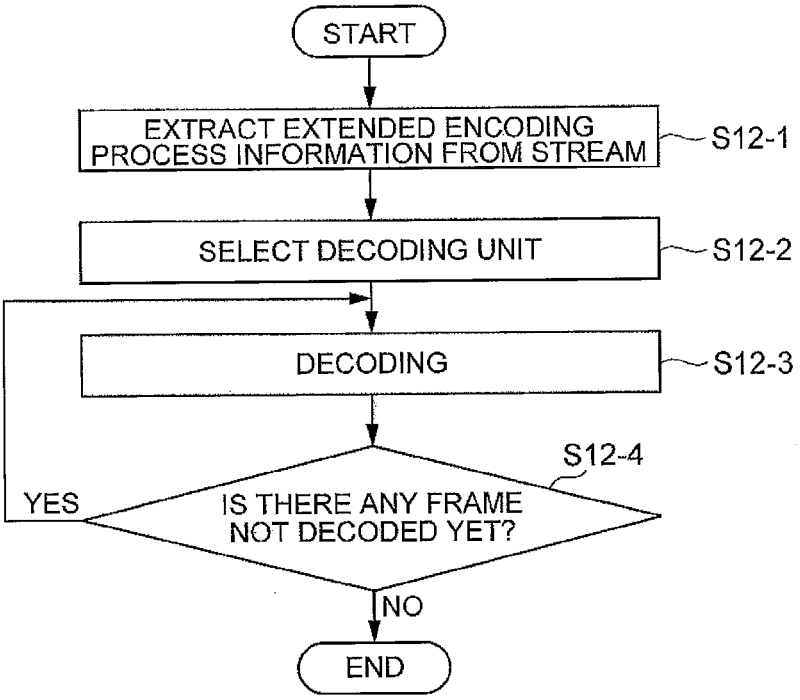
FIG. 9 is a flowchart showing an audio decoding method according to one embodiment.

Described below is an operation of the audio decoding device 12 and an audio decoding method according to an embodiment. FIG. 9 is a flowchart showing an audio decoding method according to an embodiment. In the embodiment, as shown in FIG. 9, in step S12-1, the extraction unit 12$b$ extracts a long-term encoding scheme information from a stream. In step S12-2, the selection unit 12$c$ selects one decoding unit from the decoding units 12$a_1$-12$an$ according to the extracted long-term encoding scheme information.

In step S12-3, the selected decoding unit decodes a coded sequence of a decoding target frame. Next, it is determined in step S12-4 whether there is any frame left to be decoded. When there is no frame left undecoded, the process ends. On the other hand, when there is a frame left to be decoded, the processes including step S12-3 are repeated for a target frame, using the decoding unit selected in step S12-2.

Figure 10:
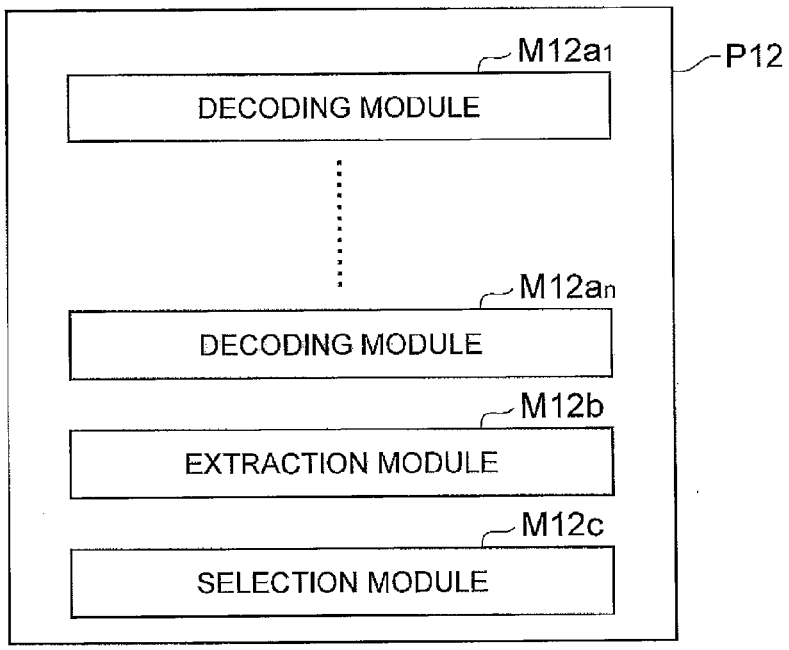
FIG. 10 is a drawing showing an audio decoding program according to one embodiment.

Described below is an audio decoding program that causes a computer to operate as the audio decoding device 12. FIG. 10 shows an audio decoding program according to one embodiment.

An audio decoding program P12 shown in FIG. 10 may be executed in the computer shown in FIGS. 5 and 6. The audio decoding program P12 may be provided in the same manner as the audio encoding program P10 is provided.

As shown in FIG. 10, the audio decoding program P12 is comprised of decoding modules M12$a_1$-M12$a_n$, an extraction module M12$b$, and a selection module M12$c$. The decoding modules M12$a_1$-M12$a_n$, the extraction module M12$b$, and the selection module M12$c$ cause the computer C10 to perform the same functions as performed by the decoding units 12$a_1$-12$a_n$, the extraction unit 12$b$, and the selection unit 12$c$, respectively.

Figure 11:
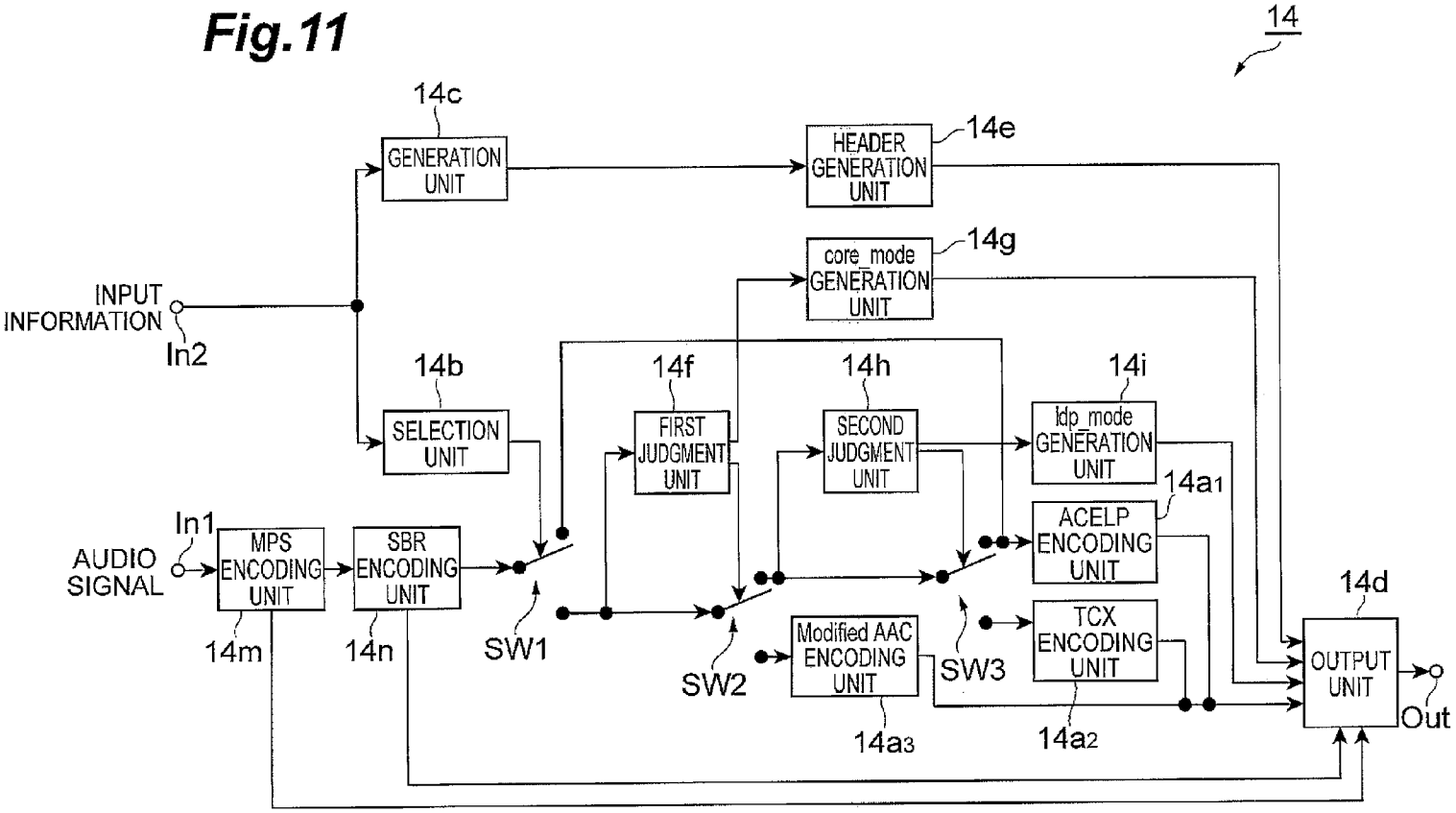
FIG. 11 is a drawing showing an audio encoding device according to another embodiment.

Described below is an audio encoding device according to another embodiment. FIG. 11 is a drawing showing an audio encoding device according to another embodiment. An audio encoding device 14 shown in FIG. 11 may be used in an extension of MPEG USAC.

Figure 12:
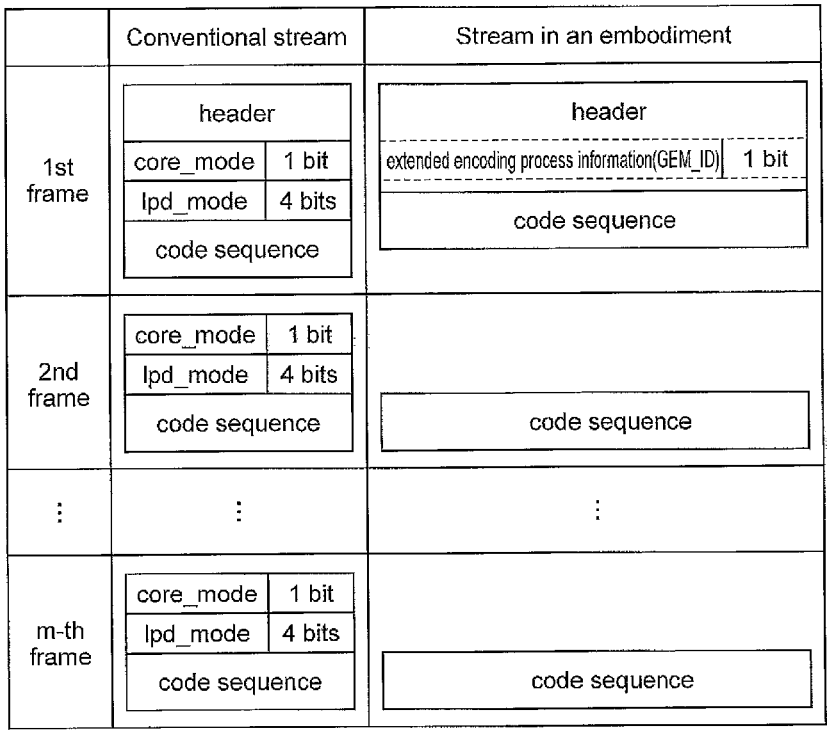
FIG. 12 is a drawing showing a stream generated according to the conventional MPEG USAC and a stream generated by the audio encoding device shown in FIG. 11.

FIG. 12 shows a stream generated according to the conventional MPEG USAC and a stream generated by the audio encoding device shown in FIG. 11. As shown in FIG. 12, in the conventional MPEG USAC, each frame in the stream is added with information i.e., with 1-bit core_mode, indicating whether FD (Modified AAC) or LPD (ACELP or TCX) was used. In the conventional MPEG USAC, a frame on which LPD is performed has a super-frame structure including four frames. When LPD is performed, a super-frame is added with information i.e., 4-bit lpd_mode, indicating whether ACELP or TXC was performed to encode each of frames in the super-frame.

The audio encoding device 14 shown in FIG. 11 encodes audio signals of all frames by a common audio encoding scheme. The audio encoding device 14 also selectively perform an audio encoding scheme on the respective frames, frame by frame, in the same manner as in the case of the conventional MPEG_USAC. In one embodiment, the audio encoding device may use LPD, i.e., a set of audio encoding schemes, commonly on every super-frame.

As shown in FIG. 11, the audio encoding device 14 is comprised of an ACELP encoding unit 14$a_1$, a TCX encoding unit 14$a_2$, a Modified AAC encoding unit 14$a_3$, a selection unit 14$b$, a generation unit 14$c$, an output unit 14$d$, a header generation unit 14$e$, a first judgment unit 14$f$, a core_mode generation unit 14$g$, a second judgment unit 14$h$, an lpd_mode generation unit 14$i$, an MPS encoding unit 14$m$, and an SBR encoding unit 14$n$.

The MPS encoding unit 14$m$ receives an audio signal fed to an input terminal In1. The audio signal fed to the MPS encoding unit 14$m$ may be a multichannel audio signal of two or more channels. The MPS encoding unit 14$m$ expresses a multichannel audio signal of each frame with an audio signal of channels whose channel number is less than the number of channels in the multichannel signal and a parameter for decoding the multichannel audio signal from the audio signal of channels whose channel number is less than the aforementioned number.

When the multichannel audio signal is a stereo signal, the MPS encoding unit 14$m$ downmixes the stereo signal to a monaural audio signal. The MPS encoding unit 14$m$ generates a level difference, a phase difference, and/or a correlation value between the monaural signal and each channel of the stereo signal, as a parameter for decoding the stereo signal from the monaural signal. The MPS encoding unit 14$m$ outputs the generated monaural signal to the SBR encoding unit 14$n$ and outputs encoded data obtained by encoding the generated parameter to the output unit 14$d$. The stereo signal may be expressed with the monaural signal and a residual signal and with the parameter.

The SBR encoding unit 14$n$ receives the audio signal of each frame from the MPS encoding unit 14$m$. The audio signal received by the SBR encoding unit 14$n$ may, for example, be the aforementioned monaural signal. When the audio signal fed to the input terminal In1 is a monaural signal, the SBR encoding unit 14$n$ accepts the audio signal. With reference to a predetermined frequency, the SBR encoding unit 14$n$ generates a low frequency band audio signal and a high frequency band audio signal from the input audio signal. Furthermore, the SBR encoding unit 14$n$ calculates a parameter for generating the high frequency band audio signal from the low frequency band audio signal. The parameter to be used herein can, for example, be any information such as frequency information indicative of the predetermined frequency, time-frequency resolution information, spectrum envelope information, additive noise information, and additive sinusoidal information. The SBR encoding unit 14$n$ outputs the low frequency band audio signal to a switch SW1. Furthermore, the SBR encoding unit 14$n$ outputs encoded data obtained by encoding the calculated parameter to the output unit 14$d$.

The encoding unit 14$a_1$ encodes the audio signal with the ACELP encoding scheme to generate a coded sequence. The encoding unit 14$a_2$ encodes the audio signal with the TCX encoding scheme to generate a coded sequence. The encoding unit 14$a_3$ encodes the audio signal with the Modified AAC encoding scheme to generate a coded sequence.

The selection unit 14*b* selects an encoding unit to encode audio signals of multiple frames fed to the switch SW1, according to the input information fed to the input terminal In2. In the present embodiment, the input information may be entered by a user. The input information may indicate whether multiple frames are to be encoded with a common encoding scheme.

In the present embodiment, when the input information indicates that multiple frames are to be encoded with a common audio encoding scheme, the selection unit 14*b* selects a predetermined encoding unit to execute the predetermined encoding scheme. For example, when the input information indicates that multiple frames are to be encoded by a common audio encoding scheme, as described, the selection unit 14*b* controls the switch SW1 to select the ACELP encoding unit 14$a_1$ as the predetermined encoding unit. In the present embodiment, therefore, when the input information indicates that multiple frames are to be encoded by a common audio encoding scheme, the ACELP encoding unit 14$a_1$ encodes the audio signals of the multiple frames.

On the other hand, when the input information indicates that multiple frames are not to be encoded by a common audio encoding scheme, the selection unit 14*b* connects the audio signal of each frame fed to the switch SW1 to a path leading to the first judgment unit 14*f* and others.

The generation unit 14*c* generates the long-term encoding scheme information, based on the input information. As shown in FIG. 12, the long-term encoding scheme information to be used may be a 1-bit GEM_ID. When the input information indicates that multiple frames are to be encoded by a common audio encoding scheme, the generation unit 14*c* sets GEM_ID to the value "1." On the other hand, when the input information indicates that multiple frames are not to be encoded by a common audio encoding scheme, the generation unit 14*c* sets GEM_ID to the value "0."

The header generation unit 14*e* generates a header to be included in a stream, and adds the set value of GEM_ID into the header. As shown in FIG. 12, this header is included in the first frame, when outputted from the output unit 14*d*.

When the input information indicates that multiple frames are not to be encoded by a common audio encoding scheme, the first judgment unit 14*f* receives an audio signal of an encoding target frame via the SW1. The first judgment unit 14*f* analyzes the audio signal of the encoding target frame to judge whether the audio signal is to be encoded by the Modified AAC encoding unit 14$a_3$.

When the first judgment unit 14*f* determines that the audio signal of the encoding target frame is to be encoded by the Modified AAC encoding unit 14$a_3$, it controls a switch SW2 to connect the frame to the Modified AAC encoding unit 14$a_3$.

On the other hand, when the first judgment unit 14*f* determines that the audio signal of the encoding target frame is not to be encoded by the Modified AAC encoding unit 14$a_3$, it controls the switch SW2 to connect the frame to the second judgment unit 14*h* and a switch SW3. In this case, the encoding target frame is divided into four frames in a subsequent process and is handled as a super-frame including the four frames.

The first judgment unit 14*f* may, for example, analyzes the audio signal of the encoding target frame and when the audio signal has tone components over a predetermined amount, selects the Modified AAC encoding unit 14$a_3$ as an encoding unit for the speech signal of the frame.

The core_mode generation unit 14*g* generates core_mode according to the judgment result by the first judgment unit 14*f*. As shown in FIG. 12, core_mode is 1-bit information. When the first judgment unit 14*f* determines that the audio signal of the encoding target frame is to be encoded by the Modified AAC encoding unit 14$a_3$, the core_mode generation unit 14*g* sets core_mode to the value "0." On the other hand, when the first judgment unit 14*f* determines that the audio signal of the judgment target frame is not to be encoded by the Modified AAC encoding unit 14$a_3$, the core_mode generation unit 14*g* sets core_mode to the value "1." This core_mode is added as parameter information to an output frame in a stream corresponding to the encoding target frame, when outputted from the output unit 14*d*.

The second judgment unit 14*h* receives an audio signal of an encoding target super-frame via the switch SW2. The second judgment unit 14*h* judges whether an audio signal of each frame in the encoding target super-frame is to be encoded by the ACELP encoding unit 14$a_1$ or by the TCX encoding unit 14$a_2$.

When the second judgment unit 14*h* determines that the audio signal of the encoding target frame is to be encoded by the ACELP encoding unit 14$a_1$, it controls the switch SW3 to connect the audio signal of the frame to the ACELP encoding unit 14$a_1$. On the other hand, when the second judgment unit 14*h* determines that the audio signal of the encoding target frame is to be encoded by the TCX encoding unit 14$a_2$, it controls the switch SW3 to connect the audio signal of the frame to the TCX encoding unit 14$a_2$.

For example, when the audio signal of the encoding target frame is a signal with a strong voice component, when a temporal envelope of the audio signal varies greater than a predetermined variation in a short period, or when the audio signal contains a transient component, the second judgment unit 14*h* may determine that the audio signal is to be encoded by the ACELP encoding unit 14$a_1$. Otherwise, the second judgment unit 14*h* may determine that the audio signal is to be encoded by the TCX encoding unit 14$a_2$. The audio signal may be determined to include a strong voice component when a pitch period of the audio signal is within a predetermined range, when an autocorrelation among pitch periods is stronger than a predetermined autocorrelation, or when a zero-cross rate is smaller than a predetermined rate.

The lpd_mode generation unit 14*i* generates lpd_mode according to the judgment result by the second judgment unit 14*h*. As shown in FIG. 12, lpd_mode is 4-bit information. The lpd_mode generation unit 14*i* sets the value of lpd_mode to a predetermined value corresponding to the judgment result from the second judgment unit 14*h* on the audio signal of each frame in the super-frame. The value of lpd_mode set by the lpd_mode generation unit 14*i* is added to an output super-frame in a stream corresponding to the encoding target super-frame, when outputted from the output unit 14*d*.

The output unit 14*d* outputs a stream. The stream contains the first frame with the header including the aforementioned GEM_ID and a corresponding coded sequence and contains the second to m-th frames (m is an integer not less than 2) added with respective corresponding coded sequences. Furthermore, the output unit 14*d* adds in each output frame the encoded data of the parameter generated by the MPS encoding unit 14*m* and the encoded data of the parameter generated by the SBR encoding unit 14*n*.

Figure 13:
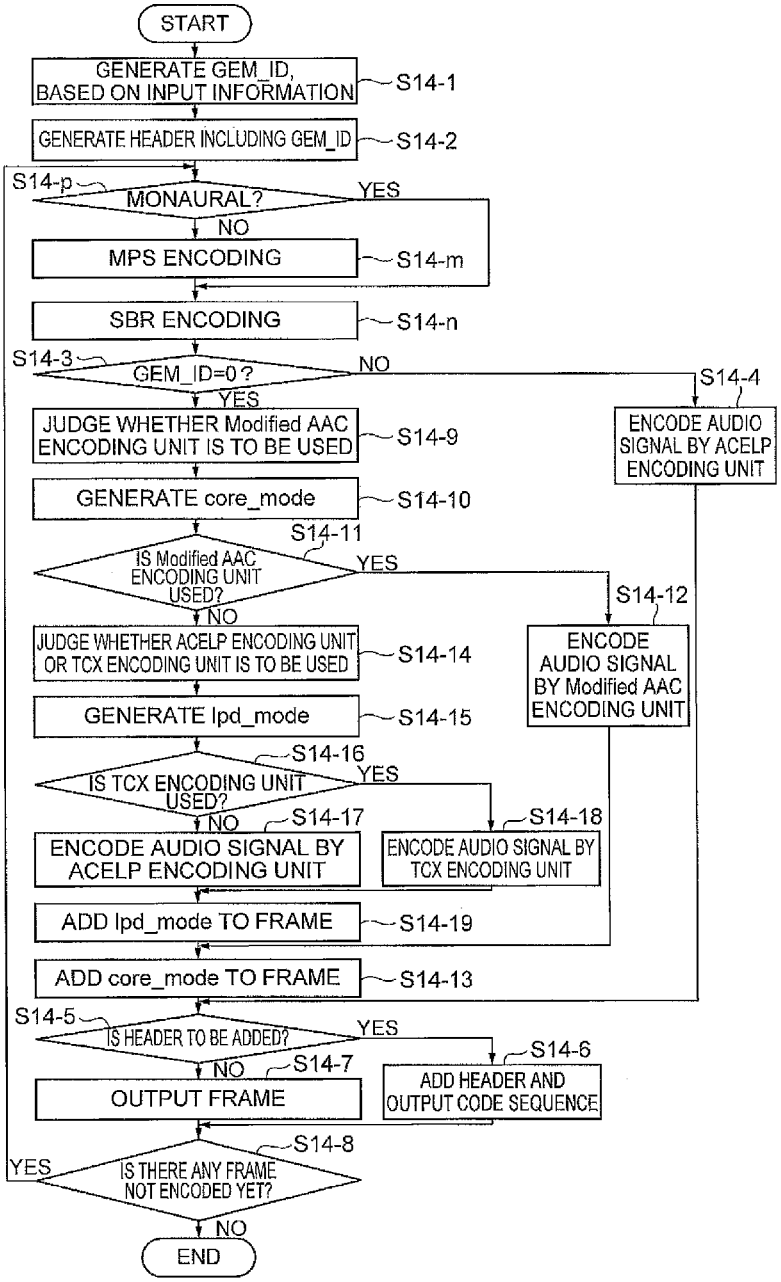
FIG. 13 is a flowchart of an audio encoding method according to another embodiment.

Described below is an operation of the audio encoding device 14 and an audio encoding method according to another embodiment. FIG. 13 is a flowchart of the audio encoding method according to the embodiment.

In one embodiment, as shown in FIG. 13, in step S14-1, the generation unit 14*c* generates (or sets) GEM_ID as described above, based on the input information. In subsequent step S14-2, the header generation unit 14*e* generates a header including the set GEM_ID.

Next, when it is determined by a judgment in step S14-*p* that an audio signal fed to the input terminal In1 is a multichannel signal, step S14-*m* is carried out in which the MPS encoding unit 14*m* generates, from the multichannel audio signal of the input encoding target frame, an audio signal of channels whose channel number is less than the number of channels of the multichannel signal and a parameter for decoding of the multichannel audio signal from the audio signal of channels whose channel number is less than the foregoing number, as described above. The MPS encoding unit 14*m* generates encoded data of the parameter. This encoded data is added in a corresponding output frame by the output unit 14*d*. On the other hand, when the audio signal fed to the input terminal In1 is a monaural signal, the MPS encoding unit 14*m* does not operate such that the audio signal fed to the input terminal In1 is fed to the SBR encoding unit 14*n*.

Next, in step S14-*n*, the SBR encoding unit 14*n* generates a low frequency band audio signal from the input audio signal and a parameter for generation of a high frequency band audio signal from the low frequency band audio signal, as described above. The SBR encoding unit 14*n* generates encoded data of the parameter. This encoded data is added in a corresponding output frame by the output unit 14*d*.

Next, in step S14-3, the selection unit 14*b* judges whether audio signals of multiple frames, i.e., low frequency band audio signals of multiple frames outputted from the SBR encoding unit 14*n*, are to be encoded by a common audio encoding scheme, based on the input information.

When in step S14-3, the input information indicates that audio signals of multiple frames are to be encoded by a common audio encoding scheme, i.e., when the value of GEM_ID is "1," the selection unit 14*b* selects the ACELP encoding unit 14$a_1$.

Next, in step S14-4, the ACELP encoding unit 14$a_1$ selected by the selection unit 14*b* encodes an audio signal of an encoding target frame to generate a coded sequence.

Next, in step S14-5, the output unit 14*d* determines whether a header is to be added to a frame. In step S14-5, when the encoding target frame is the first frame, the output unit 14*d* determines that the header is to be added to the first frame in the stream corresponding to the encoding target frame, and in subsequent step S14-6, the output unit 14*d* adds the header and coded sequence in the first frame and outputs the first frame. On the other hand, when the target frame is the second frame or a frame subsequent thereto, no header is added and, in step S14-7, the output unit 14*d* adds a coded sequence in the frame and outputs it.

Next, it is determined in step S14-8 whether there is any frame left to be encoded. When there is no frame left uncoded, the process ends. On the other hand, there is a frame left to be encoded, the process from step S14-*p* is repeated for a target frame left to be encoded.

In the present embodiment, as described above, while the value of GEM_ID is "1," the ACELP encoding unit 14$a_1$ is continuously used to encode all audio signals of multiple frames.

When it is determined in step S14-3 that the value of GEM_ID is "0," i.e., when the input information indicates that each frame is to be processed by an individual encoding scheme method, step S14-9 is carried out in which the first judgment unit 14*f* judges whether the audio signal of the encoding target frame, i.e., the low frequency band audio signal of the encoding target frame outputted from the SBR encoding unit 14*n* is to be encoded by the Modified AAC encoding unit 14$a_3$. In subsequent step S14-10, the core_mode generation unit 14*g* sets the value of core_mode to a value according to the judgment result by the first judgment unit 14*f*.

Next, it is determined in step S14-11 whether the judgment result by the first judgment unit 14*f* indicates that the audio signal of the encoding target frame is to be encoded by the Modified AAC encoding unit 14$a_3$. When the judgment result by the first judgment unit 14*f* indicates that the audio signal of the encoding target frame is to be encoded by the Modified AAC encoding unit 14$a_3$, subsequent step S14-12 is carried out in which the audio signal of the encoding target frame is encoded by the Modified AAC encoding unit 14$a_3$.

Next, in step S14-13, the output unit 14*d* adds core_mode to an output frame (or super-frame) in the stream corresponding to the encoding target frame. Then, the process proceeds to step S14-5.

When, in step S14-11, the judgment result by the first judgment unit 14*f* indicates that the audio signal of the encoding target frame is not to be encoded by the Modified AAC encoding unit 14$a_3$, the process from step S14-14 is carried out so as to process the encoding target frame as a super-frame.

In step S14-14, the second judgment unit 14*h* judges whether each frame in the super-frame is to be encoded by the ACELP encoding unit 14$a_1$ or by the TCX encoding unit 14$a_2$. In subsequent step S14-15, the lpd_mode generation unit 14*i* sets lpd_mode to a value according to the judgment result by the second judgment unit 14*h*.

Next, it is judged in step S14-16 whether the judgment result by the second judgment unit 14*h* indicates that the encoding target frame in the super-frame is to be encoded by the ACELP encoding unit 14$a_1$ or indicates that the encoding target frame is to be encoded by the TCX encoding unit 14$a_2$.

When the judgment result by the second judgment unit 14*h* indicates that the encoding target frame is to be encoded by the ACELP encoding unit 14$a_1$, step S14-17 is carried out in which the audio signal of the encoding target frame is encoded by the ACELP encoding unit 14$a_1$. On the other hand, when the judgment result by the second judgment unit 14*h* indicates that the encoding target frame is to be encoded by the TCX encoding unit 14$a_2$, step S14-18 is carried out in which the audio signal of the encoding target frame is encoded by the TCX encoding unit 14$a_2$.

Next, in step S14-19, lpd_mode is added to an output super-frame in the stream corresponding to the encoding target super-frame. Then the process proceeds to step S14-13.

According to the audio encoding device 14 and the audio encoding method described above, since GEM_ID set to "1" is included in the header, the decoder side is notified that audio signals of multiple frames were encoded only by the ACELP encoding unit, eliminating the need to include information for specifying the audio encoding scheme used in each frame. Therefore, a smaller size stream is generated.

Figure 14:
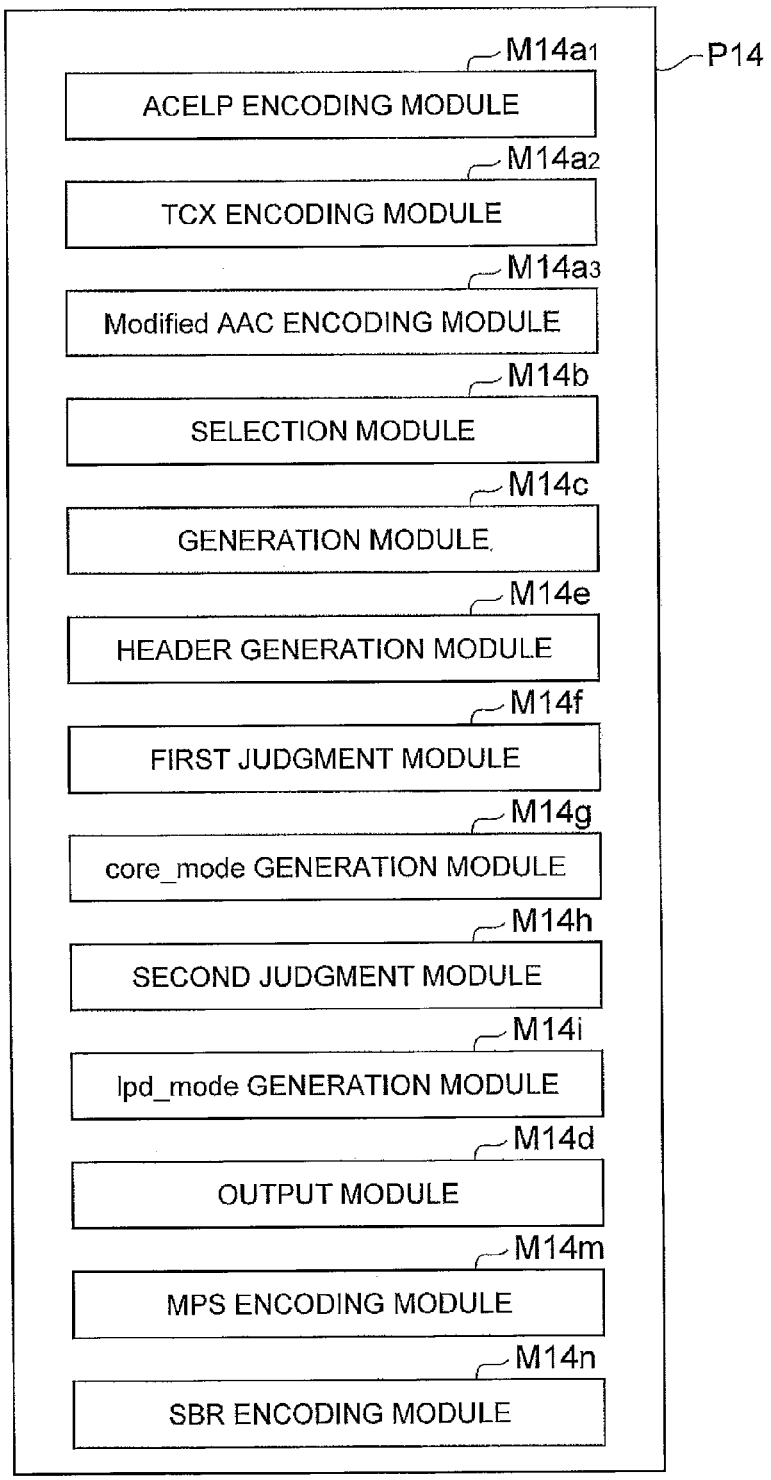
FIG. 14 is a drawing showing an audio encoding program according to another embodiment.

Described below is an audio encoding program that causes a computer to operate as the audio encoding device 14. FIG. 14 is a drawing showing the audio encoding program according to another embodiment.

The audio encoding program P14 shown in FIG. 14 may be executed in the computer shown in FIGS. 5 and 6. The audio encoding program P14 may be provided in the same manner as the audio encoding program P10.

As shown in FIG. 14, the audio encoding program P14 is comprises of an ACELP encoding module M14$a_1$, a TCX encoding module M14$a_2$, a Modified AAC encoding module M14$a_3$, a selection module M14*b*, a generation module M14*c*, an output module M14*d*, a header generation module M14*e*, a first judgment module M14*f*, a core_mode generation module M14*g*, a second judgment module M14*h*, an lpd_mode generation module M14*i*, an MPS encoding module M14*m*, and an SBR encoding module 14*n*.

The ACELP encoding module M14$a_1$, the TCX encoding module M14$a_2$, the Modified AAC encoding module M14$a_3$, the selection module M14*b*, the generation module M14*c*, the output module M14*d*, the header generation module M14*e*, the first judgment module M14*f*, the core_mode generation module M14*g*, the second judgment module M14*h*, the lpd_mode generation module M14*i*, the MPS encoding module M14*m*, and the SBR encoding module 14*n* cause the computer C10 to perform the same functions as performed by the ACELP encoding unit 14$a_1$, the TCX encoding unit 14$a_2$, the Modified AAC encoding unit 14$a_3$, the selection unit 14*b*, the generation unit 14*c*, the output unit 14*d*, the header generation unit 14*e*, the first judgment unit 14*f*, the core_mode generation unit 14*g*, the second judgment unit 14*h*, lpd_mode generation unit 14*i*, the MPS encoding unit 14*m*, and the SBR encoding unit 14*n*, respectively.

Figure 15:
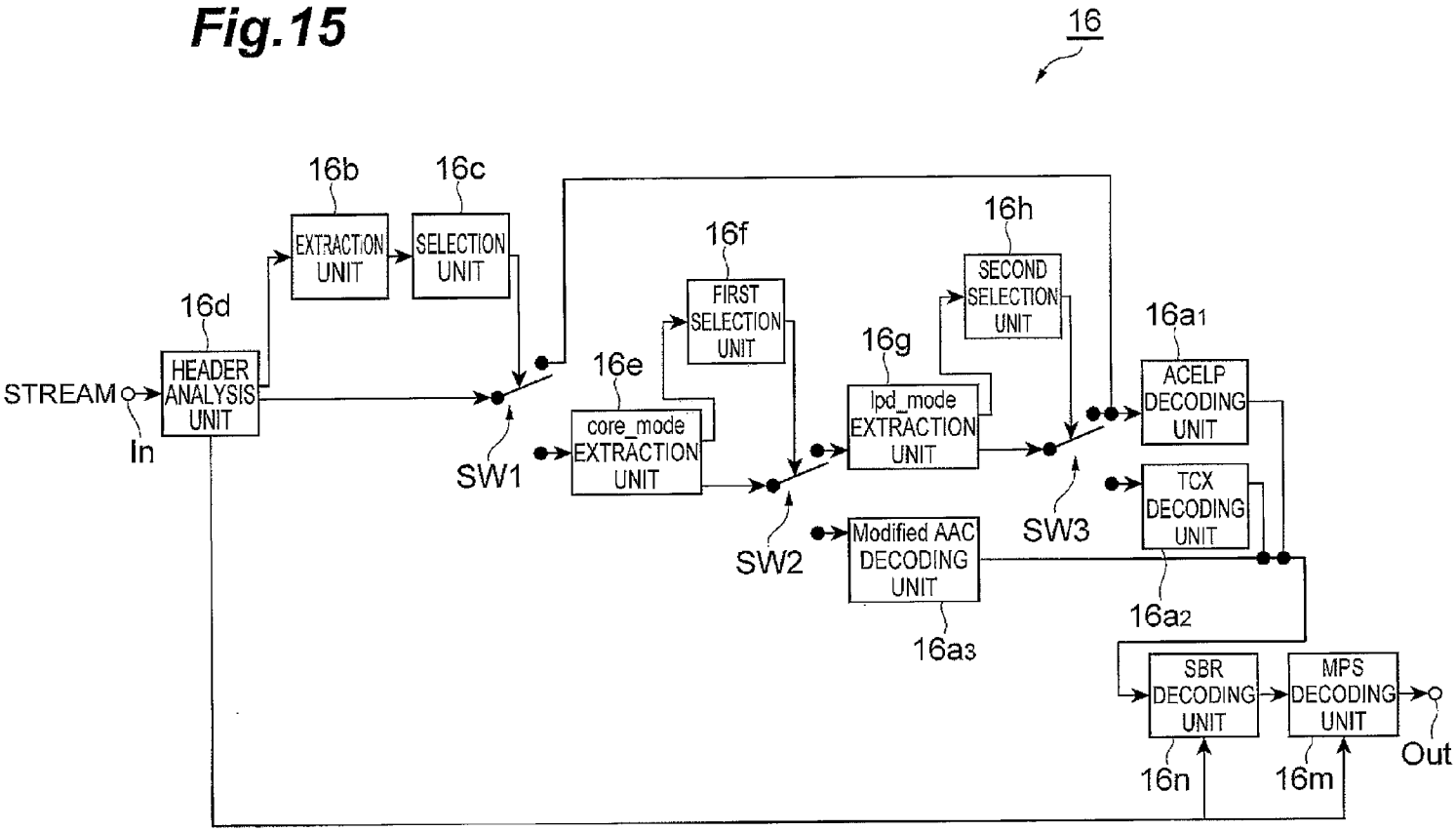
FIG. 15 is a drawing showing an audio decoding device according to another embodiment.

Described below is an audio decoding device that decodes a stream generated by the audio encoding device 14. FIG. 15 is a drawing showing an audio decoding device according to another embodiment. an audio decoding device 16 shown in FIG. 15 is comprised of an ACELP decoding unit 16$a_1$, a TCX decoding unit 16$a_2$, a Modified AAC decoding unit 16$a_3$, an extraction unit 16*b*, a selection unit 16*c*, a header analysis unit 16*d*, a core_mode extraction unit 16*e*, a first selection unit 16*f*, an lpd_mode extraction unit 16*g*, a second selection unit 16*h*, an MPS decoding unit 16*m*, and an SBR decoding unit 16*n*.

The ACELP decoding unit 16$a_1$ decodes a coded sequence in a frame by the ACELP decoding scheme to generate an audio signal. The TCX decoding unit 16$a_2$ decodes a coded sequence in a frame by the TCX decoding scheme to generate an audio signal. The Modified AAC decoding unit 16$a_3$ decodes a coded sequence in a frame by the Modified AAC decoding scheme to generate an audio signal. In one embodiment, the audio signals outputted from these decoding units are the low frequency band audio signals described above with reference to the audio encoding device 14.

The header analysis unit 16*d* separates the header from the first frame. The header analysis unit 16*d* provides the separated header to the extraction unit 16*b* and outputs the first frame from which the header is separated, and the subsequent frames to the switch SW1, the MPS decoding unit 16*m*, and the SBR decoding unit 16*n*.

The extraction unit 16*b* extracts GEM_ID from the header. The selection unit 16*c* selects a decoding unit to be used to decode coded sequences of multiple frames, according to extracted GEM_ID. Specifically, when the value of GEM_ID is "1," the selection unit 16*c* controls the switch SW1 to connect all the frames to the ACELP decoding unit 16$a_1$. On the other hand, when the value of GEM_ID is "0," the selection unit 16*c* controls the switch SW1 to connect a decoding target frame (or super-frame) to the core_mode extraction unit 16*e*.

The core_mode extraction unit 16*e* extracts core_mode from the decoding target frame (or super-frame) and provides extracted core_mode to the first selection unit 16*f*. The first selection unit 16*f* controls the switch SW2 according to the provided value of core_mode. Specifically, when the value of core_mode is "0," the first selection unit 16*f* controls the switch SW2 to connect the decoding target frame to the Modified AAC decoding unit 16$a_3$. Thereafter, the decoding target frame is fed to the Modified AAC decoding unit 16$a_3$. On the other hand, when the value of core_mode is "1," the first selection unit 16*f* controls the switch SW2 to connect the decoding target super-frame to the lpd_mode extraction unit 16*g*.

The lpd_mode extraction unit 16*g* extracts lpd_mode from the decoding target frame, i.e., from the super-frame. The lpd_mode extraction unit 16*g* connects extracted lpd_mode to the second selection unit 16*h*. The second selection unit 16*h* connects each frame in the decoding target super-frame outputted from the lpd_mode extraction unit 16*g* to the ACELP decoding unit 16$a_1$ or to the TCX decoding unit 16$a_2$, according to input lpd_mode.

Specifically, the second selection unit 16*h* refers to a predetermined table associated with value of lpd_mode to set a value of mod[k] (k=0, 1, 2, or 3). Then, the second selection unit 16*h* controls the switch SW3 according to the value of mod[k] to connect each frame in the decoding target super-frame to the ACELP decoding unit 16$a_1$ or to the TCX decoding unit 16$a_2$. The relationship between the values of mod[k] and a selection of either the ACELP decoding unit 16$a_1$ or the TCX decoding unit 16$a_2$ will be described later.

The SBR decoding unit 16*n* receives the low frequency band audio signals from the decoding units 16$a_1$, 16$a_2$, and 16$a_3$. The SBR decoding unit 16*n* also decodes encoded data in the decoding target frame to restore a parameter. The SBR decoding unit 16*n* generates a high frequency band audio signal, using the low frequency band audio signal and the restored parameter. The SBR decoding unit 16*n* combines the high frequency band audio signal and the low frequency band audio signal to generate an audio signal.

The MPS decoding unit 16*m* receives the audio signal from the SBR decoding unit 16*n*. This audio signal may be a monaural audio signal when the audio signal to be restored is a stereo signal. The MPS decoding unit 16*m* also decodes encoded data in the decoding target frame to restore a parameter. The MPS decoding unit 16*m* generates a multichannel audio signal, using the audio signal and restored parameter received from the SBR decoding unit 16*n*, and outputs the multichannel audio signal. When the audio signal to be restored is a monaural signal, the MPS decoding unit 16*m* does not operate and outputs the audio signal generated by the SBR decoding unit 16*n*.

Figure 16:
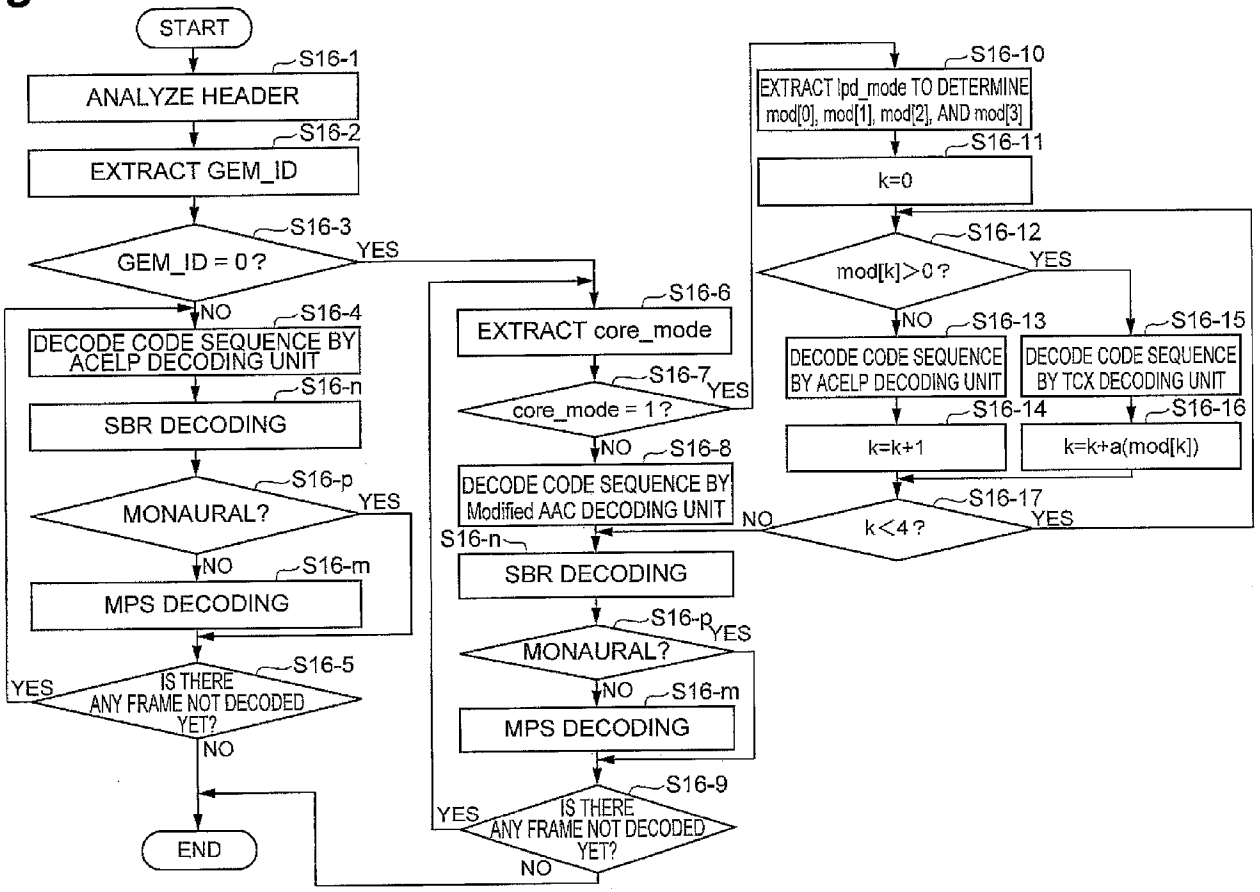
FIG. 16 is a flowchart of an audio decoding method according to another embodiment.

Described below is an operation of the audio decoding device 16 and an audio decoding method according to another embodiment. FIG. 16 is a flowchart of the audio decoding method according to another embodiment.

In the embodiment, as shown in FIG. 16, in step S16-1, the header analysis unit 16*d* separates a header from a stream. In subsequent step S16-2, the extraction unit 16*b* extracts GEM_ID from the header provided from the header analysis unit 16*d*.

Next, in step S16-3, the selection unit 16*c* selects a decoding unit to decode multiple frames, according to the value of GEM_ID extracted by the extraction unit 16*b*. Specifically, when the value of GEM_ID is "1," the selection unit 16*c* selects the ACELP decoding unit 16$a_1$. In this case, in step S16-4, the ACELP decoding unit 16$a_1$ decodes a coded sequence in the decoding target frame. The audio signal generated in step S16-4 is the aforementioned low frequency band audio signal.

Next, in step S16-*n*, the SBR decoding unit 16*n* decodes encoded data in the decoding target frame to restore a parameter. In step S16-*n*, the SBR decoding unit 16*n* generates a high frequency band audio signal, using the inputted low frequency band audio signal and the restored parameter. In step S16-*n*, the SBR decoding unit 16*n* combines the high frequency band audio signal and the low frequency band audio signal to generate an audio signal.

Next, when it is determined in step S16-*p* that the target to be processed is a multichannel signal, subsequent step S16-*m* is carried out in which the MPS decoding unit 16*m* decodes encoded data in the decoding target frame to restore a parameter. In step S16-*m*, the MPS decoding unit 16*m* generates a multichannel audio signal, using the audio signal and restored parameter received from the SBR decoding unit 16*n*, and outputs the multichannel audio signal. On the other hand, when the processing target is determined to be a monaural signal, the SBR decoding unit 16*n* outputs the generated audio signal.

Next, it is judged in step S16-5 whether there is any frame left to be decoded. When there is no frame left to be decoded, the process ends. On the other hand, when there is a frame left to be decoded, the process from step S16-4 is repeated for the target frame left to be decoded. By this operation, when the value of GEM_ID is "1," coded sequences of multiple frames are decoded by a common decoding unit, i.e., by the ACELP decoding unit 16$a_1$.

Returning to step S16-3, when the value of GEM_ID is "0," the selection unit 16*c* connects the decoding target frame to the core_mode extraction unit 16*e*. In this case, in step S16-6, the core_mode extraction unit 16*e* extracts core_mode from the decoding target frame.

Next, in step S16-7, the first selection unit 16*f* selects either the Modified AAC decoding unit 16$a_3$ or the lpd_mode extraction unit 16*g*, according to extracted core_mode. Specifically, when the value of core_mode is "0," the first selection unit 16*f* selects the Modified AAC decoding unit 16$a_3$ to connect the decoding target frame to the Modified AAC decoding unit 16$a_3$. In this case, in subsequent step S16-8, a coded sequence in the target frame to be processed is decoded by the Modified AAC decoding unit 16$a_3$. The audio signal generated in this step S16-8 is the aforementioned low frequency band audio signal. Subsequent to this step S16-8, the aforementioned SBR decoding scheme (step S16-*n*) and MPS decoding scheme (step S16-*m*) are carried out.

Next, it is judged in step S16-9 whether there is any frame left to be decoded, and the process ends when there is no frame left to be decoded. On the other hand, when there is a frame left to be decoded, the process from step S16-6 is repeated for the target frame left to be decoded.

Returning to step S16-7, when the value of core_mode is "1," the first selection unit 16*f* selects the lpd_mode extraction unit 16*g* to connect the decoding target frame to the lpd_mode extraction unit 16*g*. In this case, the decoding target frame is processed as a super-frame.

Next, in step S16-10, the lpd_mode extraction unit 16*g* extracts lpd_mode from the decoding target super-frame. Then, the second selection unit 16*h* sets mod[k] (k=0, 1, 2, or 3) according to extracted lpd_mode.

Next, in step S16-11, the second selection unit 16*h* sets the value of k to "0." In subsequent step S16-12, the second selection unit 16*h* judges whether the value of mod[k] is larger than 0. When the value of mod[k] is not larger than 0, the second selection unit 16*h* selects the ACELP decoding unit 16$a_1$. On the other hand, when the value of mod[k] is larger than 0, the second selection unit 16*h* selects the TCX decoding unit 16$a_2$.

When the ACELP decoding unit 16$a_1$ is selected, subsequent step S16-13 is carried out in which the ACELP decoding unit 16$a_1$ decodes the coded sequence of the decoding target frame in the super-frame. Next, in step S16-14, the value of k is set to k+1. On the other hand, when the TCX decoding unit 16$a_2$ is selected, subsequent step S16-15 is carried out in which the TCX decoding unit 16$a_2$ decodes the coded sequence of the decoding target frame in the super-frame. In step S16-16, the value of k is updated to k+a (mod [k]). As to the relationship between mod[k] and a(mod[k]), reference should be made to FIG. 17.

It is then judged in step S16-17 whether the value of k is smaller than 4. When the value of k is smaller than 4, the process from step S16-12 is repeated for the subsequent frame in the super-frame. On the other hand, when the value of k is not less than 4, the process proceeds to step S16-*n*.

Figure 18:
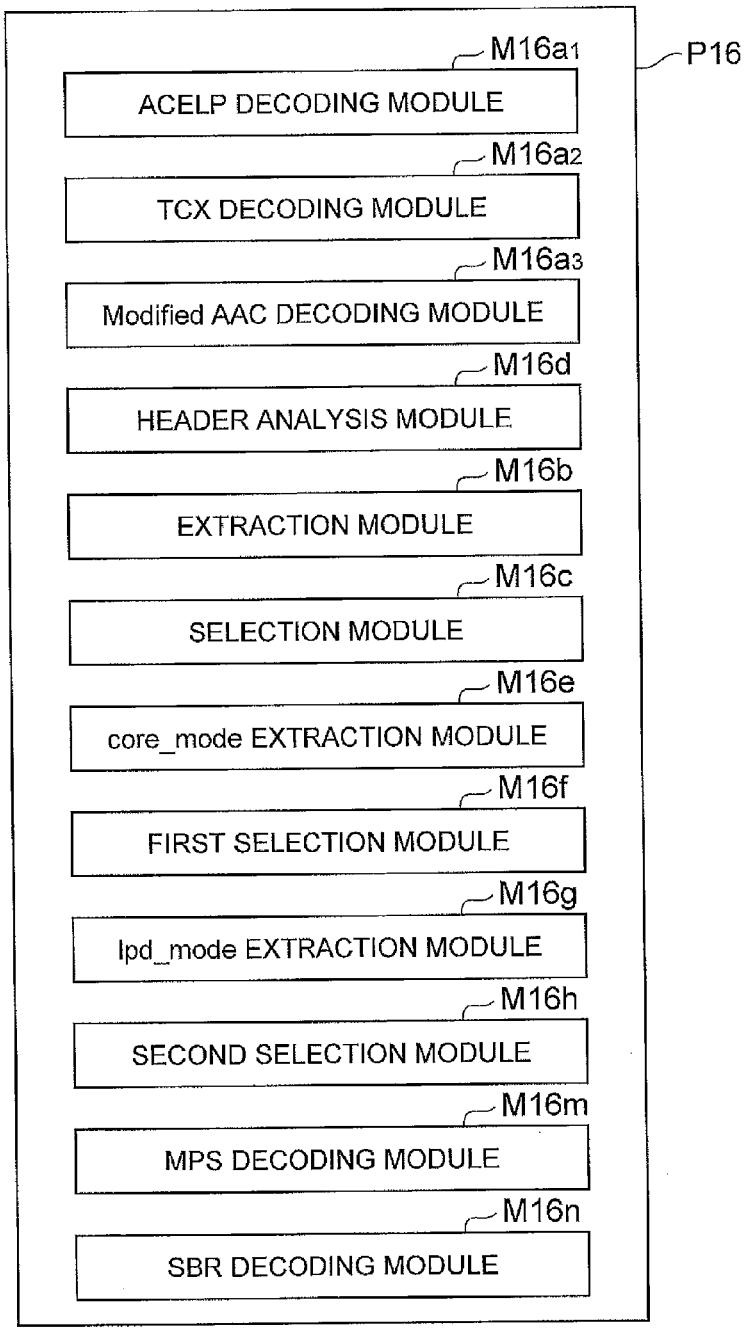
FIG. 18 is a drawing showing an audio decoding program according to another embodiment.

Described below is an audio decoding program for causing a computer to operate as the audio decoding device 16. FIG. 18 is a drawing showing the audio decoding program according to another embodiment.

The audio decoding program P16 shown in FIG. 18 may be executed in the computer shown in FIGS. 5 and 6. The audio decoding program P16 can be provided in the same manner as the audio encoding program P10.

As shown in FIG. 18, the audio decoding program P16 is comprised of an ACELP decoding module M16$a_1$, a TCX decoding module M16$a_2$, a Modified AAC decoding module M16$a_3$, an extraction module M16*b*, a selection module M16*c*, a header analysis module M16*d*, a core_mode extraction module M16*e*, a first selection module M16*f*, an lpd_mode extraction module M16*g*, a second selection module M16*h*, an MPS decoding module M16*m*, and an SBR decoding module M16*n*.

The ACELP decoding module M16$a_1$, the TCX decoding module M16$a_2$, the Modified AAC decoding module M16$a_3$, the extraction module M16*b*, the selection module M16*c*, the header analysis module M16*d*, the core_mode extraction module M16*e*, the first selection module M16*f*, the lpd_mode extraction module M16*g*, the second selection module M16*h*, the MPS decoding module M16*m*, and the SBR decoding module M16*n* cause the computer C10 to perform the same functions as performed by the ACELP decoding unit 16$a_1$, the TCX decoding unit 16$a_2$, the Modified AAC decoding unit 16$a_3$, the extraction unit 16*b*, the selection unit 16*c*, the header analysis unit 16*d*, the core_mode extraction unit 16*e*, the first selection unit 16*f*, the lpd_mode extraction unit 16*g*, the second selection unit 16*h*, the MPS decoding unit 16*m*, and the SBR decoding unit 16*n*, respectively.

Figure 19:
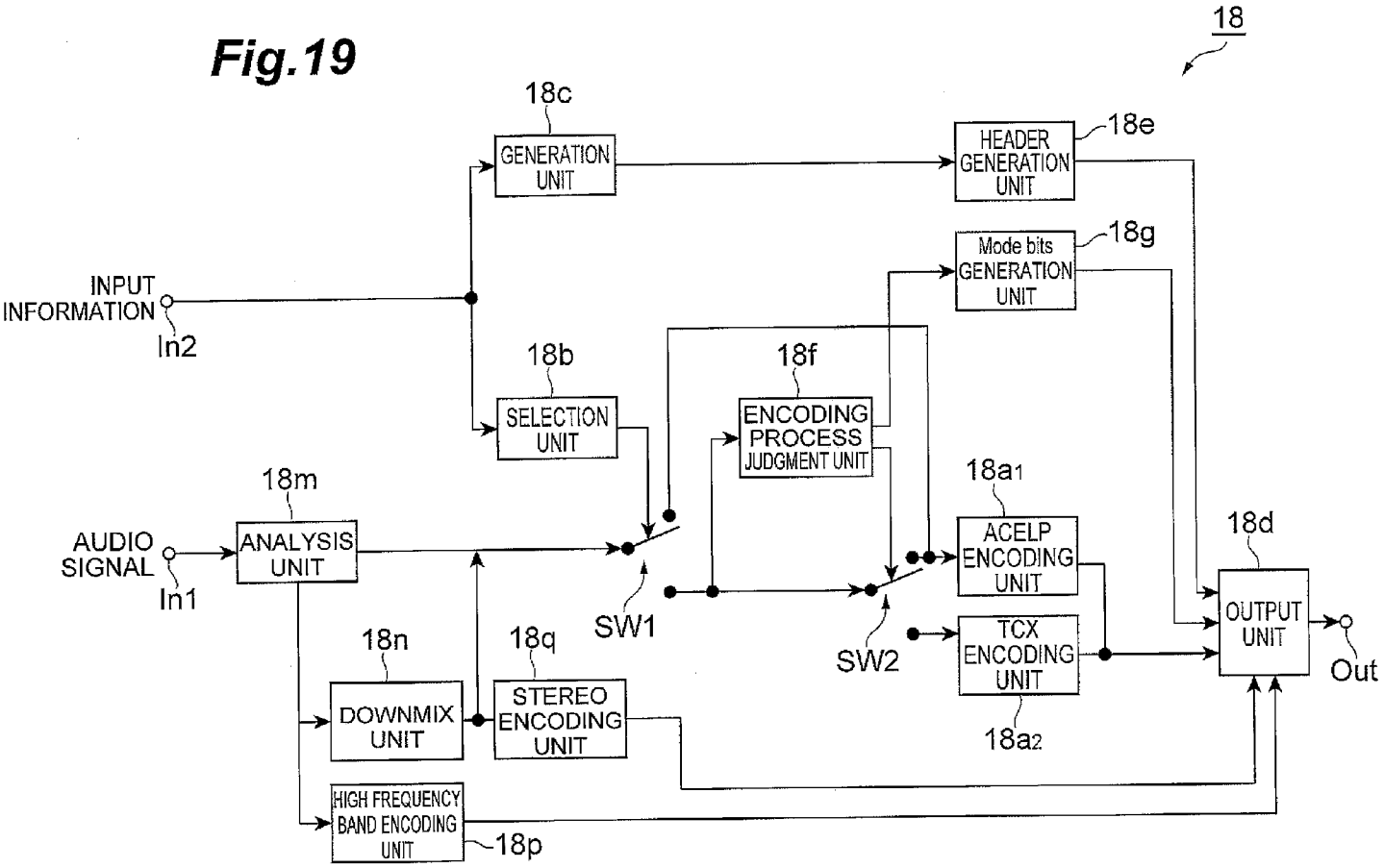
FIG. 19 is a drawing showing an audio encoding device according to another embodiment.

Described below is an audio encoding device according to another embodiment. FIG. 19 is a drawing showing an audio encoding device according to another embodiment. An audio encoding device 18 shown in FIG. 19 may be used as an extension of AMR-WB+.

FIG. 20 is a drawing showing a stream generated according to the conventional AMR-WB+ and a stream generated by the audio encoding device shown in FIG. 19. In AMR-WB+, as shown in FIG. 20, each frame is provided with 2-bit Mode bits. Mode bits indicates that either the ACELP encoding scheme or the TCX encoding scheme is to be selected, depending upon its value.

On the other hand, the audio encoding device 18 shown in FIG. 19 encodes audio signals of all frames by a common audio encoding scheme. Furthermore, the audio encoding device 18 also selects an audio encoding scheme used for the respective frames, from one to another.

As shown in FIG. 19, the audio encoding device 18 is provided with an ACELP encoding unit 18$a_1$ and a TCX encoding unit 18$a_2$. The ACELP encoding unit 18$a_1$ encodes an audio signal by the ACELP encoding scheme to generate a coded sequence. The TCX encoding unit 18$a_2$ encodes an audio signal by the TCX encoding scheme to generate a coded sequence. The audio encoding device 18 is further comprised of a selection unit 18*b*, a generation unit 18*c*, an output unit 18*d*, a header generation unit 18*e*, an encoding scheme judgment unit 18*f*, a Mode bits generation unit 18*g*, an analysis unit 18*m*, a downmix unit 18*n*, a high frequency band encoding unit 18*p*, and a stereo encoding unit 18*q*.

The analysis unit 18*m* divides, referring to a predetermined frequency, an audio signal of each frame fed to the input terminal In1 into a low frequency band audio signal and a high frequency band audio signal. When the audio signal fed to the input terminal In1 is a monaural audio signal, the analysis unit 18*m* outputs the generated low frequency band audio signal to a switch SW1 and outputs the high frequency band audio signal to the high frequency band encoding unit 18*p*. On the other hand, when the audio signal fed to the input terminal In1 is a stereo signal, the analysis unit 18*m* outputs the generated low frequency band audio signal (stereo signal) to the downmix unit 18*n*.

When the audio signal fed to the input terminal In1 is a stereo signal, the downmix unit 18*n* down-mixes the low frequency band audio signal (stereo signal) to a monaural audio signal. The downmix unit 18*n* outputs the generated monaural audio signal to the switch SW1. The downmix unit 18*n* divides, referring to a predetermined frequency, the low frequency band audio signal into audio signals of two frequency bands. The downmix unit 18*n* outputs an audio signal (monaural signal) of a lower frequency band out of the two frequency band audio signals and the right channel audio signal to the stereo encoding unit 18*q*.

The high frequency band encoding unit 18*p* calculates a parameter for enabling the decoder side to generate a high frequency band audio signal from the low frequency band audio signal, generates encoded data of the parameter, and outputs the encoded data to the output unit 18*d*. The parameter to be used herein may, for example, be a linear predictive coefficient obtained by modeling a spectrum envelope, or a gain for power adjustment.

The stereo encoding unit 18*q* calculates a side signal, which is a difference signal between the lower frequency band monaural audio signal of the two frequency band audio signals and the right channel audio signal. The stereo encoding unit 18*q* calculates a balance factor indicative of a level difference between the monaural audio signal and the side signal, encodes the balance factor and a waveform of the side signal, respectively, by predetermined methods, and outputs encoded data to the output unit 18*d*. The stereo encoding unit 18*q* calculates a parameter for a decoding device to generate a stereo audio signal from the lower frequency band audio signal of the two frequency band audio signals and outputs encoded data of the parameter to the output unit 18*d*.

The selection unit 18*b* has the same function as that of the selection unit 14*b*. Specifically, when the input information indicates that multiple frames are to be encoded by a common audio encoding scheme, the selection unit 18*b* controls the switch SW1 to connect audio signals of all frames fed to the switch SW1 to the ACELP encoding unit $\mathbf{18}a_1$. On the other hand, when the input information indicates that multiple frames are not to be encoded by a common encoding scheme, the selection unit 18*b* controls the switch SW1 to connect an audio signal of each frame fed to the switch SW1 to a path leading to the encoding scheme judgment unit 18*f* and others.

The generation unit 18*c* sets GEM_ID in the same manner as set by the generation unit 14*c*. The header generation unit 18*e* generates a header compatible with AMR-WB+ including GEM_ID generated by the generation unit 18*c*. This header is outputted as the head of the stream by the output unit 18*d*. In the present embodiment, GEM_ID may be included in an unused region in AMR_WBPSampleEntry_fields of the header.

When the input information indicates that multiple frames are not to be encoded by a common encoding scheme, the encoding scheme judgment unit 18*f* receives an audio signal of an encoding target frame via the SW1.

The encoding scheme judgment unit 18*f* processes the encoding target frame as a super-frame such that the encoding target frame is divided into four or less frames. The encoding scheme judgment unit 18*f* analyzes an audio signal of each frame in the super-frame to judge whether the audio signal is to be encoded by the ACELP encoding unit $\mathbf{18}a_1$ or to be encoded by the TCX encoding unit $\mathbf{18}a_2$. This analysis may be the same analysis as performed by the aforementioned second judgment unit 14*h*.

When the judgment unit 18*f* determines that the audio signal of the frame is to be encoded by the ACELP encoding unit $\mathbf{18}a_1$, it controls the switch SW2 to connect the audio signal of the frame to the ACELP encoding unit $\mathbf{18}a_1$. On the other hand, when the judgment unit 18*f* determines that the audio signal of the frame is to be encoded by the TCX encoding unit $\mathbf{18}a_2$, it controls the switch SW2 to connect the audio signal of the frame to the TCX encoding unit $\mathbf{18}a_2$.

The Mode bits generation unit 18*g* generates K pieces of Mode Bits[k] (k=0 to K−1) having values according to the judgment result by the encoding scheme judgment unit 18*f*. The value of K herein is an integer not more than 4 and may be a number corresponding to the number of frames in the super-frame. Furthermore, Mode bits[k] is 2-bit information indicating that either the ACELP encoding scheme or the TCX encoding scheme was used to encode the audio signal of the encoding target frame.

The output unit 18*d* outputs a stream with a header and multiple frames of corresponding coded sequences. When the value of GEM_ID is 0, the output unit 18*d* adds Mode bits[k] in the output frame. Furthermore, the output unit 18*d* adds in a corresponding frame the encoded data generated by the high frequency band encoding unit 18*p* and the encoded data generated by the stereo encoding unit 18.

Figure 21:
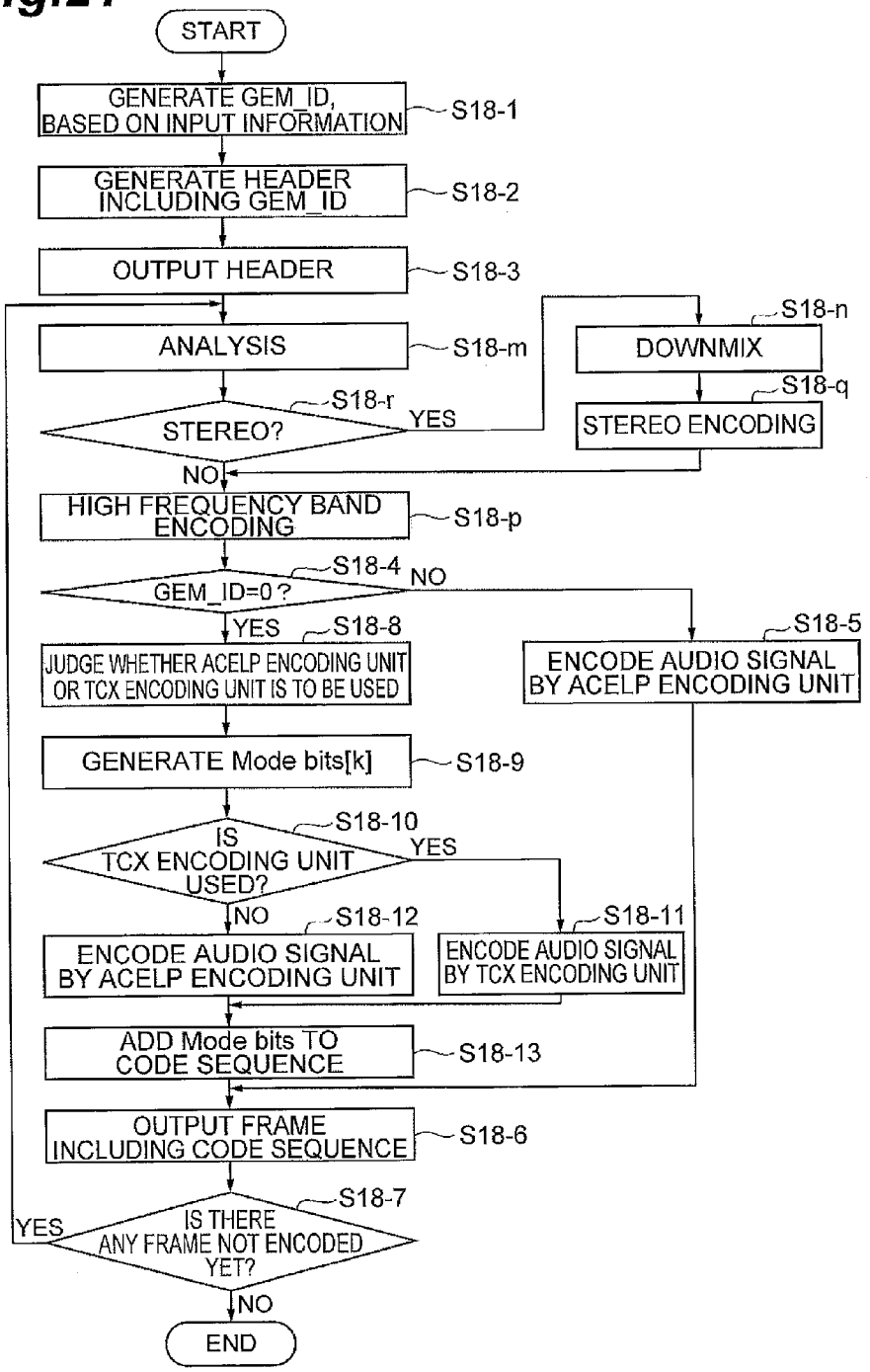
FIG. 21 is a flowchart of an audio encoding method according to another embodiment.

Described below is an operation of the audio encoding device 18 and an audio encoding method according to an embodiment. FIG. 21 is a flowchart of the audio encoding method according to still another embodiment.

In the embodiment, as shown in FIG. 21, step S18-1, which is equivalent to step S14-1, is carried out first. Next, in step S18-2, the header generation unit 18*e* generates a header of AMR-WB+ including GEM_ID, as described above. In subsequent step S18-3, the output unit 18*d* outputs the generated header as the head of a stream.

Next, in step S18-*m*, the analysis unit 18*m* divides an audio signal of an encoding target frame fed to the input terminal In1 into a low frequency band audio signal and a high frequency band audio signal, as described above. In step S18-*m*, when the audio signal fed to the input terminal In1 is a monaural audio signal, the analysis unit 18*m* outputs the generated low frequency band audio signal to the switch SW1 and outputs the high frequency band audio signal to the high frequency band encoding unit 18*p*. On the other hand, when the audio signal fed to the input terminal In1 is a stereo signal, the analysis unit 18*m* outputs the generated low frequency band audio signal (stereo signal) to the downmix unit 18*n*.

Next, when it is determined in step S18-*r* that the audio signal fed to the input terminal In1 is a monaural signal, the aforementioned process by the high frequency band encoding unit 18*p* is carried out in step S18-*p*, and the encoded data generated by the high frequency band encoding unit 18*p* is outputted from the output unit 18*d*. On the other hand, when the audio signal fed to the input terminal In1 is a stereo signal, the aforementioned process by the downmix unit 18*n* is carried out in step S18-*n*, the aforementioned process by the stereo encoding unit 18*q* is carried out in subsequent step S18-*q*, the encoded data generated by the stereo encoding unit 18*q* is outputted from the output unit 18*d*, and the processing proceeds to step S18-*p*.

Next, in step S18-4, the selection unit 18*b* judges whether the value of GEM_ID is "0." When the value of GEM_ID is not "0," i.e., when the value of GEM_ID is "1," the selection unit 18*b* selects the ACELP encoding unit 18$a_1$. Next, in step S18-5, the ACELP encoding unit 18$a_1$ thus selected encodes the audio signal of the frame (low frequency band audio signal). In subsequent step S18-6, the output unit 18*d* outputs a frame including the generated coded sequence. When the value of GEM_ID is "1," audio signals (low frequency band audio signals) of all frames are encoded by the ACELP encoding unit 18$a_1$, after it is judged in step S18-7 whether there is any frame left to be encoded, and the encoded signals are outputted.

Returning to step S18-4, when the value of GEM_ID is "0," subsequent step S18-8 is carried out in which the encoding scheme judgment unit 18*f* judges whether an encoding target frame, i.e., an audio signal of each frame in the super-frame (low frequency band audio signal) is to be encoded by the ACELP encoding scheme or by the TCX encoding scheme.

Next, in step S18-9, the Mode bits generation unit 18*g* generates Mode bits[k] having a value according to the judgment result by the encoding scheme judgment unit 18*f*.

Next, it is judged in step S18-10 whether the judgment result in step S18-8 indicates that the audio signal of the encoding target frame is to be encoded by the TCX encoding scheme, i.e., by the TCX encoding unit 18$a_2$.

When the judgment result in step S18-8 indicates that the audio signal of the encoding target frame is to be encoded by the TCX encoding unit 18$a_2$, subsequent step S18-11 is carried out in which the TCX encoding unit 18$a_2$ encodes the audio signal (low frequency band audio signal) of the frame. On the other hand, when the judgment result does not indicate that the audio signal of the encoding target frame is to be encoded by the TCX encoding unit 18$a_2$, subsequent step S18-12 is carried out in which the ACELP encoding unit 18$a_1$ encodes the audio signal (low frequency band audio signal) of the frame. The processes from step S18-10 to step S18-12 are carried out for each of frames in the super-frame.

Next, in step S18-13, the output unit 18*d* adds Mode bits[k] to the coded sequence generated in step S18-11 or in step S18-12. Then the process proceeds to step S18-6.

In the audio encoding device 18 and the audio encoding method described above, GEM_ID set to "1" is also included in the header, whereby the decoder side is notified that audio signals of multiple frames were encoded only by the ACELP encoding unit. Therefore, the stream is generated in a smaller size.

Figure 22:
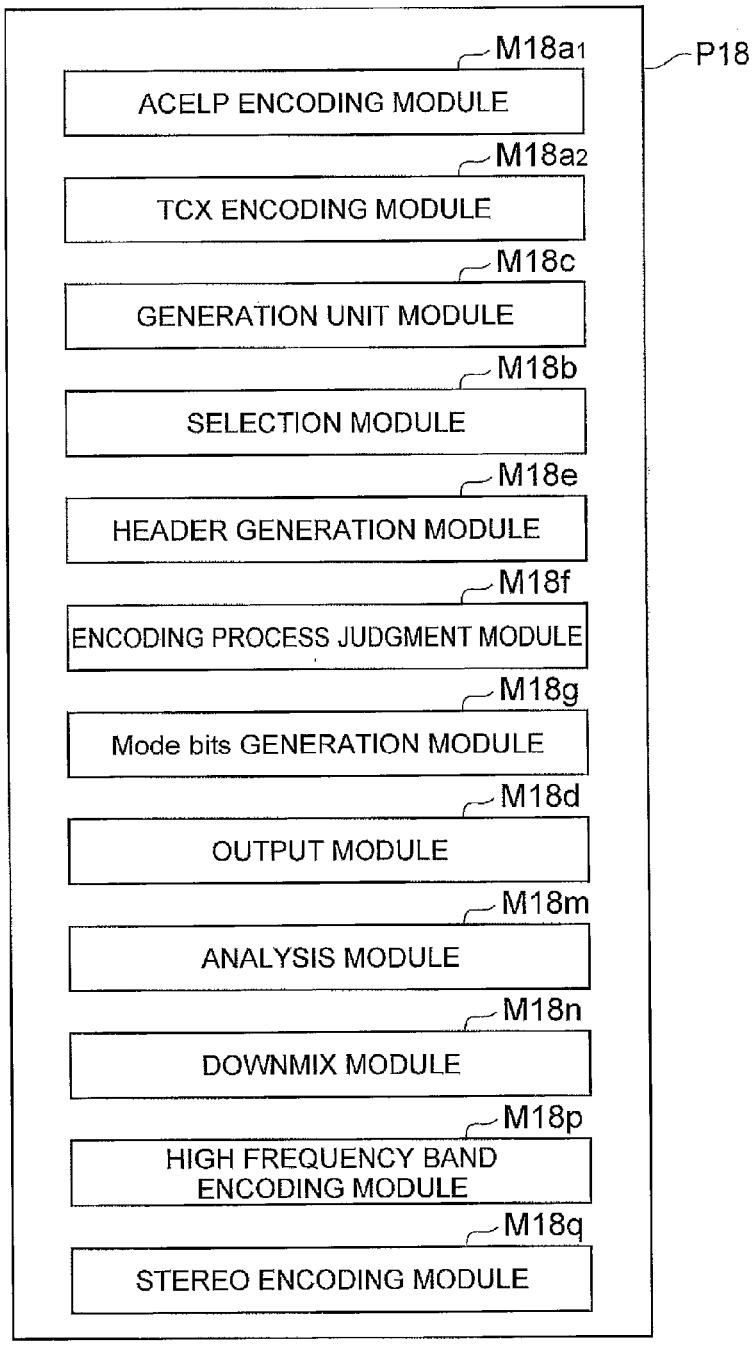
FIG. 22 is a drawing showing an audio encoding program according to another embodiment.

Described below is an audio encoding program for causing a computer to operate as the audio encoding device 18. FIG. 22 shows an audio encoding program according to another embodiment.

The audio encoding program P18 shown in FIG. 22 may be executed in the computer shown in FIGS. 5 and 6. Furthermore, the audio encoding program P18 may be provided in the same manner as the audio encoding program P10.

The audio encoding program P18 is comprised of an ACELP encoding module M18$a_1$, a TCX encoding module M18$a_2$, a selection module M18*b*, a generation module M18*c*, an output module M18*d*, a header generation module M18*e*, an encoding scheme judgment module M18*f*, a Mode bits generation module M18*g*, an analysis module M18*m*, a downmix module M18*n*, a high frequency band encoding module M18*p*, and a stereo encoding module M18*q*.

The ACELP encoding module M18$a_1$, the TCX encoding module M18$a_2$, the selection module M18*b*, the generation module M18*c*, the output module M18*d*, header generation module M18*e*, the encoding scheme judgment module M18*f*, the Mode bits generation module M18*g*, the analysis module M18*m*, the downmix module M18*n*, the high frequency band encoding module M18*p*, and the stereo encoding module M18*q* cause the computer C10 to perform the same functions as performed by the ACELP encoding unit 18$a_1$, the TCX encoding unit 18$a_2$, the selection unit 18*b*, the generation unit 18*c*, the output unit 18*d*, header generation unit 18*e*, the encoding scheme judgment unit 18*f*, the Mode bits generation unit 18*g*, the analysis unit 18*m*, the downmix unit 18*n*, the high frequency band encoding unit 18*p*, and the stereo encoding unit 18*q*, respectively.

Figure 23:
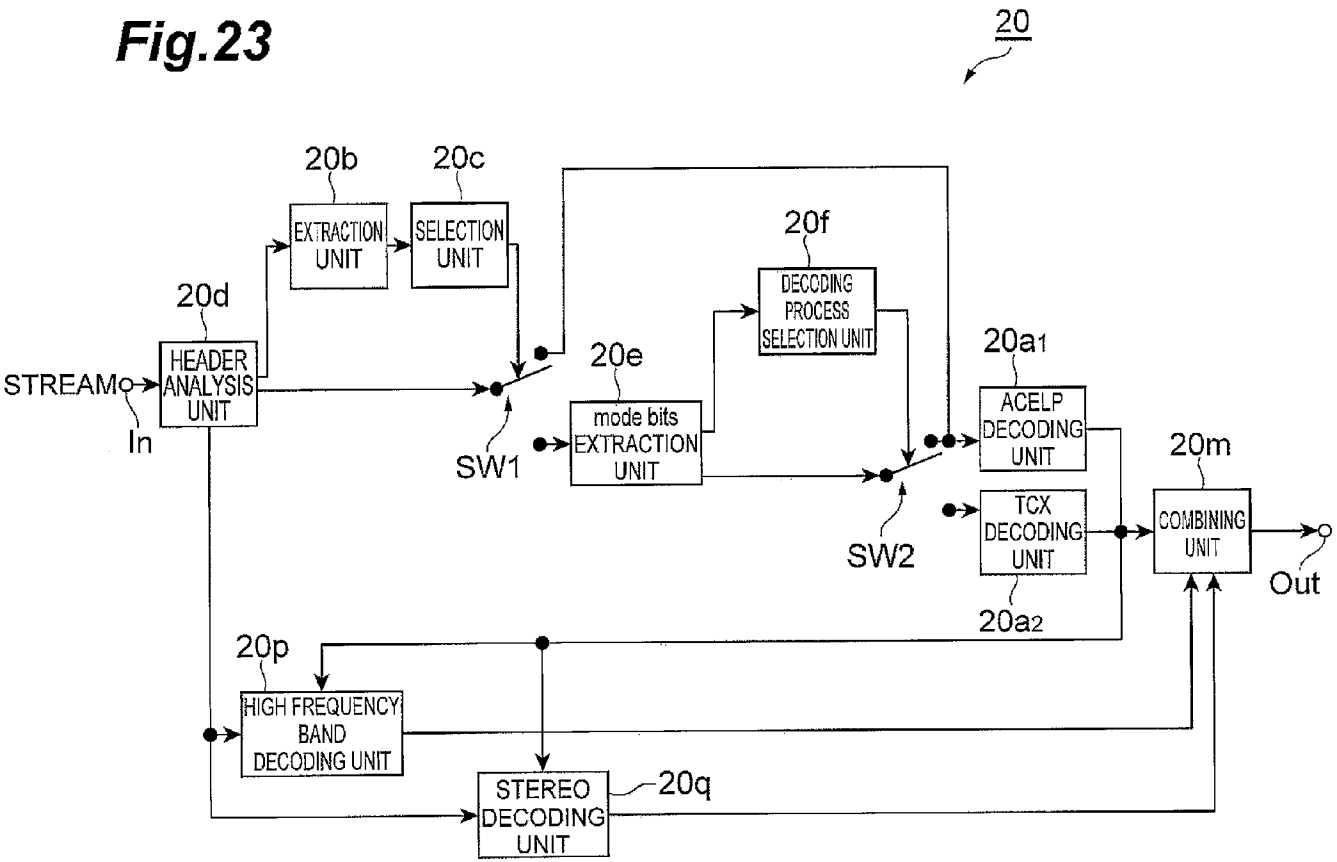
FIG. 23 is a drawing showing an audio decoding device according to another embodiment.

Described below is an audio decoding device that decodes a stream generated by the audio encoding device 18. FIG. 23 shows an audio decoding device according to another embodiment. The audio decoding device 20 shown in FIG. 23 is comprised of an ACELP decoding unit 20$a_1$ and a TCX decoding unit 20$a_2$. The ACELP decoding unit 20$a_1$ decodes a coded sequence in a frame by the ACELP decoding scheme to generate an audio signal (low frequency band audio signal). The TCX decoding unit 20$a_2$ decodes a coded sequence in a frame by the TCX decoding scheme to generate an audio signal (low frequency band audio signal). The audio decoding device 20 is further comprised of an extraction unit 20*b*, a selection unit 20*c*, a header analysis unit 20*d*, a Mode bits extraction unit 20*e*, a decoding scheme selection unit 20*f*, a high frequency band decoding unit 20*p*, a stereo decoding unit 20*q*, and a synthesis unit 20*m*.

The header analysis unit 20*d* receives the stream shown in FIG. 20 and separates the header from the stream. The header analysis unit 20*d* provides the separated header to the extraction unit 20*b*. Furthermore, the header analysis unit 20*d* outputs each frame in the stream from which the header is separated to a switch SW1, the high frequency band decoding unit 20*p*, and the stereo decoding unit 20*q*.

The extraction unit 20*b* extracts GEM_ID from the header. When the value of GEM_ID extracted is "1," the selection unit 20*c* controls the switch SW1 to connect multiple frames to the ACELP decoding unit 20$a_1$. Thereby, coded sequences of all frames are decoded by the ACELP decoding unit 20$a_1$ when the value of GEM_ID is "1."

On the other hand, when the value of GEM_ID is "0," the selection unit 20*c* controls the switch SW1 to connect each frame to the Mode bits extraction unit 20*e*. The Mode bits extraction unit 20*e* extracts Mode bits[k] for each input frame, i.e., each frame in a super-frame and provides it to the decoding scheme selection unit 20*f*.

The decoding scheme selection unit 20*f* controls a switch SW2 according to the value of Mode bits[k]. Specifically, when the decoding scheme selection unit 20*f* determines from the value of Mode bits[k] that the ACELP decoding scheme is to be selected, it controls the switch SW2 to connect the decoding target frame to the ACELP decoding unit 20$a_1$. On the other hand, when the decoding scheme selection unit 20*f* determines from the value of Mode bits[k] that the TCX decoding scheme is to be selected, it controls the switch SW2 to connect the decoding target frame to the TCX decoding unit 20$a_2$.

The high frequency band decoding unit 20*p* decodes the encoded data included in the decoding target frame to restore the aforementioned parameter. The high frequency band decoding unit 20*p* generates the high frequency band audio signal, using the restored parameter and the low frequency band audio signal decoded by the ACELP decoding unit 20$a_1$ and/or by the TCX decoding unit 20$a_2$, and outputs the high frequency band audio signal to the synthesis unit 20*m*.

The stereo decoding unit 20*q* decodes the encoded data included in the decoding target frame to restore the aforementioned parameter, the balance factor, and the waveform of the side signal. The stereo decoding unit 20*q* generates a stereo signal, using the restored parameter, balance factor, and waveform of the side signal, and the low frequency band monaural audio signal decoded by the ACELP decoding unit 20$a_1$ and/or by the TCX decoding unit 20$a_2$.

The synthesis unit 20*m* combines the low frequency band audio signal restored by the ACELP decoding unit 20$a_1$ and/or by the TCX decoding unit 20$a_2$ with the high frequency band audio signal generated by the high frequency band decoding unit 20*p* in order to generate a decoded audio signal. When a stereo signal is a target signal to be processed, the synthesis unit 20*m* generates a stereo audio signal, also using the input signal (stereo signal) from the stereo decoding unit 20*q*.

Figure 24:
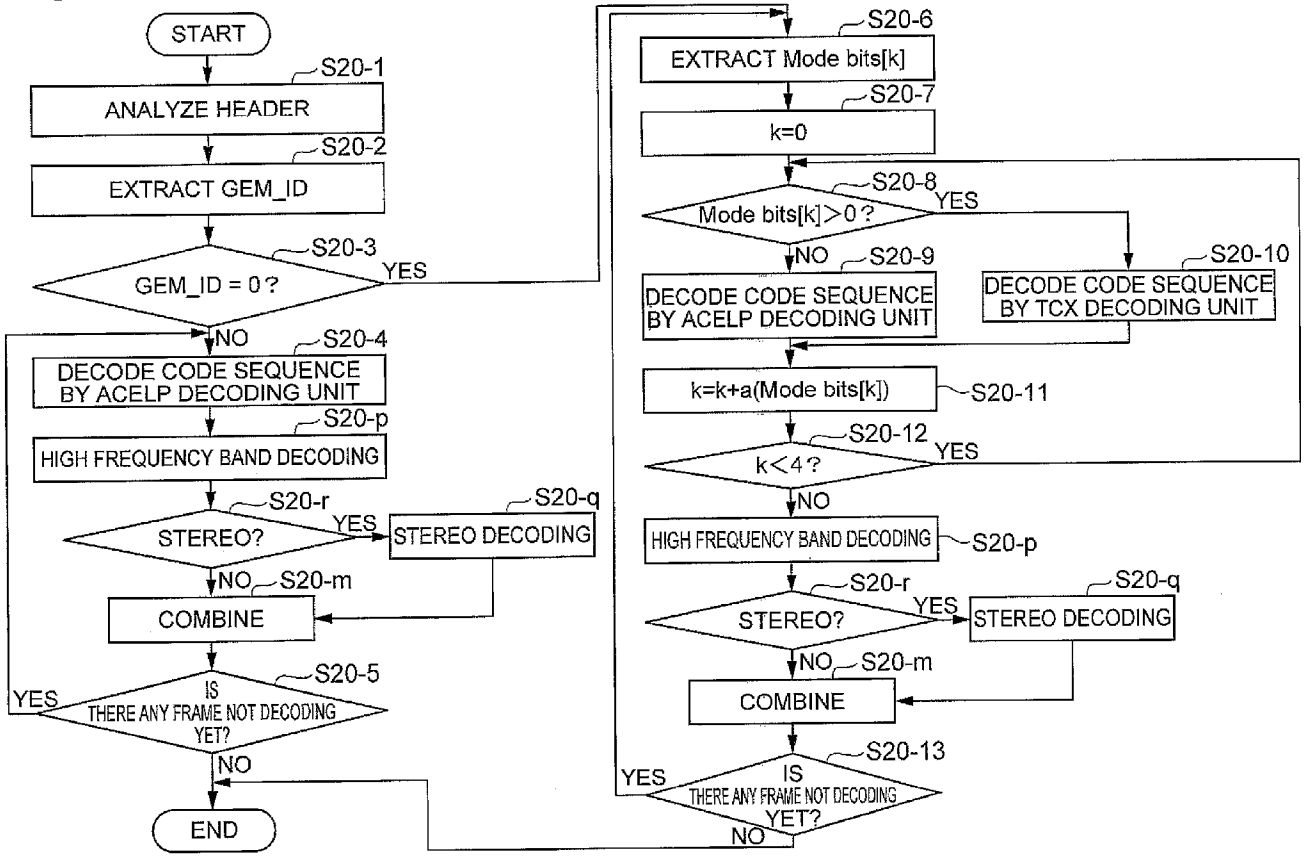
FIG. 24 is a flowchart of an audio decoding method according to another embodiment.

Described below is an operation of the audio decoding device 20 and an audio decoding method according to an embodiment. FIG. 24 is a flowchart of the audio decoding method according to another embodiment.

In an embodiment, as shown in FIG. 24, step S20-1 is carried out first in which the header analysis unit 20*d* separates a header from a stream.

Next, in step S20-2, the extraction unit 20*b* extracts GEM_ID from the header. In subsequent step S20-3, the selection unit 20*c* controls a switch SW1 according to the value of GEM_ID.

Specifically, when the value of GEM_ID is "1," the selection unit 20*c* controls the switch SW1 to select the ACELP decoding unit 20$a_1$ as a decoding unit to decode coded sequences of multiple frames in the stream. In this case, in subsequent step S20-4, the ACELP decoding unit 20$a_1$ decodes a coded sequence of a decoding target frame. Thereby, a low frequency band audio signal is restored.

Next, in step S20-*p*, the high frequency band decoding unit 20*p* restores a parameter from the encoded data included in the decoding target frame. In step S20-*p*, the high frequency band decoding unit 20*p* generates a high frequency band audio signal, using the restored parameter and the low frequency band audio signal restored by the ACELP decoding unit 20$a_1$, and outputs the high frequency band audio signal to the synthesis unit 20*m*.

Next, when it is determined in step S20-*r* that a stereo signal is a target signal to be processed, subsequent step S20-*q* is carried out in which the stereo decoding unit 20*q* decodes the encoded data included in the decoding target frame to restore the aforementioned parameter, the balance factor, and the waveform of the side signal. In step S20-*q*, the stereo decoding unit 20*q* restores a stereo signal, using the restored parameter, balance factor, and waveform of the side signal, and the low frequency band monaural audio signal restored by the ACELP decoding unit 20$a_1$.

Next, in step S20-*m*, the synthesis unit 20*m* combines the low frequency band audio signal restored by the ACELP decoding unit 20$a_1$ and the high frequency band audio signal generated by the high frequency band decoding unit 20*p* to generate a decoded audio signal. When a stereo signal is a target signal to be processed, the synthesis unit 20*m* restores a stereo audio signal, also using the input signal (stereo signal) from the stereo decoding unit 20*q*.

When it is judged in step S20-5 that there is no frame left to be decoded, the process ends. On the other hand, when there is a frame left to be decoded, the processes from step S20-4 are repeated for a target unprocessed frame.

Returning to step S20-3, when the value of GEM_ID is "0," the selection unit 20*c* controls the switch SW1 to connect each frame in the stream to the Mode bits extraction unit 20*e*. In this case, in subsequent step S20-6, the Mode bits extraction unit 20*e* extracts Mode bits[k] from the decoding target super-frame. Mode bits[k] may be extracted from the super-frame at once or may be extracted one at a time in its order during decoding of each frame in the super-frame.

Next, in step S20-7, the decoding scheme selection unit 20*f* sets the value of k to "0." In subsequent step S20-8, the decoding scheme selection unit 20*f* judges whether the value of Mode bits[k] is larger than 0. When the value of Mode bits[k] is not larger than 0, subsequent step S20-9 is carried out in which the ACELP decoding unit 20$a_1$ decodes a coded sequence of a decoding target frame in the super-frame. On the other hand, when the value of Mode bits[k] is larger than 0, the TCX decoding unit 20$a_2$ decodes the coded sequence of the decoding target frame in the super-frame.

Next, in step S20-11, the decoding scheme selection unit 20*f* updates the value of k to k+a(Mode bits[k]). The relationship between the values of Mode bits[k] and a(Mode bits[k]) herein may be equivalent to the relation between mod[k] and a(mod[k]) shown in FIG. 17.

Next, in step S20-12, the decoding scheme selection unit 20*f* judges whether the value of k is smaller than 4. When the value of k is smaller than 4, the processes from step S20-8 are continued for a target subsequent frame in the super-frame. On the other hand, when the value of k is not less than 4, step S20-*p* is carried out in which the high frequency band decoding unit 20*p* restores the parameter from the encoded data included in the decoding target frame. In step S20-*p*, the high frequency band decoding unit 20*p* generates a high frequency band audio signal from the parameter and the low frequency band audio signal restored by the decoding unit 20$a_1$ or by the decoding unit 20$a_2$, and outputs the high frequency band audio signal to the synthesis unit 20*m*.

Next, when it is determined in step S20-*r* that a stereo signal is a target signal to be processed, subsequent step S20-*q* is carried out in which the stereo decoding unit 20*q* decodes the encoded data included in the decoding target frame to restore the aforementioned parameter, the balance factor, and the waveform of the side signal. In step S20-*q*, the stereo decoding unit 20*q* restores a stereo signal, using the restored parameter, balance factor, and waveform of the side signal, and the low frequency band monaural audio signal restored by the decoding unit 20$a_1$ or by the decoding unit 20$a_2$.

Next, in step S20-*m*, the synthesis unit 20*m* synthesizes a decoded audio signal from the low frequency band audio signal restored by the decoding unit 20$a_1$ or by the decoding unit 20$a_2$, and the high frequency band audio signal generated by the high frequency band decoding unit 20*p*. When a stereo signal is a target signal to be processed, the synthesis unit 20*m* restores a stereo audio signal, also using an input signal (stereo signal) from the stereo decoding unit 20*q*. Then the process proceeds to step S20-13.

It is judged in step S20-13 whether there is any frame let to be decoded. When there is no frame left to be decoded, the process is terminated. On the other hand, when there is a frame let to be decoded, the processes from step S20-6 are executed for a target frame (super-frame).

Figure 25:
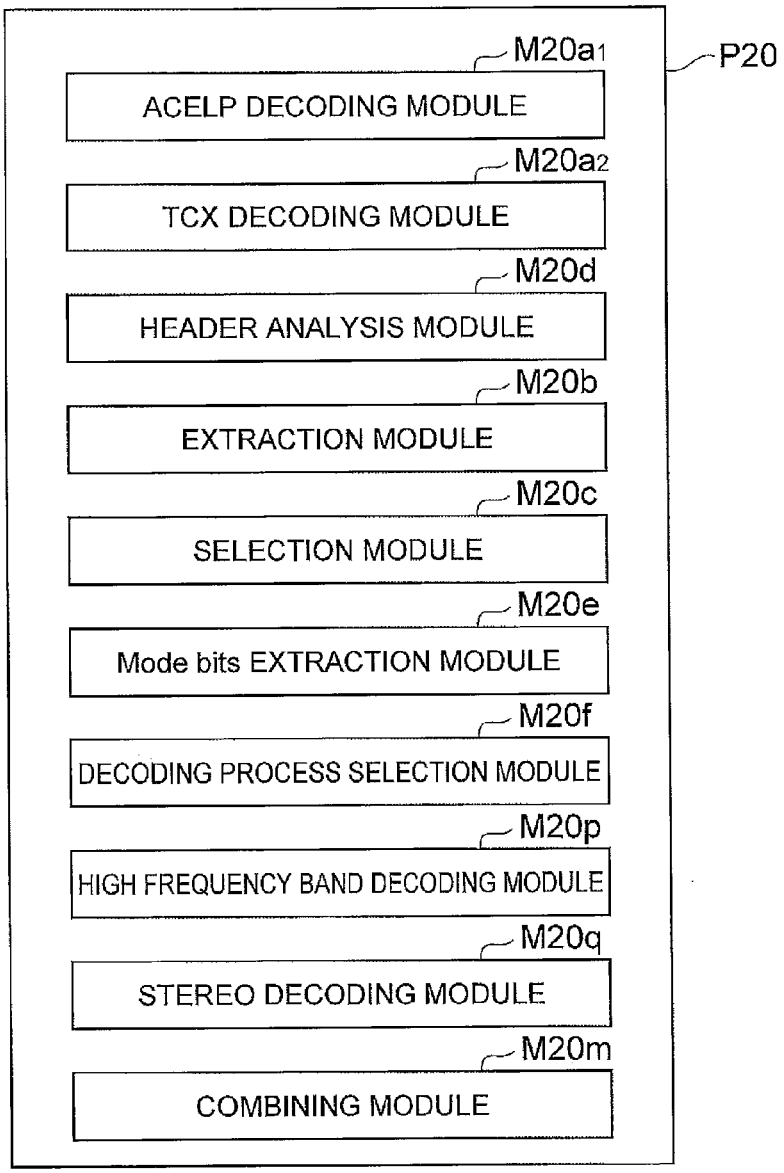
FIG. 25 is a drawing showing an audio decoding program according to another embodiment.

Described below is an audio decoding program that causes a computer to operate as the audio decoding device 20. FIG. 25 shows an audio decoding program according to another embodiment.

The audio decoding program P20 shown in FIG. 25 may be executed in the computer shown in FIGS. 5 and 6. The audio decoding program P20 can be provided in the same manner as the audio encoding program P10.

The audio decoding program P20 is comprised of an ACELP decoding module M20$a_1$, a TCX decoding module M20$a_2$, an extraction module M20*b*, a selection module M20*c*, a header analysis module M20*d*, a Mode bits extraction module M20*e*, a decoding scheme selection module M20*f*, a high frequency band decoding module M20*p*, a stereo decoding module M20*q*, and a synthesis module M20*m*.

The ACELP decoding module M20$a_1$, the TCX decoding module M20$a_2$, the extraction module M20*b*, the selection module M20*c*, the header analysis module M20*d*, the Mode bits extraction module M20*e*, the decoding scheme selection module M20*f*, the high frequency band decoding module M20*p*, the stereo decoding module M20*q*, and the synthesis module M20*m* cause the computer to perform the same functions as performed by the ACELP decoding unit 20$a_1$, the TCX decoding unit 20$a_2$, the extraction unit 20*b*, the selection unit 20*c*, the header analysis unit 20*d*, the Mode bits extraction unit 20*e*, the decoding scheme selection unit 20*f*, the high frequency band decoding unit 20*p*, the stereo decoding unit 20*q*, and the synthesis unit 20*m*, respectively.

Figure 26:
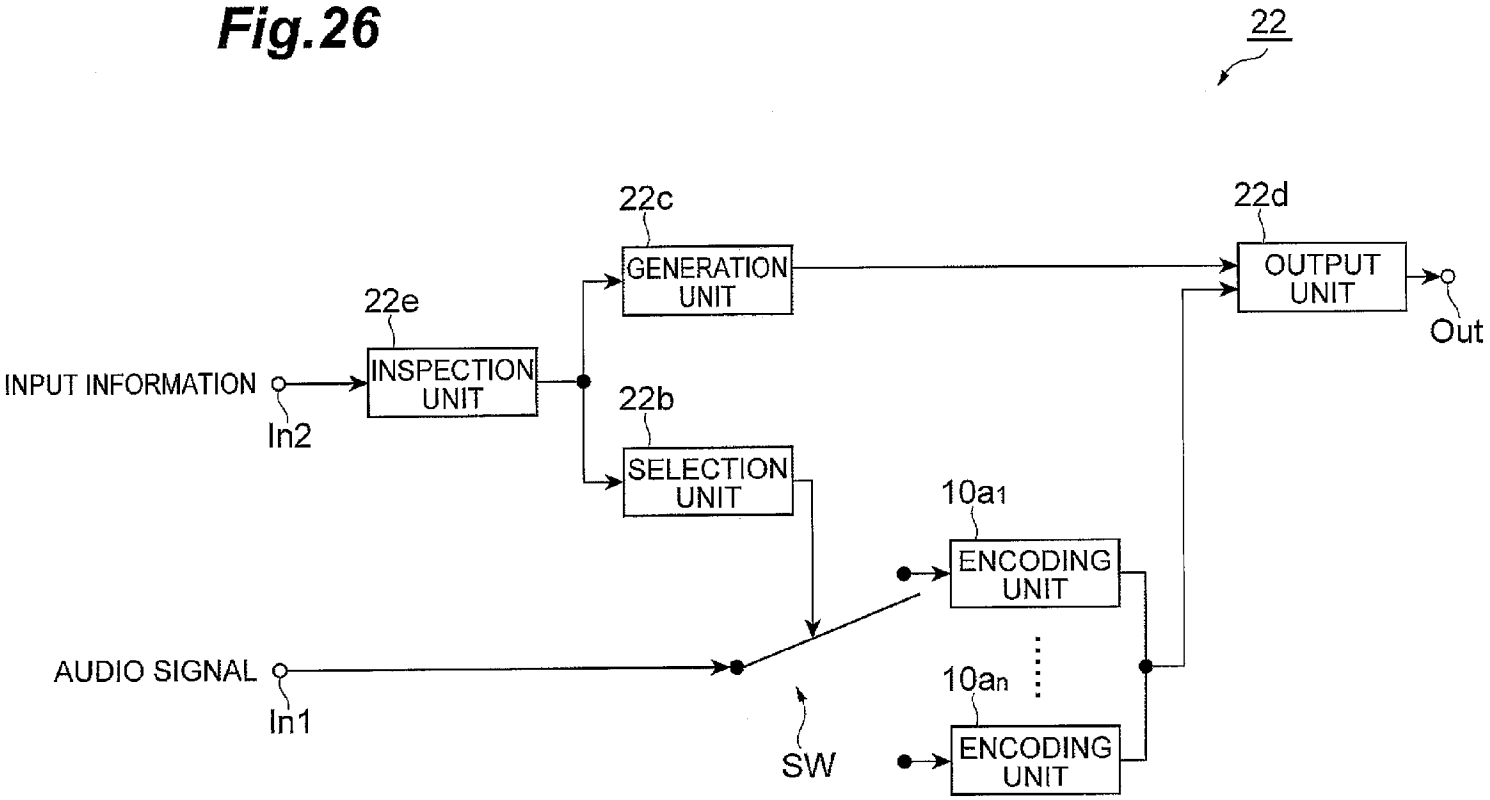
FIG. 26 is a drawing showing an audio encoding device according to another embodiment.

Described below is an audio encoding device of another embodiment. FIG. 26 shows an audio encoding device according to another embodiment. The audio encoding device 22 shown in FIG. 26 can implement switching between an audio encoding scheme used to encode audio signals of a first plurality of frames and an audio encoding scheme used to encode audio signals of subsequent second plurality of frames.

Like the audio encoding device 10, the audio encoding device 22 is comprised of the encoding units 10$a_1$-10$a_n$. The audio encoding device 22 is further comprised of a generation unit 22*c*, a selection unit 22*b*, an output unit 22*d*, and an inspection unit 22*e*.

The inspection unit 22*e* monitors an input inputted in the input terminal In2 and receives input information fed to the input terminal In2. The input information is information for specifying an audio encoding scheme used commonly to encode multiple frames.

The selection unit 22*b* selects an encoding unit according to the input information. Specifically, the selection unit 22*b* controls a switch SW to connect an audio signal fed to the input terminal In1 to an encoding unit to execute the audio encoding scheme specified by the input information. The selection unit 22*b* continues selection of a single encoding unit until next input information is fed to the inspection unit 22*e*.

Every time the inspection unit 22*e* receives input information, the generation unit 22*c* generates, based on the input information, the long-term encoding scheme information which indicates that a common encoding scheme was used for multiple frames.

When the generation unit 22*c* generates the long-term encoding scheme information, the output unit 22*d* adds the long-term encoding scheme information to multiple frames. FIG. 27 shows a stream generated by the audio encoding device shown in FIG. 26. As shown in FIG. 27, the long-term encoding scheme information is added to a lead frame of the multiple frames. In the example shown in FIG. 27, the multiple frames consisting of the first frame to the (l−1)th frame are encoded by a common encoding scheme, the encoding scheme is switched to another at the l-th frame, and the multiple frames from the l-th frame to the m-th frame are encoded by a common encoding scheme.

Figure 28:
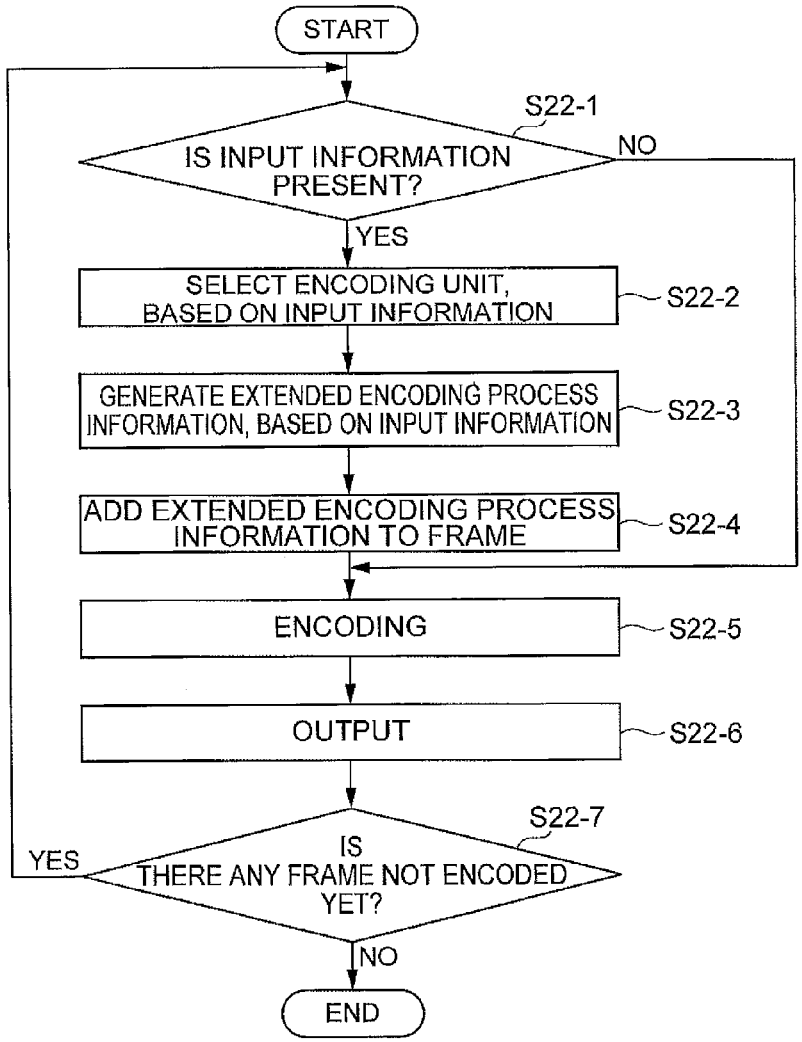
FIG. 28 is a flowchart of an audio encoding method according to another embodiment.

Described below is an operation of the audio encoding device 22 and an audio encoding method according to an embodiment. FIG. 28 is a flowchart showing an audio encoding method according to another embodiment.

In the embodiment, as shown in FIG. 28, in step S22-1, the inspection unit 22*e* monitors inputted input information. When the input information is received, step S22-2 is carried out in which the selection unit 22*b* selects an encoding unit according to the input information.

Next, in step S22-3, the selection unit 22*b* generates the long-term encoding scheme information, based on the input information. The long-term encoding scheme information may be added to a lead frame of the multiple frames by the output unit 22*d* in step S22-4.

In step S22-5, an audio signal of an encoding target frame is then encoded by the selected encoding unit. Until next input information is fed, the audio signal of the encoding target frame is encoded without passing through the processes of steps S22-2 to S22-4.

Next, in step S22-6, the encoded coded sequence is added in a frame in a bit stream corresponding to the encoding target frame and is outputted from the output unit 22*d*.

Next, it is judged in step S22-7 whether there is any frame left to be encoded. When there is no frame left uncoded, the process ends. On the other hand, when there is a frame left to be encoded, the processes from step S22-1 are performed.

Figure 29:
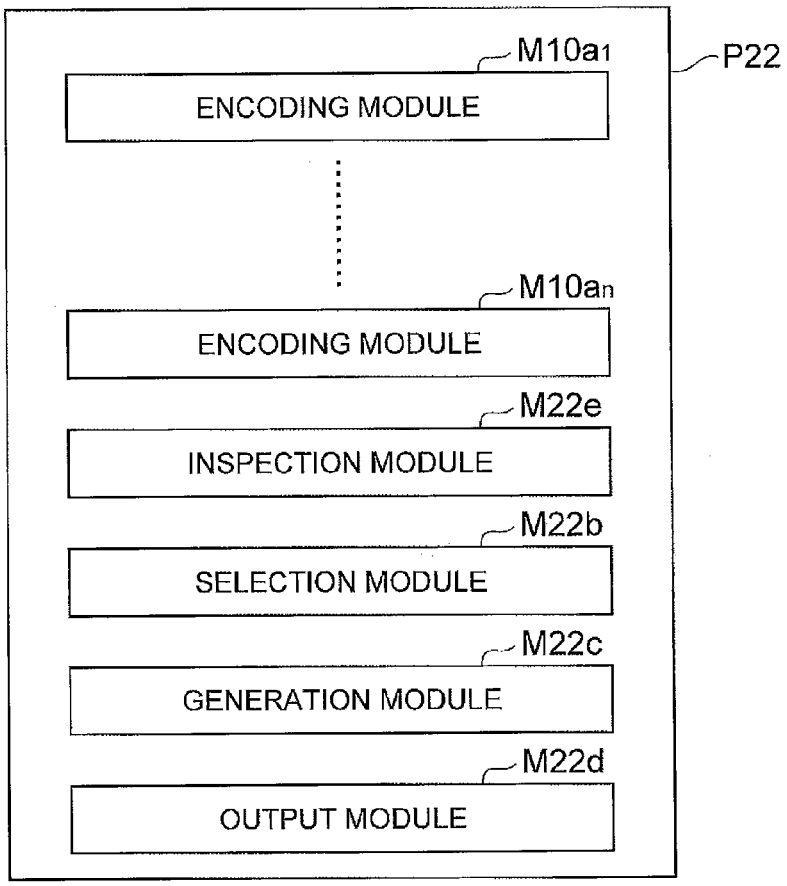
FIG. 29 is a drawing showing an audio encoding program according to another embodiment.

Described below is an audio encoding program that cause a computer to operate as the audio encoding device 22. FIG. 29 shows an audio encoding program according to another embodiment.

The audio encoding program P22 shown in FIG. 29 may be executed in the computer shown in FIGS. 5 and 6. The audio encoding program P22 can be provided in the same manner as the audio encoding program P10.

As shown in FIG. 29, the audio encoding program P22 is comprised of encoding modules M10$a_1$-10$a_n$, a generation module M22*c*, a selection module M22*b*, an output module M22*d*, and an inspection module M22*e*.

The encoding modules M10$a_1$-10$a_n$, the generation module M22*c*, the selection module M22*b*, the output module M22*d*, and the inspection module M22*e* cause the computer C10 to perform the same functions as performed by the encoding units 10$a_1$-10$a_n$, the generation unit 22*c*, the selection unit 22*b*, the output unit 22*d*, and the inspection unit 22*e*, respectively.

Figure 30:
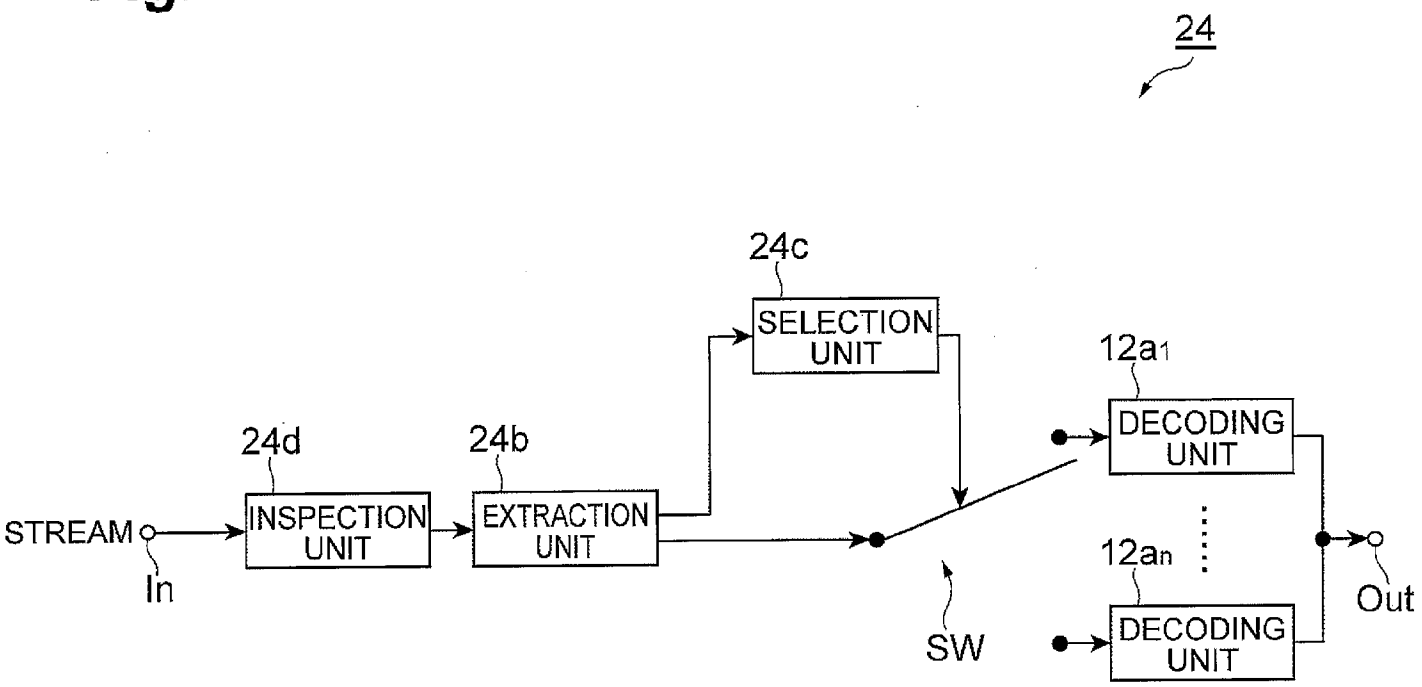
FIG. 30 is a drawing showing an audio decoding device according to another embodiment.

Described below is an audio decoding device that decodes a stream generated by the audio encoding device 22. FIG. 30 shows an audio decoding device according to another embodiment.

Like the audio decoding device 12, an audio decoding device 24 shown in FIG. 30 is comprised of the decoding units 12$a_1$-12$a_n$. The audio decoding device 24 is further comprised of an extraction unit 24*b*, a selection unit 24*c*, and an inspection unit 24*d*.

The inspection unit 24*d* determines whether the long-term encoding scheme information is included in each frame in a stream fed to the input terminal In. When the inspection unit 24*d* determines that the long-term encoding scheme information is included in a frame, the extraction unit 24*b* extracts the long-term encoding scheme information from the frame. The extraction unit 24*b* sends the frame to a switch SW after the long-term encoding scheme information is extracted.

When the extraction unit 24*b* extracts the long-term encoding scheme information, the selection unit 24*c* controls the switch SW, based on the long-term encoding scheme information, to select a decoding unit to execute an audio decoding scheme corresponding to an encoding scheme specified. Until the inspection unit 24*d* extracts next long-term encoding scheme information, the selection unit 24*c* continues selecting a single decoding unit and continues decoding coded sequences of multiple frames by a common audio decoding scheme.

Figure 31:
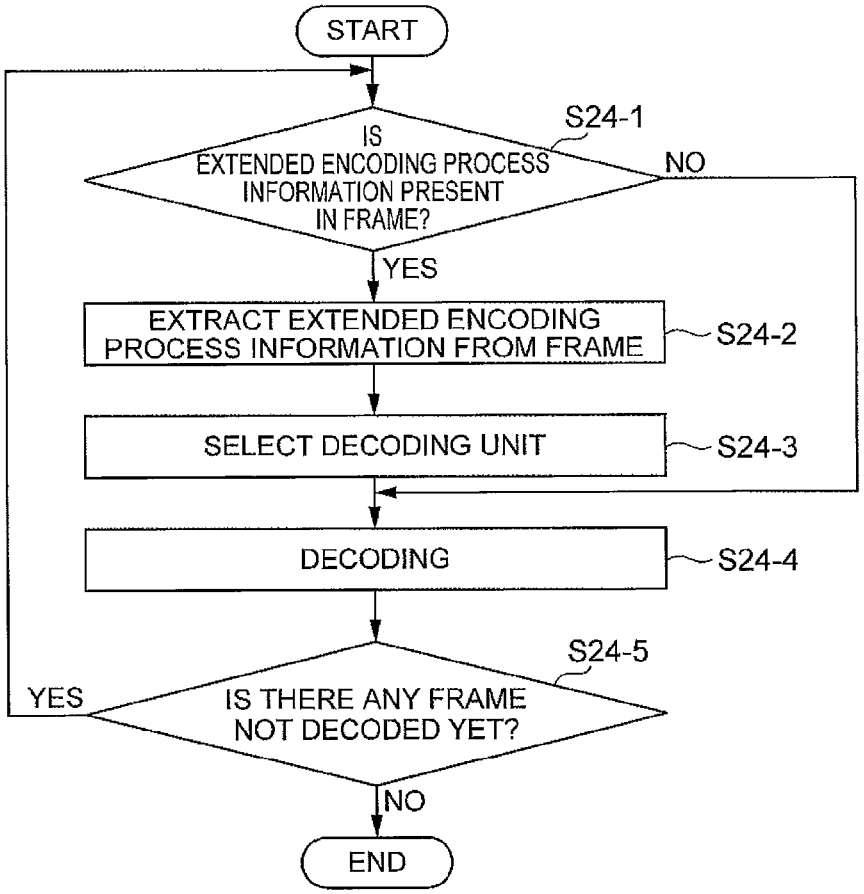
FIG. 31 is a flowchart of an audio decoding method according to another embodiment.

Described below is an operation of the audio decoding device 24 and an audio decoding method according to an embodiment. FIG. 31 is a flowchart showing the audio decoding method according to another embodiment.

In the embodiment as shown in FIG. 31, in step S24-1, the inspection unit 24*d* monitors whether long-term encoding scheme information is included in an input frame. When the inspection unit 24*d* detects the long-term encoding scheme information, subsequent step S24-2 is carried out in which the extraction unit 24*b* extracts the long-term encoding scheme information from the frame.

Next, in step S24-3, the selection unit 24*c* selects an appropriate decoding unit, based on the long-term encoding scheme information extracted. In subsequent step S24-4, the selected decoding unit decodes a coded sequence of a decoding target frame.

It is then judged in step S24-5 whether there is any frame left to be decoded. When there is no frame left to be decoded, the process ends. On the other hand, when there is a frame left to be decoded, the processes from step S24-1 are executed.

In the present embodiment, when it is determined in step S24-1 that the long-term encoding scheme information is not added to the frame, the process of step S24-4 is executed without passing through the processes of step S24-2 and step S24-3.

Figure 32:
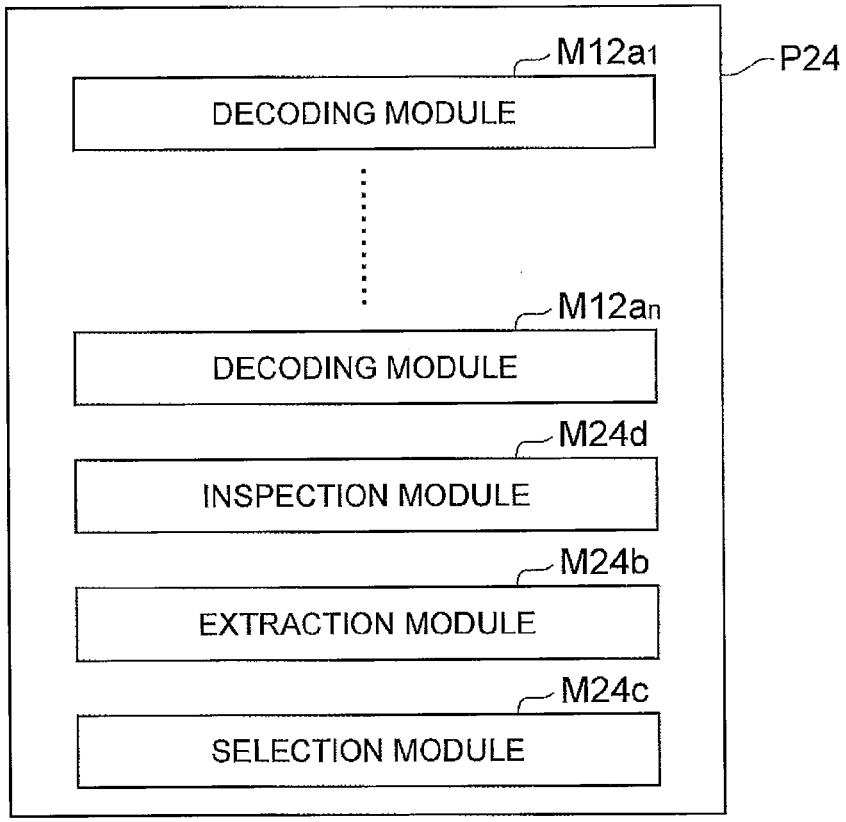
FIG. 32 is a drawing showing an audio decoding program according to another embodiment.

Described below is an audio decoding program that causes a computer to operate as the audio decoding device 24. FIG. 32 shows an audio decoding program according to another embodiment.

The audio decoding program P24 shown in FIG. 32 may be executed in the computer shown in FIGS. 5 and 6. The audio decoding program P24 can be provided in the same manner as the audio encoding program P10.

As shown in FIG. 32, the audio decoding program P24 is comprised of the decoding modules M12$a_1$-12$a_n$, an extraction module M24*b*, a selection module M24*c*, and an inspection module M24*d*.

The decoding modules M12$a_1$-12$a_n$, the extraction module M24*b*, the selection module M24*c*, and the inspection module M24*d* cause the computer C10 to perform the same functions as performed by the decoding units 12$a_1$-12$a_n$, the extraction unit 24*b*, the selection unit 24*c*, and the inspection unit 24*d*, respectively.

Figure 33:
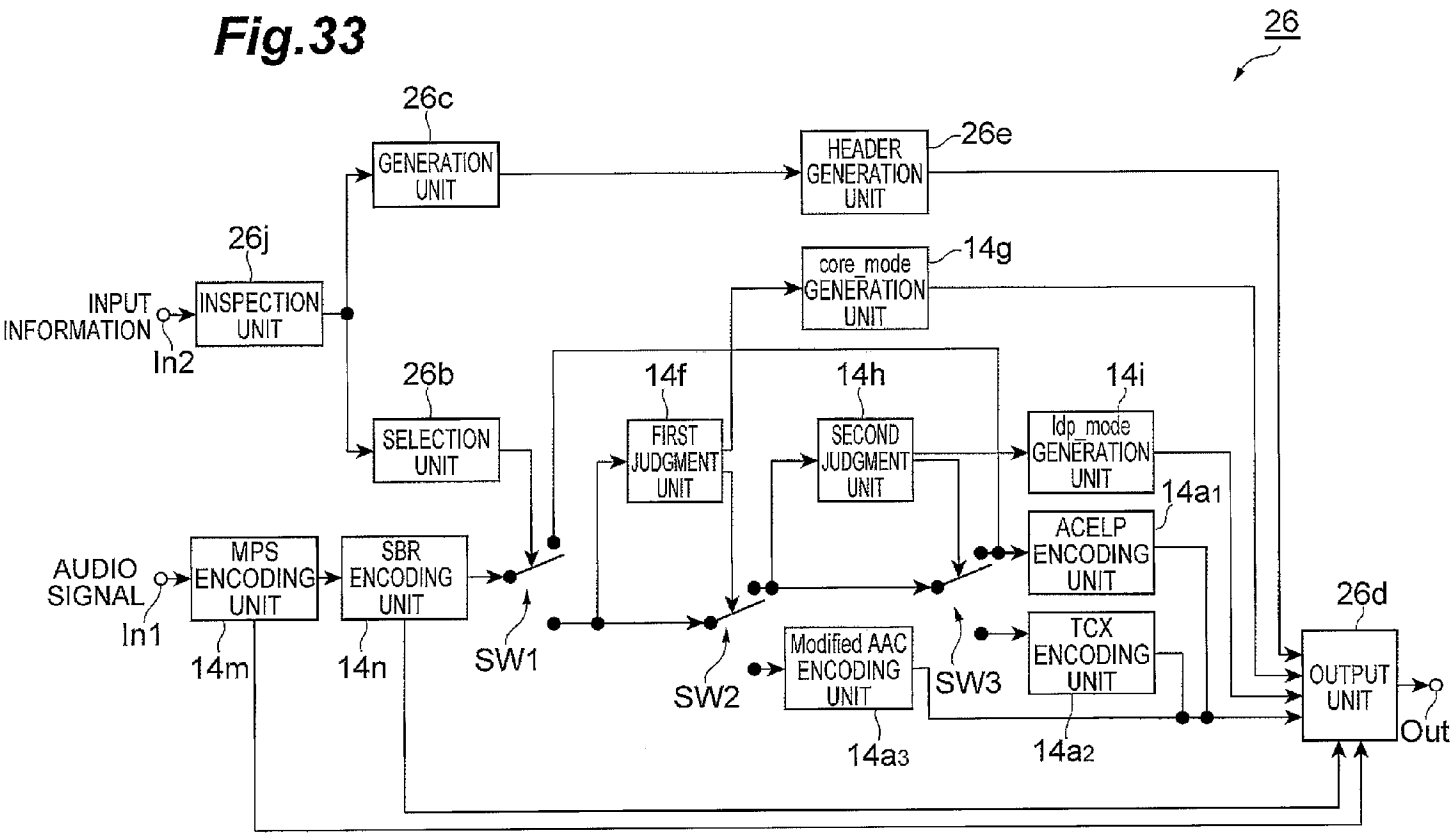
FIG. 33 is a drawing showing an audio encoding device according to another embodiment.

Described below is an audio encoding device according to another embodiment. FIG. 33 shows an audio encoding device according to another embodiment. FIG. 34 shows streams generated according to the conventional MPEG USAC and a stream generated by the audio encoding device shown in FIG. 33.

The aforementioned audio encoding device 14 can either encode audio signals of all frames by a single common audio encoding scheme or encode an audio signal of each frame by a respective audio encoding scheme.

On the other hand, the audio encoding device 26 shown in FIG. 33 uses a common audio encoding scheme for some frames of the multiple frames. The audio encoding device 26 also uses respective audio encoding schemes for some frames of the frames. Furthermore, the audio encoding device 26 uses a common audio encoding scheme for multiple frames coming amid all the frames.

As shown in FIG. 33, like the audio encoding device 14, the audio encoding device 26 is comprised of the ACELP encoding unit 14$a_1$, the TCX encoding unit 14$a_2$, the Modified AAC encoding unit 14$a_3$, the first judgment unit 14*f*, the core_mode generation unit 14*g*, the second judgment unit 14*h*, the lpd_mode generation unit 14*i*, the MPS encoding unit 14*m*, and the SBR encoding unit 14*n*. The audio encoding device 26 is further comprised of an inspection unit 26*j*, a selection unit 26*b*, a generation unit 26*c*, an output unit 26*d*, and a header generation unit 26*e*. Among the elements of the audio encoding device 26, elements different from those of the audio encoding device 14 will be described below.

The inspection unit 26*j* inspects whether there is input information fed to the input terminal In2. The input information is information indicating whether audio signals of multiple frames are to be encoded by a common audio encoding scheme.

When the inspection unit 26*j* detects the input information, the selection unit 26*b* controls a switch SW1. Specifically, when the detected input information indicates that audio signals of multiple frames are to be encoded by a common audio encoding scheme, the selection unit 26*b* controls the switch SW1 to connect the switch SW1 to the ACELP encoding unit 14$a_1$. On the other hand, when the detected input information indicates that audio signals of multiple frames are not to be encoded by a common audio encoding scheme, the selection unit 26*b* controls the switch SW1 to connect the switch SW1 to a path leading to the first judgment unit 14*f* and others.

When the inspection unit 26*j* detects the input information, the generation unit 26*c* generates GEM_ID for an output frame corresponding to an encoding target frame found at that point. Specifically, when the detected input information indicates that audio signals of multiple frames are to be encoded by a common audio encoding scheme, the generation unit 26*c* sets the value of GEM_ID to "1." On the other hand, when the detected input information indicates that audio signals of multiple frames are not to be encoded by a common audio encoding scheme, the generation unit 26*c* sets the value of GEM_ID to "0."

When the inspection unit 26*j* detects the input information, the header generation unit 26*e* generates a header of an output frame corresponding to an encoding target frame found at that point and adds GEM_ID generated by the generation unit 26*c* in the header.

The output unit 26*d* outputs an output frame including a generated coded sequence. Furthermore, the output unit 26*d* adds in each output frame encoded data of a parameter generated by the MPS encoding unit 14*m* and encoded data of a parameter generated by the SBR encoding unit 14*n*. When the input information is detected by the inspection unit 26*j*, the output frame contains the header generated by the header generation unit 26*e*.

Figure 35:
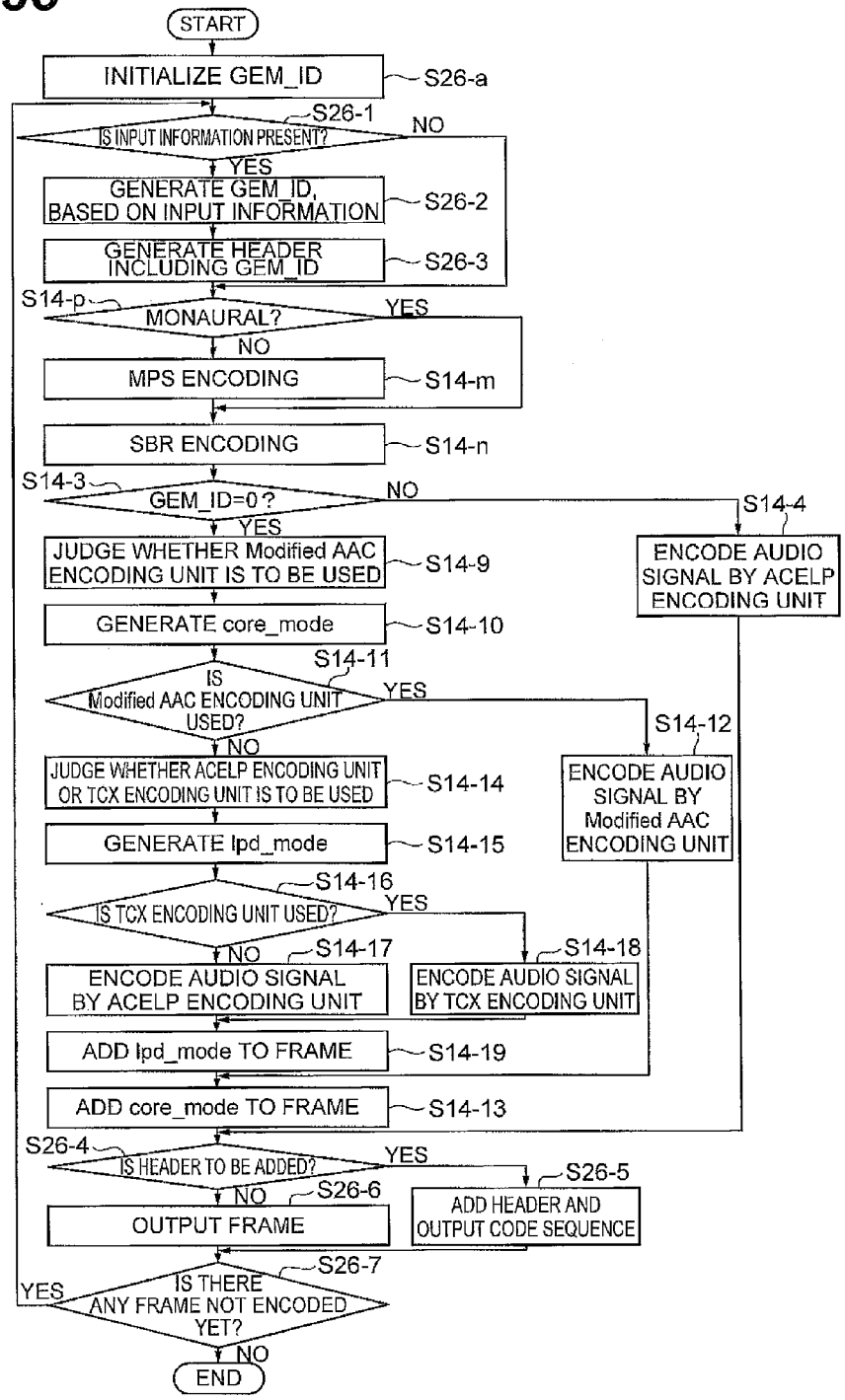
FIG. 35 is a flowchart of an audio encoding method according to another embodiment.

Described below are an operation of the audio encoding device 26 and an audio encoding method according to another embodiment. FIG. 35 is a flowchart showing an audio encoding method according to another embodiment.

In the flow shown in FIG. 35, the processes of steps S14-3 to 4, steps S14-9 to 19, and step S14-*m* to step S14-*n* are the same as those shown in FIG. 13. The processes different from those in the flow shown in FIG. 13 will be described below.

In the embodiment as shown in FIG. 35, in step S26-*a*, the value of GEM_ID is initialized. The value of GEM_ID may be initialized, for example, to "0." In step S26-1, the inspection unit 26*j* monitors the input information as described above. When an input of the input information is detected, subsequent step S26-2 is carried out in which the generation unit 26*c* generates GEM_ID according to the input information, and thereafter step S26-3 is carried out in which the header generation unit 26*e* generates a header including GEM_ID thus generated. On the other hand, when there is no input information detected, the process proceeds to step S14-*p*, without passing through the processes of steps S26-2 and S26-3.

In step S26-4, it is determined whether a header is to be added. When the inspection unit 26*j* detects the input information, a header including GEM_ID is added in step S26-5 to an output frame corresponding to an encoding target frame found at that point, and the frame including the header is outputted. On the other hand, when no input information is detected, an output frame corresponding to an encoding target frame found at that point is outputted as it is in step S26-6.

It is then judged in step S26-7 whether there is any frame left to be encoded. When there is no frame left uncoded, the process ends. On the other hand, when there is a frame left to be encoded, the processes from step S26-1 are executed for a target frame left to be encoded.

According to the audio encoding device 26 and the audio encoding method of the embodiment described above, multiple frames are encoded by a common audio encoding scheme, some frames thereafter are encoded by respective audio encoding schemes, and multiple frames subsequent thereto are encoded by a common audio encoding scheme.

The audio encoding device 26 determines an audio encoding scheme to be used to encode audio signals of multiple frames, based on the input information. However, in the present invention, an audio encoding scheme to be used commonly for multiple frames may be determined based on the result of an analysis on an audio signal of each frame. For example, an analysis unit to analyze an audio signal of each frame is provided between the input terminal In1 and the switch SW1 and, the selection unit 26*b* and the generation unit 26*c*, and others may be made to operate based on the analysis result. The aforementioned analysis technique may be applied to this analysis.

It should be noted that audio signals of all frames may be connected to the path including the first judgment unit 14*f* and output frames including coded sequences may be stored in the output unit 26*d*. In this case, using the judgment results by the first judgment unit 14*f* and the second judgment unit 14*h*, operations, such setting of lpd_mode, core_mode, and so on, and generation and addition of the header, may be performed ex-post for each frame.

It should be noted that after an analysis is performed on a predetermined number of frames, or judgments are performed on the predetermined number of frames by the first judgment unit 14*f* and the second judgment unit, an encoding scheme commonly to be used for multiple frames including the predetermined number of frames may be predicted, using the analysis result or the judgment results on the predetermined number of frames.

Whether a common encoding scheme or respective encoding schemes are executed for multiple frames may be determined so as to reduce an amount of additional information including core_mode, lpd_mode, and the header or the like.

Figure 36:
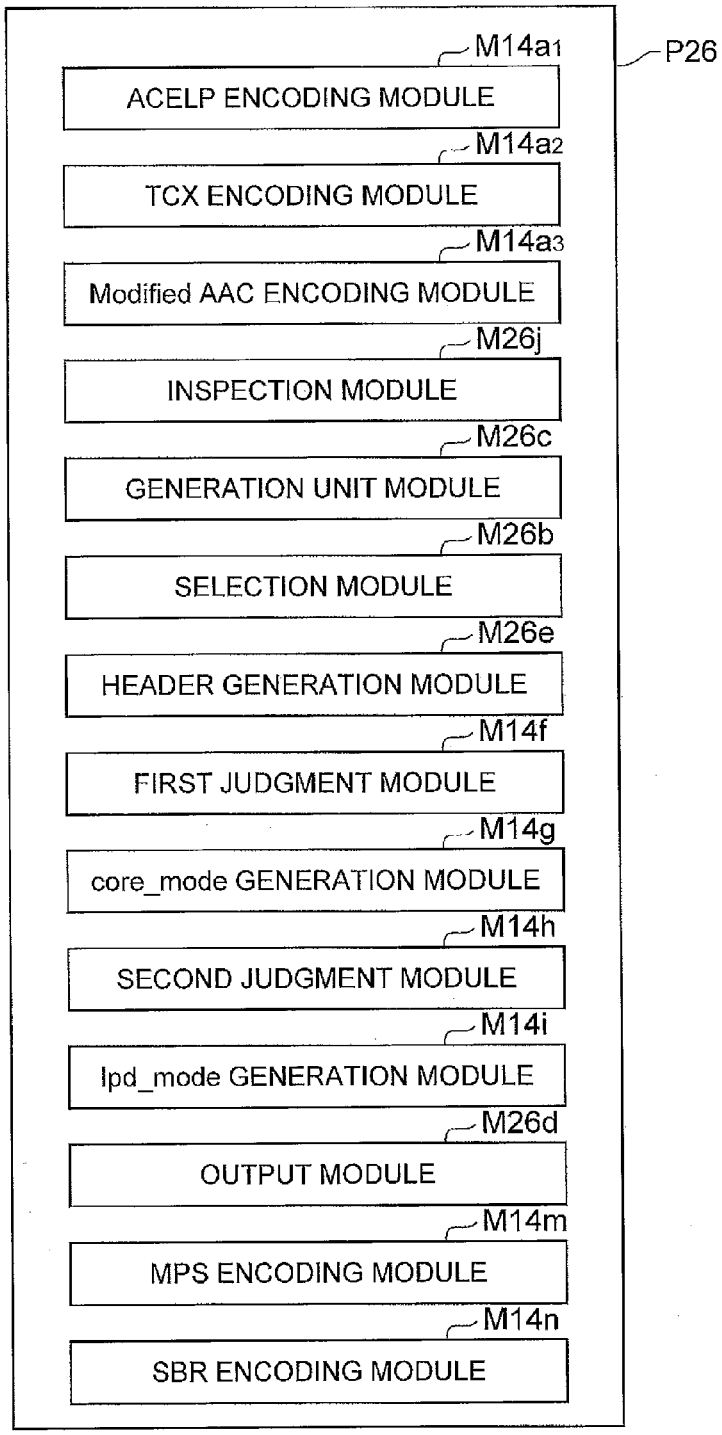
FIG. 36 is a drawing showing an audio encoding program according to another embodiment.

Described below is an audio encoding program that cause a computer to operate as the audio encoding device 26. FIG. 36 shows an audio encoding program according to another embodiment.

The audio encoding program P26 shown in FIG. 36 may be executed in the computer shown in FIGS. 5 and 6. The audio encoding program P26 can be provided in the same manner as the audio encoding program P10.

As shown in FIG. 36, the audio encoding program P26 is comprised of the ACELP encoding module M14$a_1$, the TCX encoding module M14$a_2$, the Modified AAC encoding module M14$a_3$, the first judgment module M14*f*, the core_mode generation module M14*g*, the second judgment module M14*h*, the lpd_mode generation module M14*i*, the MPS encoding module M14*m*, the SBR encoding module M14*n*, an inspection module M26*j*, a selection module M26*b*, a generation module M26*c*, an output module M26*d*, and a header generation module M26*e*.

The ACELP encoding module M14$a_1$, the TCX encoding module M14$a_2$, the Modified AAC encoding module M14$a_3$, the first judgment module M14*f*, the core_mode generation module M14*g*, the second judgment module M14*h*, the lpd_mode generation module M14*i*, the MPS encoding module M14*m*, the SBR encoding module M14*n*, the inspection module M26*j*, the selection module M26*b*, the generation module M26*c*, the output module M26*d*, and the header generation module M26*e* cause the computer C10 to perform the same functions as performed by the ACELP encoding unit 14$a_1$, the TCX encoding unit 14$a_2$, the Modified AAC encoding unit 14$a_3$, the first judgment unit 14*f*, the core_mode generation unit 14*g*, the second judgment unit 14*h*, the lpd_mode generation unit 14*i*, the MPS encoding unit 14*m*, the SBR encoding unit 14*n*, the inspection unit 26*j*, the selection unit 26*b*, the generation unit 26*c*, the output unit 26*d*, and the header generation unit 26*e*, respectively.

Figure 37:
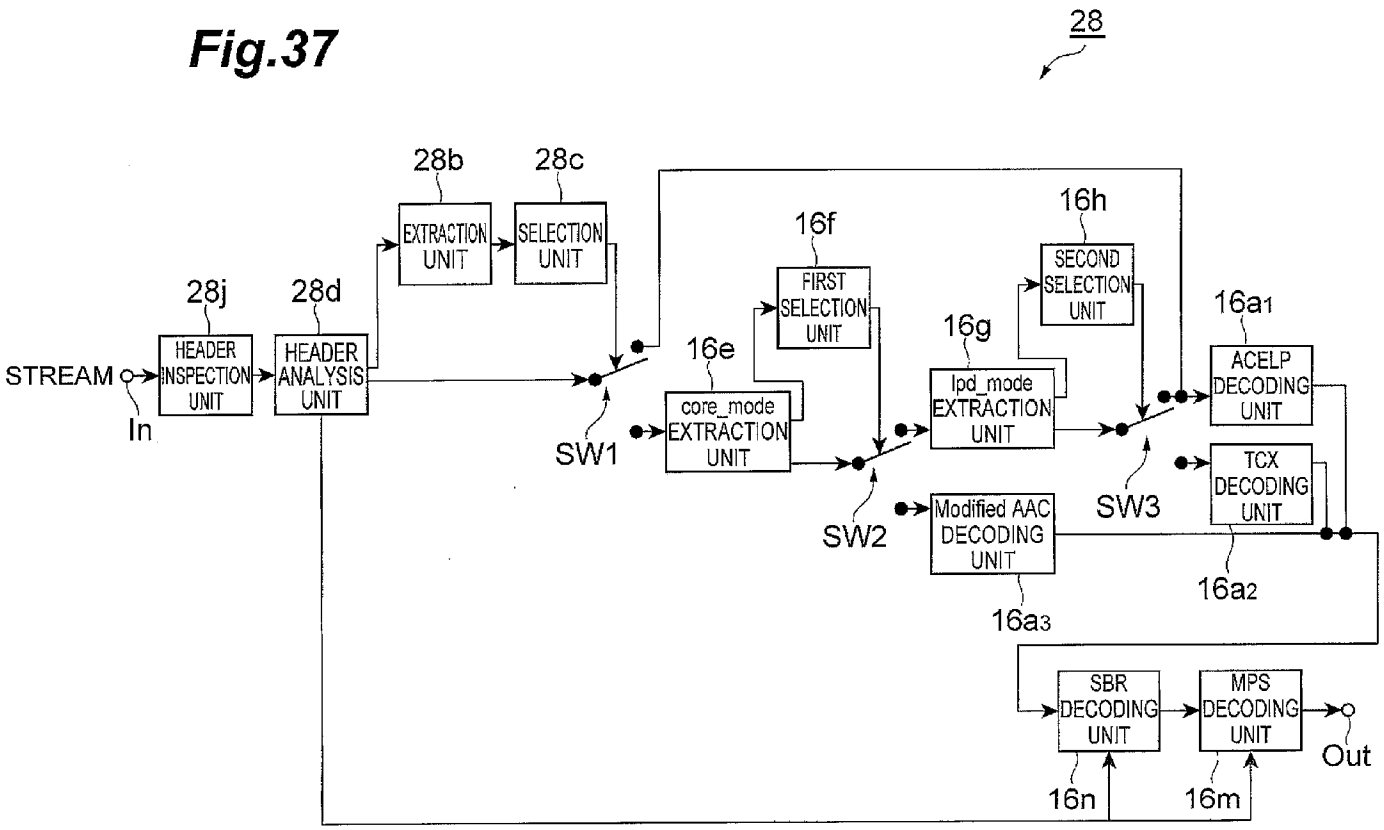
FIG. 37 is a drawing showing an audio decoding device according to another embodiment.

Described below is an audio decoding device that decodes a stream generated by the audio encoding device 26. FIG. 37 shows an audio decoding device according to another embodiment.

Like the audio decoding device 16, the audio decoding device 28 shown in FIG. 37 is comprised of the ACELP decoding unit 16$a_1$, the TCX decoding unit 16$a_2$, the Modified AAC decoding unit 16$a_3$, the core_mode extraction unit 16*e*, the first selection unit 16*f*, the lpd_mode extraction unit 16*g*, the second selection unit 16*h*, the MPS decoding unit 16*m*, and the SBR decoding unit 16*n*. The audio decoding device 28 is further comprised of a header inspection unit 28*j*, a header analysis unit 28*d*, an extraction unit 28*b*, and a selection unit 28*c*. Among the elements of the audio decoding device 28, elements different from those of the audio decoding device 16 will be described below.

The header inspection unit 28*j* monitors whether there is a header in each frame fed to the input terminal In. When the header inspection unit 28*j* detects that there is a header in a frame, the header analysis unit 28*d* separates the header. The extraction unit 28*b* extracts GEM_ID from the extracted header.

The selection unit 28*c* controls a switch SW1 according to extracted GEM_ID. Specifically, when the value of GEM_ID is "1," the selection unit 28*c* controls the switch SW1 to connect the frame sent from the header analysis unit 28*d*, to the ACELP decoding unit 16$a_1$ until next GEM_ID is extracted.

On the other hand, when the value of GEM_ID is "0," the selection unit 28*c* connects the frame sent from the header analysis unit 28*d* to the core_mode extraction unit 16*e*.

Figure 38:
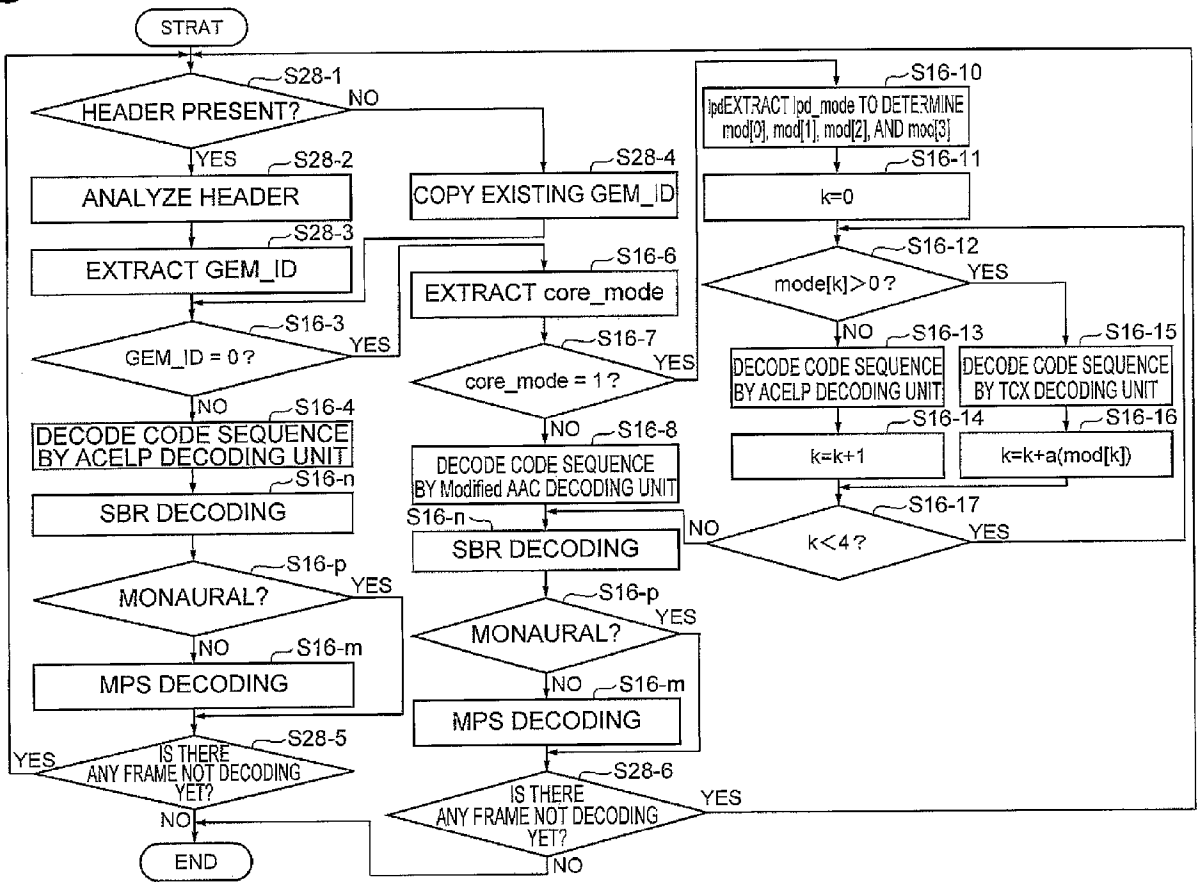
FIG. 38 is a flowchart of an audio decoding method according to another embodiment.

Described below is operations of the audio decoding device 28 and an audio decoding method according to another embodiment. FIG. 38 is a flowchart showing an audio decoding method according to another embodiment.

The processes specified by reference signs including "S16" in FIG. 38 are the same processes as the corresponding processes found in FIG. 16. Among the processes in FIG. 38, processes different from those shown in FIG. 16 will be described below.

In the embodiment as shown in FIG. 38, in step S28-1, the header inspection unit 28*j* monitors whether there is a header included in an input frame. When a header is included in a frame, subsequent step S28-2 is carried out in which the header analysis unit 28*d* separates the header from the frame.

In step S28-3, the extraction unit 28*b* then extracts GEM_ID from the header. On the other hand, when there is no header found in the frame, step S28-4 is carried in which GEM_ID extracted immediately before is copied, and copied GEM_ID is used thereafter.

It is judged in step S28-5 whether there is any frame left to be decoded. When there is no frame left to be decoded, the process ends. On the other hand, when there is a frame left to be decoded, the processes from step S28-1 are executed for a target frame left to be decoded.

It is judged in step S28-6 whether there is any frame left to be decoded. When there is no frame left to be decoded, the process ends. On the other hand, when there is a frame left to be decoded, the processes from step S28-1 are executed for a target frame left to be decoded.

Figure 39:
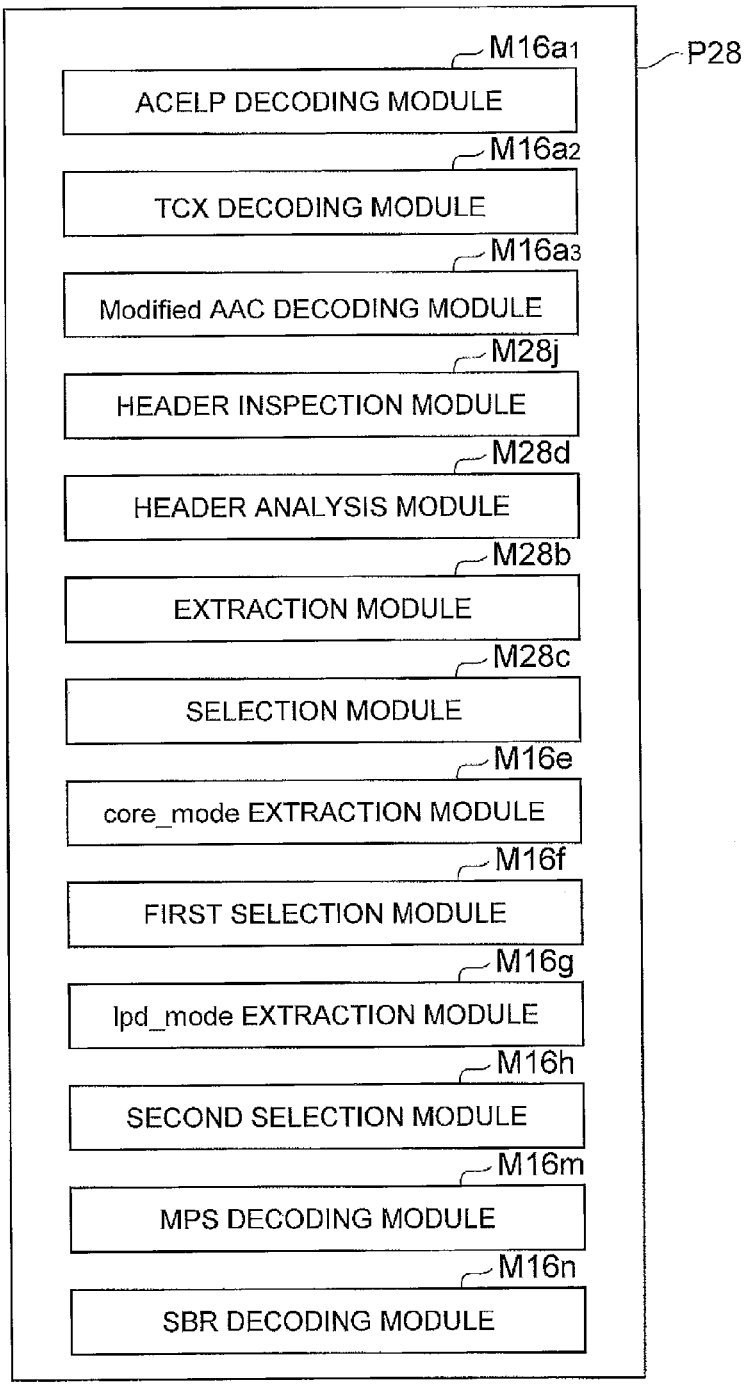
FIG. 39 is a drawing showing an audio decoding program according to another embodiment.

Described below is an audio decoding program that causes a computer to operate as the audio decoding device 28. FIG. 39 shows an audio decoding program according to another embodiment.

An audio decoding program P28 shown in FIG. 39 may be executed in the computer shown in FIGS. 5 and 6. The audio decoding program P28 can be provided in the same manner as the audio encoding program P10.

As shown in FIG. 39, the audio decoding program P28 is comprised of the ACELP decoding module M16*a*1, the TCX decoding module M16*a*2, the Modified AAC decoding module M16*a*3, the core_mode extraction module M16*e*, the first selection module M16*f*, the lpd_mode extraction module M16*g*, the second selection module M16*h*, the MPS decoding module M16*m*, the SBR decoding module M16*n*, a header inspection module M28*j*, a header analysis module M28*d*, an extraction module M28*b*, and a selection module M28*c*.

The ACELP decoding module M16*a*1, the TCX decoding module M16*a*2, the Modified AAC decoding module M16*a*3, the core_mode extraction module M16*e*, the first selection module M16*f*, the lpd_mode extraction module M16*g*, the second selection module M16*h*, the MPS decoding module M16*m*, the SBR decoding module M16*n*, the header inspection module M28*j*, the header analysis module M28*d*, the extraction module M28*b*, and the selection module M28*c* cause the computer C10 to perform the same functions as performed by the ACELP decoding unit 16$a_1$, the TCX decoding unit 16$a_2$, the Modified AAC decoding unit 16$a_3$, the core_mode extraction unit 16*e*, the first selection unit 16*f*, the lpd_mode extraction unit 16*g*, the second selection unit 16*h*, the MPS decoding unit 16*m*, the SBR decoding unit 16*n*, the header inspection unit 28*j*, the header analysis unit 28*d*, the extraction unit 28*b*, and the selection unit 28*c*, respectively.

Figure 40:
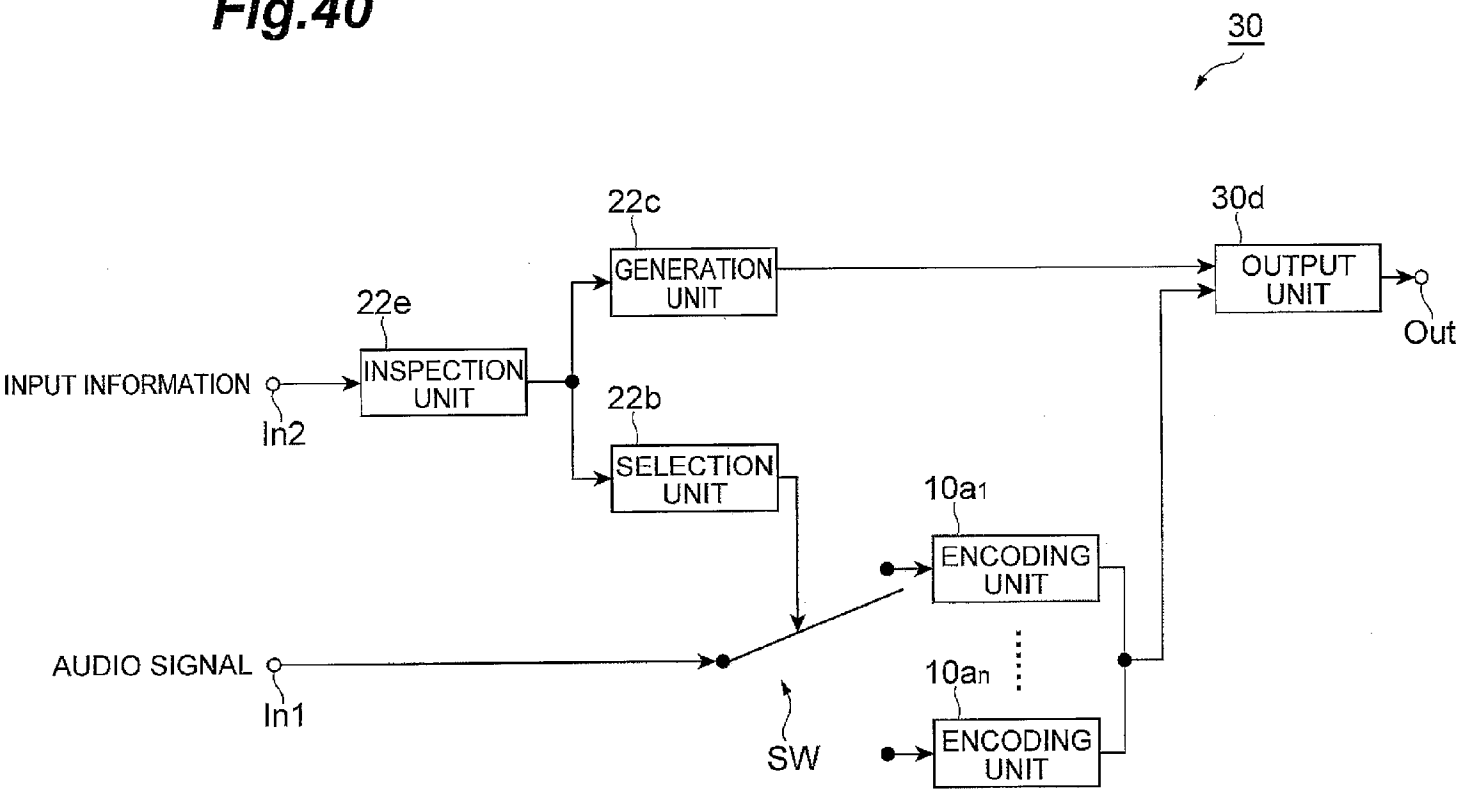
FIG. 40 is a drawing showing an audio encoding device according to another embodiment.
Figure 41:
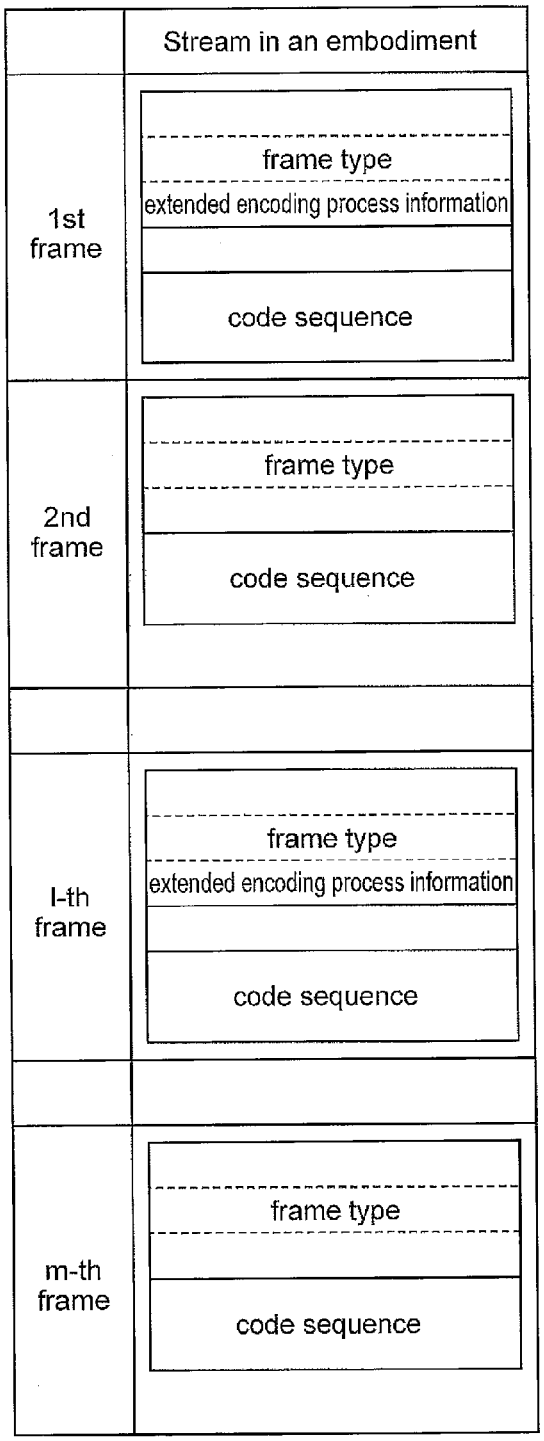
FIG. 41 is a drawing showing a stream generated by the audio encoding device shown in FIG. 40.

Described below is an audio encoding device according to another embodiment. FIG. 40 shows an audio encoding device according to another embodiment. FIG. 41 shows a stream generated by the audio encoding device shown in FIG. 40.

The audio encoding device 30 shown in FIG. 40 has the elements of the audio encoding device 22, except an output unit 30*d*. Namely, in the audio encoding device 30, when GEM_ID is generated, the output unit 30*d* outputs an output frame as an output frame of a first frame type including the long-term encoding scheme information. On the other hand, if the long-term encoding scheme information is not generated, the output unit 30*d* outputs an output frame as an output frame of a second frame type including no long-term encoding scheme information.

Figure 42:
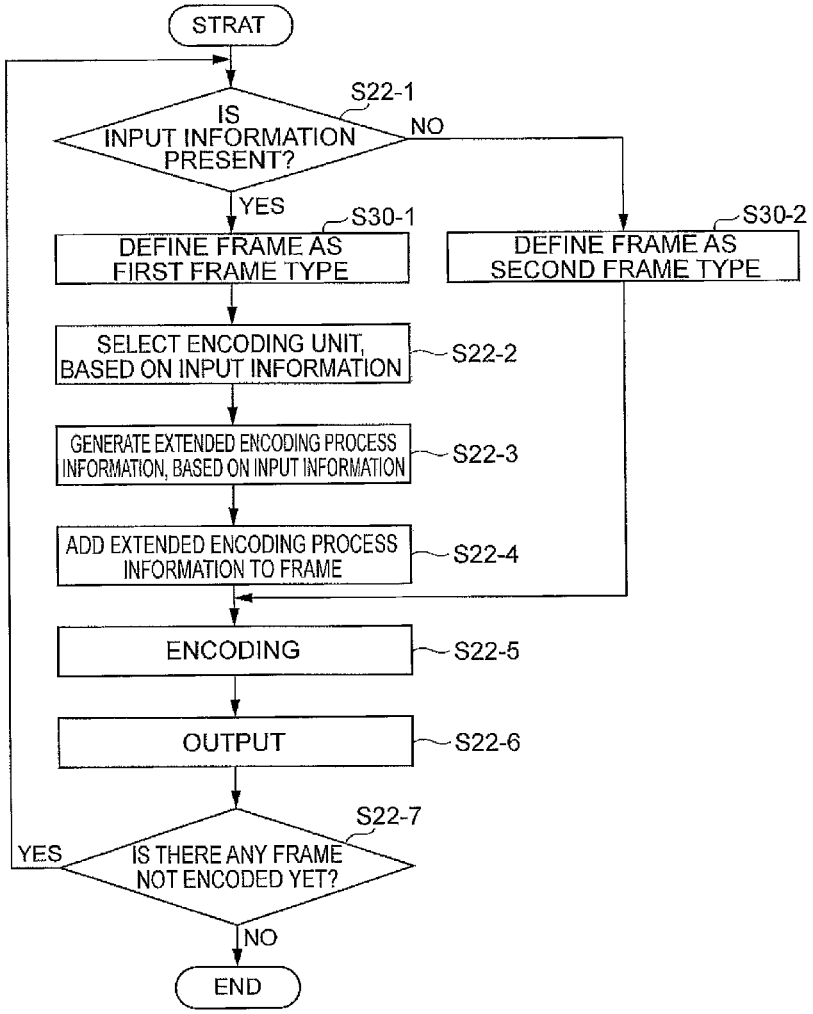
FIG. 42 is a flowchart of an audio encoding method according to another embodiment.

FIG. 42 is a flowchart showing an audio encoding method according to another embodiment. Described below with reference to FIG. 42 are operations of the audio encoding device 30 and the audio encoding method according to another embodiment. It is noted that the processes shown in FIG. 42 are the same as those shown in FIG. 28, except the processes of step S30-1 and step S30-2. Therefore, step S30-1 and step S30-2 will be described below.

When input information is fed in step S22-1, step S30-1 is carried out in which the output unit 30*d* sets an output frame corresponding to an encoding target frame found at that point to the first frame type that includes the long-term encoding scheme information. On the other hand, when no input information is fed in step S22-1, step S30-2 is carried out in which the output unit 30*d* sets an output frame corresponding to an encoding target frame found at that point to the second frame type including no long-term encoding scheme information. In an embodiment, the input information is inputted when the first frame of the audio signal is inputted, and an output frame corresponding to the first frame is set to the first frame type.

When the frame type is changed depending upon the presence or absence of the long-term encoding scheme information as described above, it also becomes possible to notify the decoder side of the long-term encoding scheme information.

Figure 43:
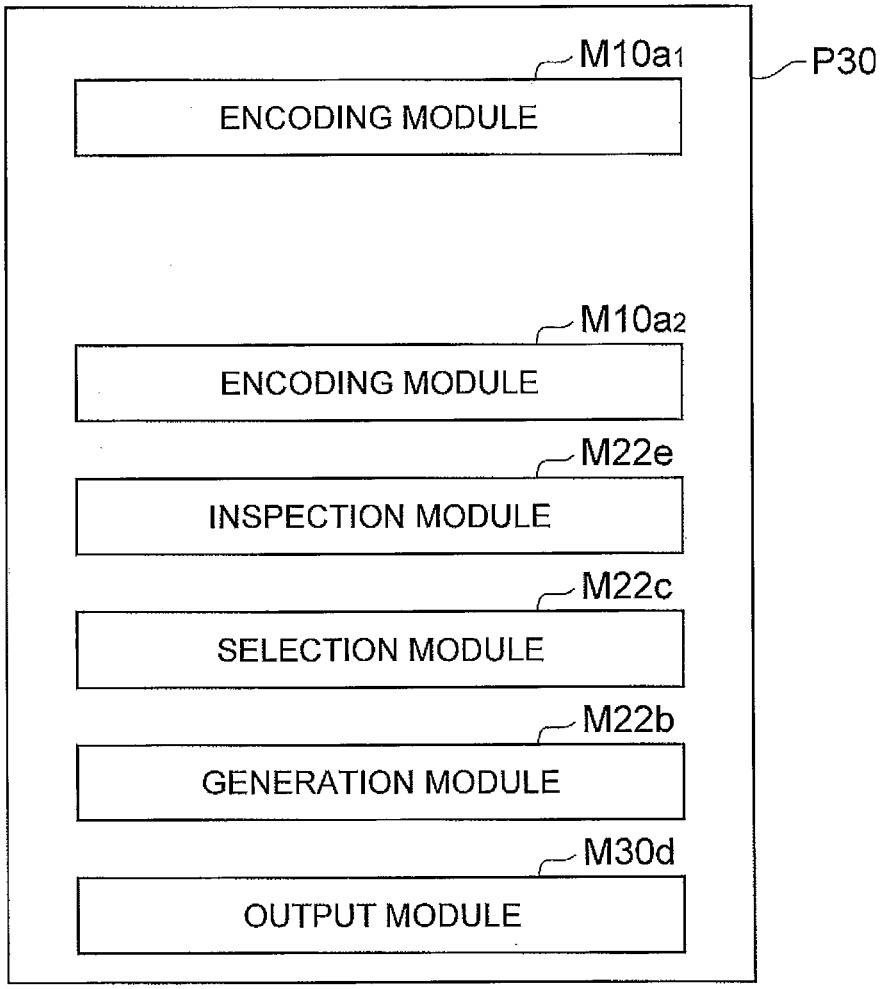
FIG. 43 is a drawing showing an audio encoding program according to another embodiment.

Described below is an audio encoding program that cause a computer to operate as the audio encoding device 30. FIG. 43 shows an audio encoding program according to another embodiment.

The audio encoding program P30 shown in FIG. 43 may be executed in the computer shown in FIGS. 5 and 6. Furthermore, the audio encoding program P30 can be provided in the same manner as the audio encoding program P10.

As shown in FIG. 43, the audio encoding program P30 is comprised of the encoding modules M10$a_1$-10$a_n$, the generation module M22*c*, the selection module M22*b*, an output module M30*d*, and the inspection module M22*e*.

The encoding modules M10$a_1$-10$a_n$, the generation module M22*c*, the selection module M22*b*, the output module M30*d*, and the inspection module M22*e* cause the computer C10 to perform the same functions as performed by the encoding units 10$a_1$-10$a_n$, the generation unit 22*c*, the selection unit 22*b*, the output unit 30*d*, and the inspection unit 22*e*, respectively.

Figure 44:
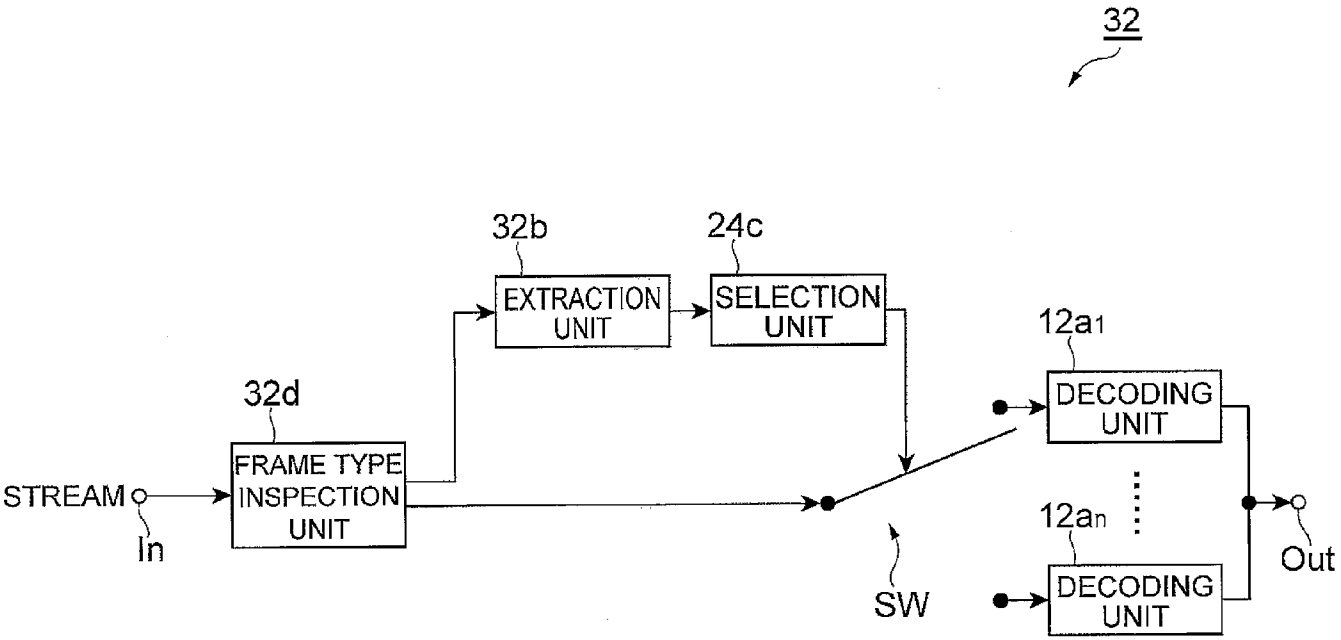
FIG. 44 is a drawing showing an audio decoding device according to another embodiment.

Described below is an audio decoding device that decodes a stream generated by the audio encoding device 30. FIG. 44 shows an audio decoding device according to another embodiment. The audio decoding device 32 shown in FIG. 44 has the elements in the audio decoding device 24, except an extraction unit 32*b* and a frame type inspection unit 32*d*. The extraction unit 32*b* and the frame type inspection unit 32*d* will be described below.

The frame type inspection unit 32*d* inspects a frame type of each frame in a stream fed to the input terminal In. Specifically, when the decoding target frame is a frame of the first frame type, the frame type inspection unit 32*d* provides the frame to the extraction unit 30*b* and the switch SW1. On the other hand, when the decoding target frame is a frame of the second frame type, the frame type inspection unit 32*d* sends the frame to the switch SW1 only. The extraction unit 32*b* extracts the long-term encoding scheme information from inside the frame received from the frame type inspection unit 32*d* and provides the long-term encoding scheme information to the selection unit 24*c*.

Figure 45:
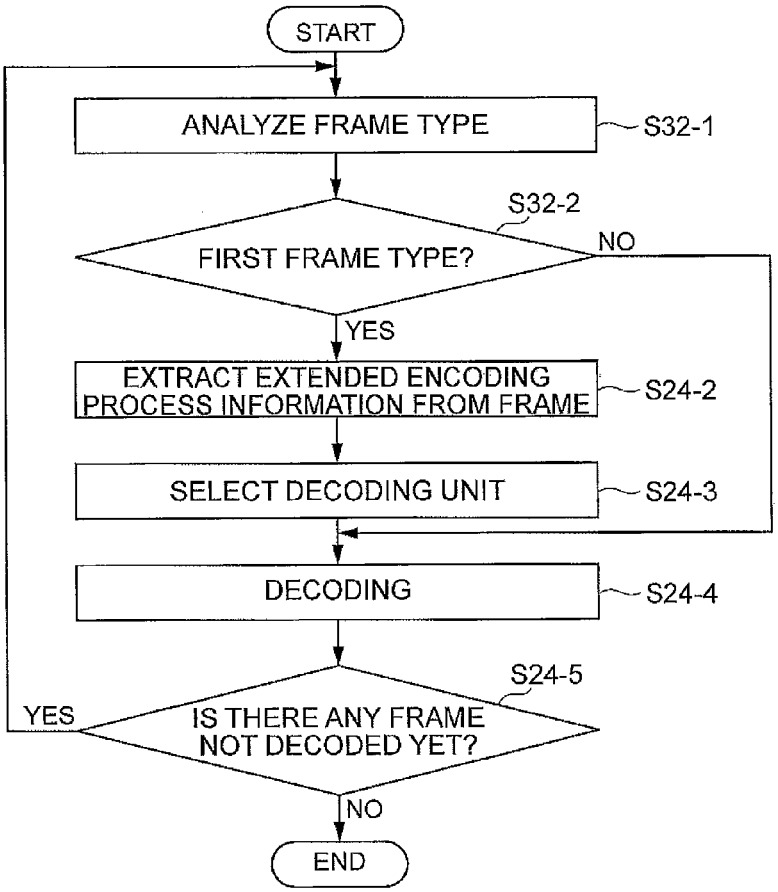
FIG. 45 is a flowchart of an audio decoding method according to another embodiment.

FIG. 45 is a flowchart of an audio decoding method according to another embodiment. Described below with reference to FIG. 45 are operations of the audio decoding device 32 and an audio decoding method according to another embodiment. It is noted that in the processes shown in FIG. 45, the processes represented by reference characters including "S24"

are the processes shown in FIG. 31. Described below are step S32-1 and step S32-2, which are not shown in FIG. 31.

In step S32-1, the frame type inspection unit 32*d* analyzes whether the decoding target frame is a frame of the first frame type. When it is judged in subsequent step S32-2 that the decoding target frame is a frame of the first frame type, step S24-2 is carried out in which the extraction unit 32*b* extracts the long-term encoding scheme information from the frame. On the other hand, when it is determined in step S32-2 that the decoding target frame is not a frame of the first frame type, the process proceeds to step S24-4. Namely, once a decoding unit is selected in step S24-3, the common decoding unit is continuously used until a next frame of the first frame type is fed.

Figure 46:
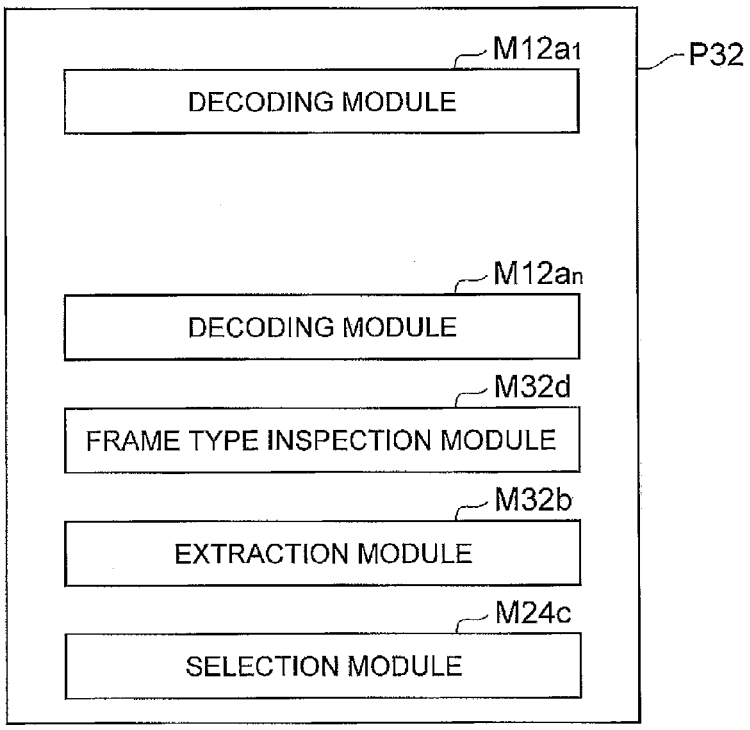
FIG. 46 is a drawing showing an audio decoding program according to another embodiment.

Described below is an audio decoding program that causes a computer to operate as the audio decoding device 32. FIG. 46 shows an audio decoding program according to another embodiment.

An audio decoding program P32 shown in FIG. 46 may be executed in the computer shown in FIGS. 5 and 6. Furthermore, the audio decoding program P32 can be provided in the same manner as the audio encoding program P10.

As shown in FIG. 46, the audio decoding program P24 is comprised of the decoding modules M12$a_1$-12$a_n$, an extraction module M32*b*, the selection module M24*c*, and a frame type inspection module M32*d*.

The decoding modules M12$a_1$-12$a_n$, the extraction module M32*b*, the selection module M24*c*, and the frame type inspection module M32*d* cause the computer C10 to perform the same functions as performed by the decoding units 12$a_1$-12$a_n$, the extraction unit 32*b*, the selection unit 24*c*, and the frame type inspection unit 32*d*, respectively.

Figure 47:
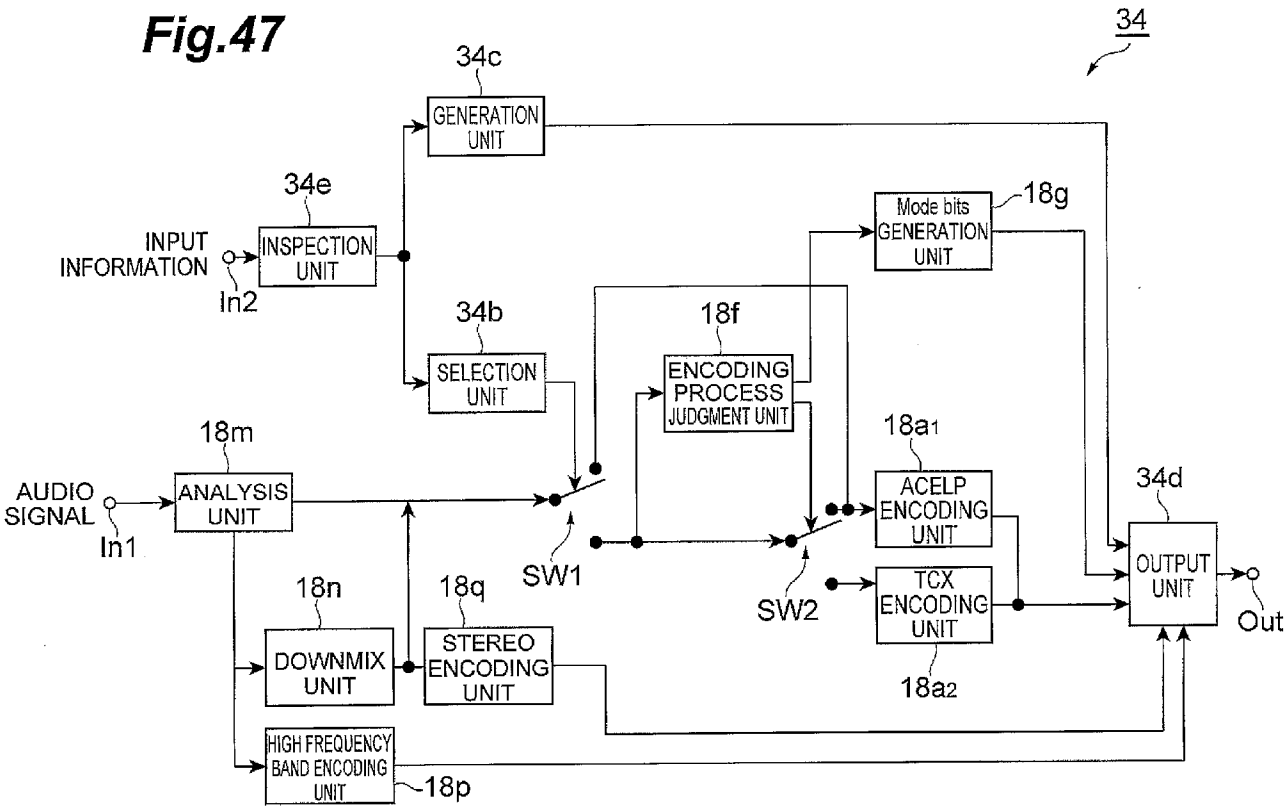
FIG. 47 is a drawing showing an audio encoding device according to another embodiment.

Described below is an audio encoding device according to another embodiment. FIG. 47 shows an audio encoding device according to another embodiment. The audio encoding device 34 shown in FIG. 47 is different from the audio encoding device 18 in the points described below. Namely, the audio encoding device 34 uses a common audio encoding scheme for some continuous frames of input frames and uses respective audio encoding schemes for some other frames. The audio encoding device 34 uses a common audio encoding scheme for first plurality of frames, uses respective audio encoding schemes for some subsequent frames, and uses a common audio encoding scheme for second plurality of frames subsequent thereto. FIG. 48 shows a stream generated according to conventional AMR-WB+ and a stream generated by the audio encoding device shown in FIG. 47. As shown in FIG. 48, the audio encoding device 34 outputs frames of the first frame type including GEM_ID and frames of the second frame type not including GEM_ID.

As shown in FIG. 47, like the audio encoding device 18, the audio encoding device 34 is comprised of the ACELP encoding unit 18$a_1$, the TCX encoding unit 18$a_2$, the encoding scheme judgment unit 18*f*, the Mode bits generation unit 18*g*, the analysis unit 18*m*, the downmix unit 18*n*, the high frequency band encoding unit 18*p*, and the stereo encoding unit 18*q*. The audio encoding device 34 is further comprised of an inspection unit 34*e*, a selection unit 34*b*, a generation unit 34*c*, and an output unit 34*d*. Described below are elements among the elements of the audio encoding device 34 which are different from those of the audio encoding device 18.

The inspection unit 34*e* monitors an input of input information to the input terminal In2. The input information indicates whether a common encoding scheme is to be used for audio signals of multiple frames. When the inspection unit detects an input of the input information, the selection unit 34*b* determines whether the input information indicates that a common encoding scheme is to be used for audio signals of multiple frames. When the input information indicates that a common encoding scheme is to be used for audio signals of multiple frames, the selection unit 34*b* controls the switch SW1 to connect the switch SW1 to the ACELP encoding unit 18$a_1$. This connection is maintained until an input of next input information is detected. On the other hand, when the input information does not indicate that a common encoding scheme is to be used for audio signals of multiple frames, i.e., when the input information indicates that respective encoding schemes are to be used for respective encoding target frames, the selection unit 34*b* connects the switch SW1 to a path including the encoding scheme judgment unit 18*f* and others.

When the inspection unit detects an input of the input information, the generation unit 34*c* generates GEM_ID having a value according to the input information. Specifically, when the input information indicates that a common encoding scheme is to be used for audio signals of multiple frames, the generation unit 34*c* sets the value of GEM_ID to "1." On the other hand, when the input information does not indicate that a common encoding scheme is to be used for audio signals of multiple frames, the generation unit 34*c* sets the value of GEM_ID to "0."

When the inspection unit 34*e* detects the input information, the output unit 34*d* adopts an output frame corresponding to an encoding target frame found at that point as an output frame of the first frame type, adds GEM_ID generated by the generation unit 34*c* in the output frame, and adds a coded sequence of an audio signal of the encoding target frame in the output frame. When the value of GEM_ID is 0, the output unit 34*d* adds Mode bits[k] in the output frame. On the other hand, when the inspection unit 34*e* detects no input information, the output unit adopts an output frame corresponding to the encoding target frame found at that point as an output frame of the second frame type and adds a coded sequence of an audio signal of the encoding target frame in the output frame. The output unit 34*d* outputs the output frame generated as described above.

Figure 49:
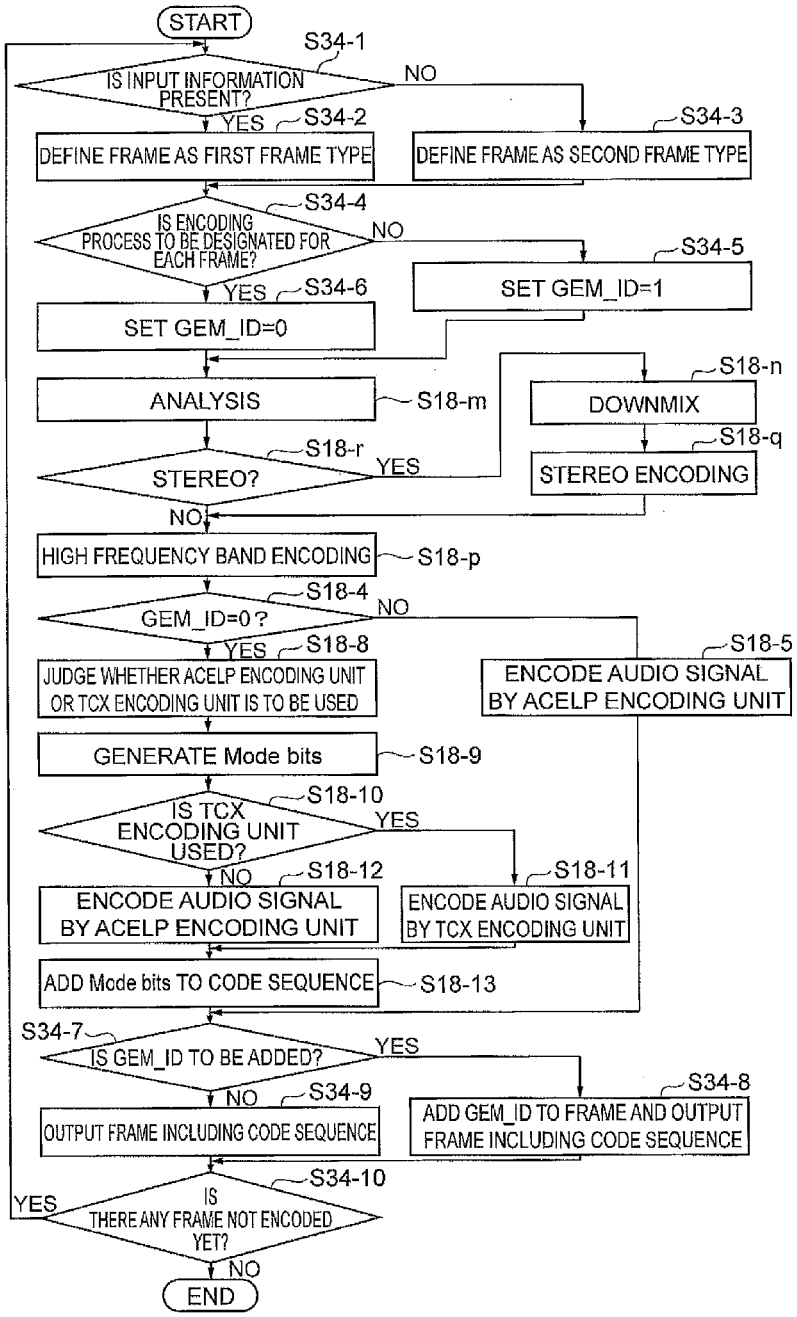
FIG. 49 is a flowchart of an audio encoding method according to another embodiment.

FIG. 49 is a flowchart of an audio encoding method according to another embodiment. Described below with respect to FIG. 49 are operations of the audio encoding device 34 and the audio encoding method according to 1 another embodiment. It is noted that in the processes shown in FIG. 49, the processes represented by reference characters including "S18" are the processes shown in FIG. 21. Described below are the processes among the processes in the flow shown in FIG. 49 which are different from those in FIG. 21.

In the embodiment as shown in FIG. 49, in step S34-1, the inspection unit 34*e* monitors an input of input information to the input terminal In2. When an input of input information is detected, subsequent step S34-2 is carried out in which an output frame corresponding to the encoding target frame is adopted as an output frame of the first frame type. On the other hand, when an input of input information is not detected, subsequent step S34-3 is carried out in which an output frame corresponding to the encoding target frame is adopted as an output frame of the second frame type.

It is then judged in step S34-4 whether the input information indicates that encoding schemes are designated for respective frames. Namely, it is judged whether the input information indicates that a common encoding scheme is to be used for multiple frames. When the input information indicates that a common encoding scheme is to be used for multiple frames, subsequent step S34-5 is carried out in which the value of GEM_ID is set to "1." On the other hand, when the input information does not indicate that a common encoding scheme is to be used for multiple frames, subsequent step S34-6 is carried out in which the value of GEM_ID is set to "0."

It is judged in step S34-7 whether GEM_ID is to be added. Specifically, if the encoding target frame being processed is the one found when an input of input information is detected, subsequent step S34-8 is carried out in which GEM_ID is added and an output frame of the first frame type including a coded sequence is outputted. On the other hand, if the encoding target frame being processed is one found when an input of input information is detected, subsequent step S34-9 is carried out in which an output frame of the second frame type including a coded sequence is outputted.

It is then judged in step S34-10 whether there is any frame left to be encoded. When there is no frame left uncoded, the process ends. On the other hand, when there is a frame left to be encoded, the processes from step S34-1 are executed for a target frame.

Figure 50:
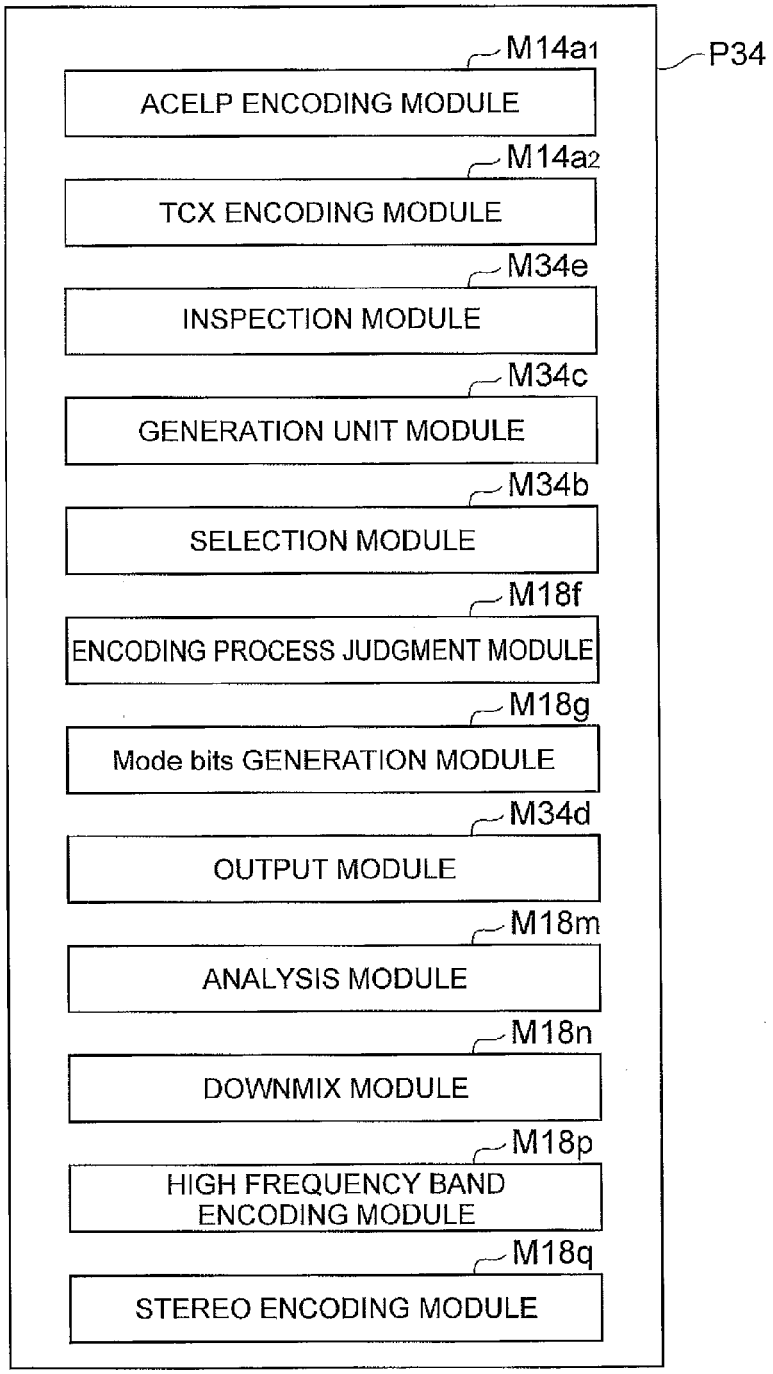
FIG. 50 is a drawing showing an audio encoding program according to another embodiment.

Describe below is an audio encoding program that cause a computer to operate as the audio encoding device 34. FIG. 50 shows an audio encoding program according to another embodiment.

The audio encoding program P34 shown in FIG. 50 may be executed in the computer shown in FIGS. 5 and 6. Furthermore, the audio encoding program P34 can be provided in the same manner as the audio encoding program P10.

An audio encoding program P34 is comprised of the ACELP encoding module M18$a_1$, the TCX encoding module M18$a_2$, a selection module M34*b*, a generation module M34*c*, an output module M34*d*, the encoding scheme judgment module M18*f*, the Mode bits generation module M18*g*, the analysis module M18*m*, the downmix module M18*n*, the high frequency band encoding module M18*p*, and the stereo encoding module M18*q*.

The CELP encoding module M18$a_1$, the TCX encoding module M18$a_2$, the selection module M34*b*, the generation module M34*c*, the output module M34*d*, the encoding scheme judgment module M18*f*, the Mode bits generation module M18*g*, the analysis module M18*m*, the downmix module M18*n*, the high frequency band encoding module M18*p*, and the stereo encoding module M18*q* cause the computer C10 to perform the same functions as performed by the ACELP encoding unit 18$a_1$, the TCX encoding unit 18$a_2$, the selection unit 34*b*, the generation unit 34*c*, the output unit 34*d*, the encoding scheme judgment unit 18*f*, the Mode bits generation unit 18*g*, the analysis unit 18*m*, the downmix unit 18*n*, the high frequency band encoding unit 18*p*, and the stereo encoding unit 18*q*, respectively.

Figure 51:
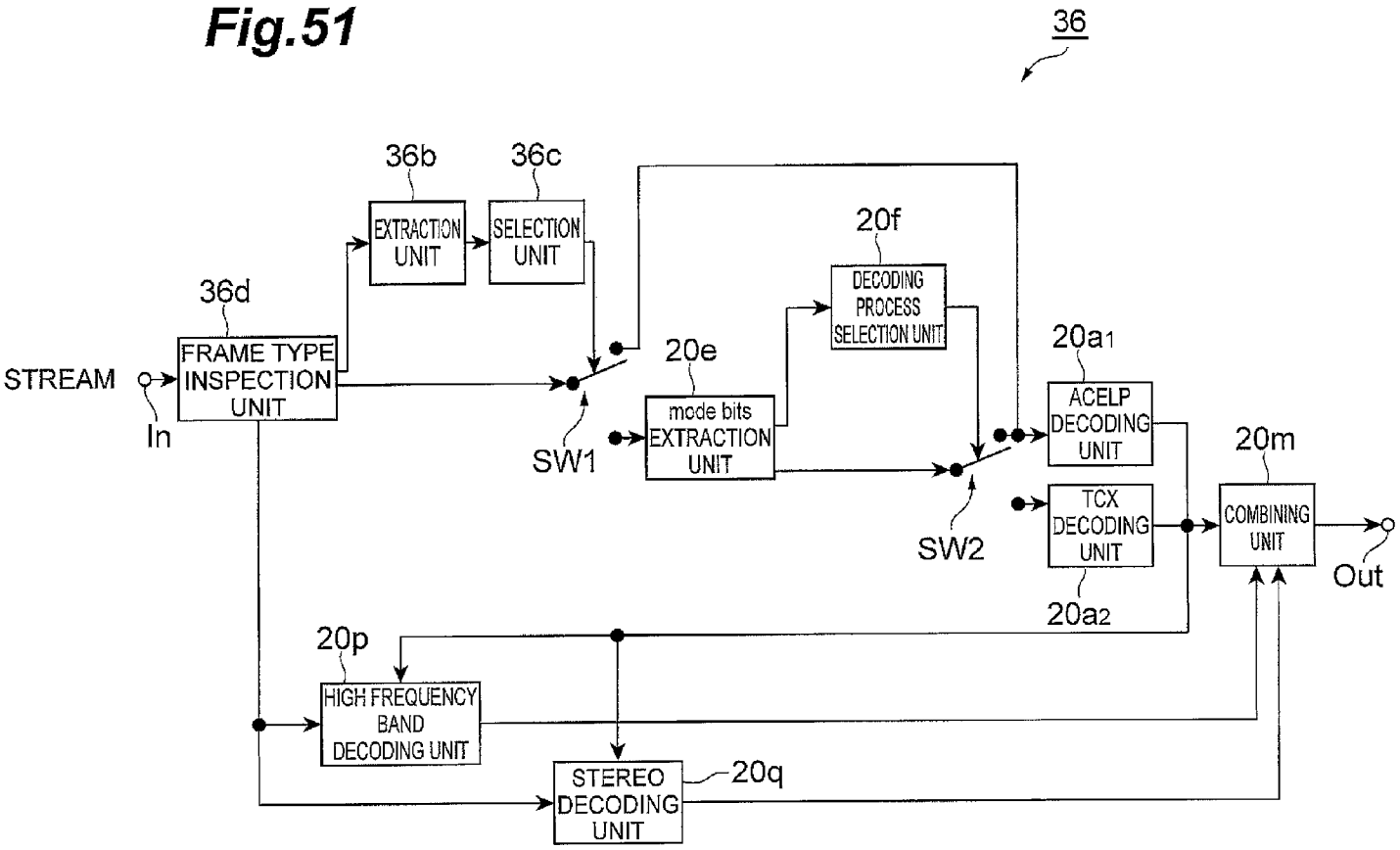
FIG. 51 is a drawing showing an audio decoding device according to another embodiment.

Described below is an audio decoding device that decodes a stream generated by the audio encoding device 34. FIG. 51 shows an audio decoding device according to another embodiment.

Like the audio decoding device 20, an audio decoding device 36 shown in FIG. 51 is comprised of the ACELP decoding unit 20$a_1$, the TCX decoding unit 20$a_2$, the Mode bits extraction unit 20*e*, the decoding scheme selection unit 20*f*, the high frequency band decoding unit 20*p*, the stereo decoding unit 20*q*, and the synthesis unit 20*m*. The audio decoding device 36 is further comprised of a frame type inspection unit 36*d*, an extraction unit 36*b*, and a selection unit 36*c*. Described below are elements among the elements of the audio decoding device 36 which are different from those of the audio decoding device 20.

The frame type inspection unit 36*d* inspects a frame type of each frame in a stream fed to the input terminal In. The frame type inspection unit 36*d* sends a frame of the first frame type to the extraction unit 36*b*, the switch SW1, the high frequency band decoding unit 20*p*, and the stereo decoding unit 20*q*. On the other hand, the frame type inspection unit 36*d* sends a frame of the second frame type to the switch SW1, the high frequency band decoding unit 20*p*, and the stereo decoding unit 20*q* only.

The extraction unit 36*b* extracts GEM_ID from the frame received from the frame type inspection unit 36*d*. The selection unit 36*c* controls the switch SW1 according to the value of GEM_ID extracted. Specifically, when the value of GEM_ID is "1," the selection unit 36*c* controls the switch SW1 to connect the decoding target frame to the ACELP decoding unit 20$a_1$. When the value of GEM_ID is "1," the ACELP decoding unit 20$a_1$ is continuously selected until a next frame of the first frame type is fed. On the other hand, when the value of GEM_ID is "0," the selection unit 36*c* controls the switch SW1 to connect the decoding target frame to the Mode bits extraction unit 20*e*.

Figure 52:
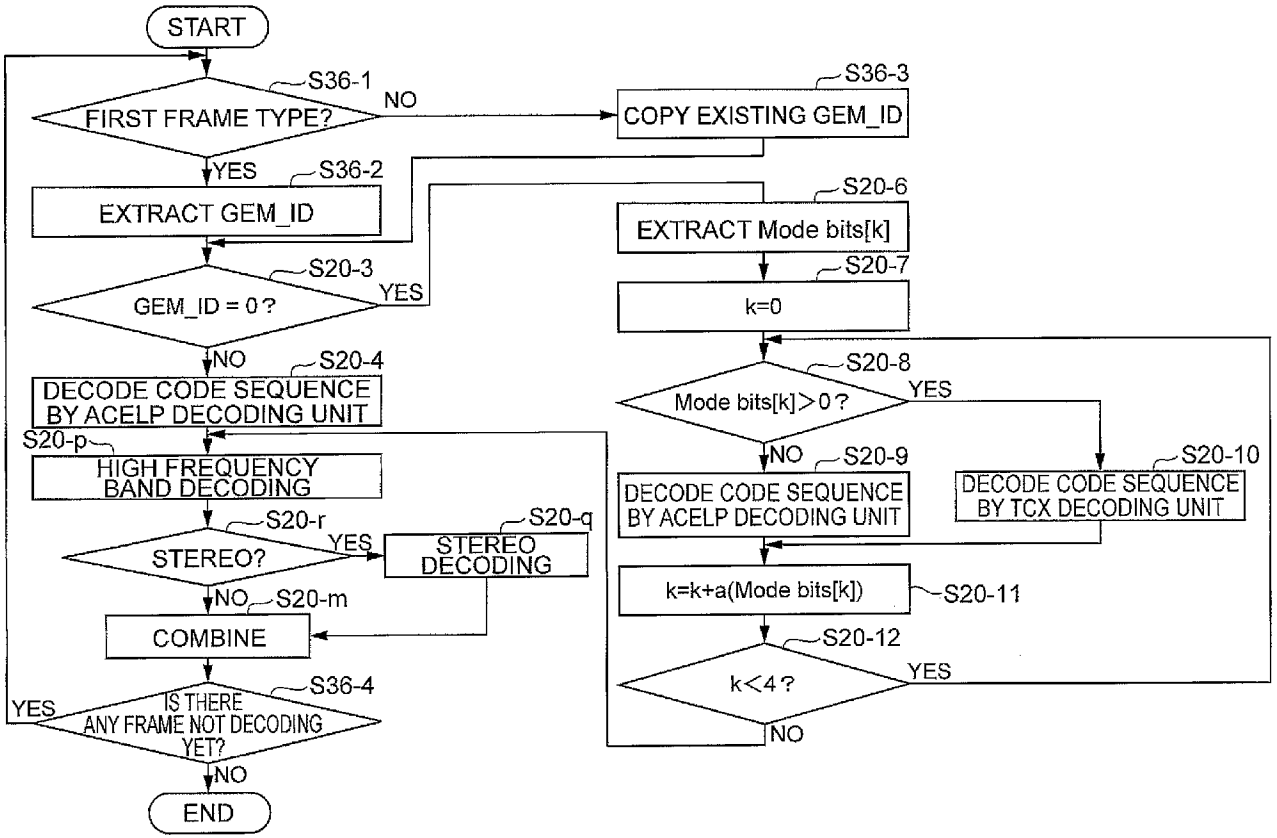
FIG. 52 is a flowchart of an audio decoding method according to another embodiment.

FIG. 52 is a flowchart of an audio decoding method according to another embodiment. Described below with reference to FIG. 52 are operations of the audio decoding device 36 and the audio decoding method according to another embodiment. It is noted that in the processes shown in FIG. 52, the processes including "S20" are the processes shown in FIG. 24. Described below are the processes among the processes in the flow shown in FIG. 52 which are different from those shown in FIG. 24.

In the embodiment as shown in FIG. 52, in step S36-1, the frame type inspection unit 36*d* judges whether the decoding target frame is a frame of the first frame type. When the decoding target frame is a frame of the first frame type, subsequent step S36-2 is carried out in which the extraction unit 36*b* extracts GEM_ID. On the other hand, when the decoding target frame is a frame of the second frame type, subsequent step S36-3 is carried out in which existing GEM_ID is copied and used in the subsequent processes.

It is judged in step S36-4 whether there is any frame left to be decoded. When there is no frame left to be decoded, the process ends. On the other hand, there is a frame left to be decoded, the processes from step S36-1 are executed for a target frame.

Figure 53:
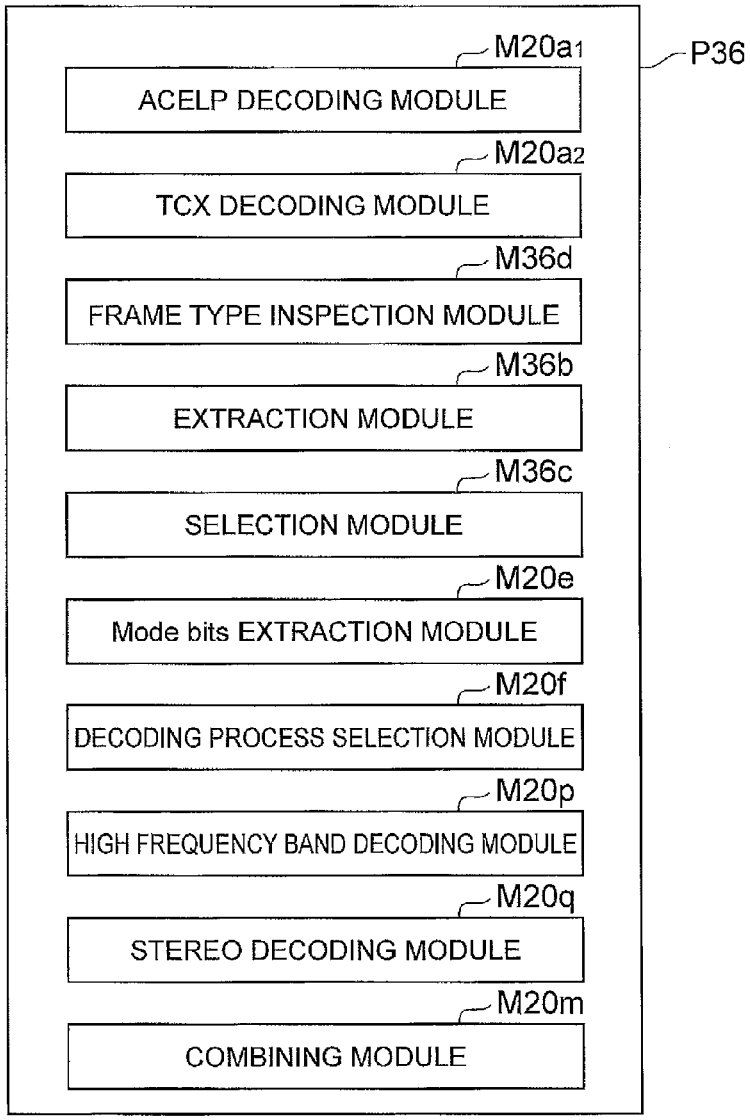
FIG. 53 is a drawing showing an audio decoding program according to another embodiment.

Described below is an audio decoding program that causes a computer to operate as the audio decoding device 36. FIG. 53 shows an audio decoding program according to another embodiment.

The audio decoding program P36 shown in FIG. 53 may be executed in the computer shown in FIGS. 5 and 6. The audio decoding program P36 can be provided in the same manner as the audio encoding program P10.

The audio decoding program P36 is comprised of the ACELP decoding module M20$a_1$, the TCX decoding module M20$a_2$, an extraction module M36*b*, a selection module M36*c*, a frame type inspection module M36*d*, the Mode bits extraction module M20*e*, the decoding scheme selection module M20*f*, the high frequency band decoding module M20*p*, the stereo decoding module M20*q*, and the synthesis module M20*m*.

The ACELP decoding module M20$a_1$, the TCX decoding module M20$a_2$, the extraction module M36*b*, the selection module M36*c*, the frame type inspection module M36*d*, the Mode bits extraction module M20*e*, the decoding scheme selection module M20*f*, the high frequency band decoding module M20*p*, the stereo decoding module M20*q*, and the synthesis module M20*m* cause a computer to perform the same functions as performed by the ACELP decoding unit 20$a_1$, the TCX decoding unit 20$a_2$, the extraction unit 36*b*, the selection unit 36*c*, the frame type inspection unit 36*d*, the Mode bits extraction unit 20*e*, the decoding scheme selection unit 20*f*, the high frequency band decoding unit 20*p*, the stereo decoding unit 20*q*, and the synthesis unit 20*m*, respectively.

The various embodiments of the present invention have been described above. It should be noted that the present invention is not limited to the above-described embodiments and may be modified in many ways. For example, in some of the above-described embodiments, the ACELP encoding scheme and the ACELP decoding scheme are selected as an encoding scheme and a decoding scheme used commonly for multiple frames. However, the encoding scheme and decoding scheme used commonly are not always limited to the ACELP encoding scheme and decoding scheme. They may be any audio encoding scheme and audio decoding scheme. Furthermore, aforementioned GEM_ID may be GEM_ID set in any bit size and value.

What is claimed is:

1. An audio decoding device comprising;

a processor;

a plurality of decoding units each executable by the processor to perform different audio decoding schemes, respectively, to generate audio signals from coded sequences;

an extraction unit executable by the processor to extract, from a stream having multiple frames, each including a coded sequence of an audio signal, long-term encoding scheme information for the multiple frames, the long-term encoding scheme information indicating a same audio encoding scheme is to be used to generate coded sequences of the multiple frames, wherein in the stream, each frame coming subsequent to a lead frame in the multiple frames does not include information identifying a specific audio encoding scheme to be used to generate a coded sequence of said each frame; and a selection unit executable by the processor in response to extraction of the long-term encoding scheme information, to select from the plurality of decoding units, a same decoding unit to be used commonly to decode the coded sequences of the multiple frames.

2. The audio decoding device according to claim 1, wherein the selection unit is further executable by the processor to select a predetermined decoding unit from the plurality of decoding units in response to the long-term encoding scheme information extracted from the stream by the extraction unit not including information identifying the specific audio encoding scheme to be used to generate the coded sequences of the multiple frames, the long-term encoding scheme information being different from the information identifying the specific audio encoding scheme.

3. The audio decoding device according to claim 2, wherein the long-term encoding scheme information is 1-bit information.

4. An audio encoding device comprising:

a processor;

a plurality of encoding units each executable by the processor to perform different audio encoding schemes, respectively, to generate coded sequences from audio signals;

a selection unit executable by the processor to select, from the plurality of encoding units, a same encoding unit to be used commonly to encode audio signals of multiple frames;

a generation unit executable by the processor to generate long-term encoding scheme information for the multiple frames, the long-term encoding scheme information indicating that a same audio encoding scheme is to be used to generate coded sequences of the multiple frames; and an output unit which outputs a stream including the coded sequences of the multiple frames generated by the encoding unit selected by the selection unit, and the long-term encoding scheme information, wherein, in the stream, each frame subsequent to a lead frame in the multiple frames does not include information identifying a specific audio encoding scheme to be used to generate a coded sequence of said each frame.

5. The audio encoding device according to claim 4, wherein the selection unit is further executable by the processor to select a predetermined encoding unit from the plurality of encoding units, and wherein the stream does not include information identifying the specific audio encoding scheme to be used to generate the coded sequences of the multiple frames, the long-term encoding scheme information being different from the information identifying the specific audio encoding scheme.

6. The audio encoding device according to claim 5, wherein the long-term encoding scheme information is 1-bit information.

7. An audio decoding method comprising;

a step of extracting with an extraction unit executable by a processor, from a stream having multiple frames, each including a coded sequence of an audio signal, long-term encoding scheme information which indicates that a same audio encoding scheme is to be used to generate coded sequences of the multiple frames, wherein in the stream, each frame coming subsequent to a lead frame in the multiple frames does not include information identifying a specific audio encoding scheme to be used to generate a coded sequence of said each frame;

a step of, in response to extraction of the long-term encoding scheme information, selecting, with a selecting unit executable by the processor, from a plurality of different audio decoding schemes, a same audio decoding scheme to be used commonly to decode the coded sequences of the multiple frames; and a step of decoding, with a decoding unit executable by the processor, the coded sequences of the multiple frames, using the selected same audio decoding scheme.

8. An audio encoding method comprising:

selecting, with a selecting unit executable by a processor, from a plurality of different audio decoding schemes, a same audio encoding scheme to be used commonly to encode audio signals of multiple frames;

a step of encoding, with an encoding unit executable by the processor, the audio signals of the multiple frames using the same selected audio encoding scheme to generate coded sequences of the multiple frames;

a step of generating, with a generating unit executable by the processor, long-term encoding scheme information for the multiple frames, the long-term encoding scheme information indicating that a same audio encoding scheme is to be used to generate the coded sequences of the multiple frames; and a step of outputting, with an output unit executable by the processor, a stream including the coded sequences of the multiple frames, and the long-term encoding scheme information, wherein, in the stream, each frame subsequent to a lead frame in the multiple frames does not include information identifying a specific audio encoding scheme to be used to generate a coded sequence of said each frame.

9. A non-transitory storage medium that includes instructions executable by a processor, the non-transitory storage medium comprising:

instructions executable by the processor to cause any of a plurality of decoding units which execute different audio decoding schemes, respectively, to generate audio signals from coded sequences;

instructions executable by the processor to cause an extraction unit to extract, from a stream having multiple frames each including a coded sequence of an audio signal, long-term encoding scheme information for the multiple frames which indicates that a same audio encoding scheme is to be used to generate coded sequences of the multiple frames, wherein in the stream, each frame coming subsequent to a lead frame in the multiple frames does not include information identifying a specific audio encoding scheme to be used to generate a coded sequence of said each frame; and instructions executable by the processor to cause a selection unit, in response to extraction of the long-term encoding scheme information, to select, from the plurality of decoding units, a same decoding unit to be used to decode the coded sequences of the multiple frames.

10. A non-transitory storage medium that includes instructions executable by a processor, the non-transitory storage medium comprising:

instructions executable by the processor to cause any of a plurality of encoding units which execute different audio encoding schemes, respectively, to generate coded sequences from audio signals;

instructions executable by the processor to cause a selection unit to select, from the plurality of encoding units, a same encoding unit to be used to encode audio signals of multiple frames;

instructions executable by the processor to cause a generation unit to generate long-term encoding scheme information for the multiple frames which indicates that a same audio encoding scheme is to be used to generate coded sequences of the multiple frames; and instructions executable by the processor to cause an output unit to output a stream including the coded sequences of the multiple frames generated by the same encoding unit selected by the selection unit, and the long-term encoding scheme information, wherein, in the stream, each frame subsequent to a lead frame in the multiple frames does not include information identifying a specific audio encoding scheme to be used to generate a coded sequence of said each frame.

* * * * *